US006387862B2

(12) United States Patent
Busch et al.

(10) Patent No.: US 6,387,862 B2
(45) **Date of Patent: *May 14, 2002**

(54) BLEACH COMPOSITIONS

(75) Inventors: Daryle Hadley Busch, Lawrence, KS (US); Simon Robert Collinson, Fleetwood (GB); Timothy Jay Hubin, Eudora, KS (US); Christopher Mark Perkins, Cincinnati, OH (US); Regine Labeque, Brussels (BE); Barbara Kay Williams, Cincinnati, OH (US); James Pyott Johnston, Merchtem (BE); David Johnathan Kitko; James Charles Theophile Roger Burckett-St. Laurent, both of Cincinnati, OH (US); Michael Eugene Burns, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/832,480

(22) Filed: Apr. 11, 2001

Related U.S. Application Data

(63) Continuation of application No. 09/380,674, filed as application No. PCT/IB98/00300 on Mar. 6, 1998, now Pat. No. 6,218,351.

(60) Provisional application No. 60/039,915, filed on Mar. 7, 1997, and provisional application No. 60/040,222, filed on Mar. 7, 1997.

(51) Int. Cl.[7] ..... C11D 3/00; C11D 7/18; C11D 7/54; C11D 15/00

(52) U.S. Cl. ..... 510/311; 510/376; 510/500

(58) Field of Search ..... 510/311, 367, 510/376, 500

(56) References Cited

U.S. PATENT DOCUMENTS

| | | | | |
|---|---|---|---|---|
| 3,919,102 A | | 11/1975 | Kuhling et al. | 252/99 |
| 4,888,032 A | | 12/1989 | Busch et al. | 55/38 |
| 5,126,464 A | | 6/1992 | Burrows | 549/520 |
| 5,153,161 A | | 10/1992 | Kerschner et al. | 502/167 |
| 5,194,416 A | | 3/1993 | Jureller et al. | 502/167 |
| 5,272,056 A | | 12/1993 | Burrows et al. | 435/6 |
| 5,329,024 A | | 7/1994 | Jureller et al. | 549/531 |
| 5,356,554 A | | 10/1994 | Delwel et al. | 252/94 |
| 5,409,627 A | | 4/1995 | Boskamp | 252/102 |
| 5,409,633 A | | 4/1995 | Clements et al. | 252/186.42 |
| 5,428,180 A | | 6/1995 | Burrows et al. | 549/520 |
| 5,429,769 A | | 7/1995 | Nicholson et al. | 252/186.42 |
| 5,433,884 A | | 7/1995 | Altieri et al. | 252/174.23 |
| 5,434,069 A | | 7/1995 | Tsaur et al. | 435/188 |
| 5,441,660 A | | 8/1995 | Tsaur et al. | 252/95 |
| 5,460,743 A | | 10/1995 | Delwel et al. | 252/174.23 |
| 5,466,390 A | | 11/1995 | Houghton et al. | 252/174.17 |
| 5,480,575 A | | 1/1996 | Altieri et al. | 252/94 |
| 5,480,577 A | | 1/1996 | Nicholson et al. | 252/174.13 |
| 5,480,990 A | | 1/1996 | Kiefer et al. | 540/465 |
| 5,484,555 A | | 1/1996 | Schepers | 252/541 |
| 5,504,075 A | | 4/1996 | Burrows et al. | 514/189 |
| 5,550,301 A | | 8/1996 | Bhinde et al. | 568/835 |
| 5,580,485 A | * | 12/1996 | Feringa et al. | 510/311 |
| 6,218,351 B1 | * | 4/2001 | Busch et al. | 510/311 |

FOREIGN PATENT DOCUMENTS

| | | | |
|---|---|---|---|
| EP | 0 458 398 A2 | 11/1991 | C11D/3/395 |
| EP | 0 509 787 A2 | 12/1992 | C11D/3/39 |
| WO | WO 95/10217 | 4/1995 | |
| WO | WO 95/19185 | 7/1995 | A61K/49/00 |
| WO | WO 95/19347 | 7/1995 | C07D/255/02 |
| WO | WO 95/20353 | 8/1995 | A61B/5/055 |
| WO | WO 95/30733 | 11/1995 | C11D/3/39 |
| WO | WO 95/34628 | 12/1995 | C11D/3/39 |
| WO | WO 98/39406 | 9/1998 | C11D/3/39 |

OTHER PUBLICATIONS

Weisman, Gary R. et al, "Synthesis and transition metal–complexes of new cross–bridged tetraamine ligands", Chem. Commun. (Cambridge) 1996, (8) 947–948.*

* cited by examiner

*Primary Examiner*—Lorna M. Douyon
*Assistant Examiner*—John M Petruncio
(74) *Attorney, Agent, or Firm*—Richard S. Echler, Sr.; C. Brant Cook; Kim W. Zerby

(57) ABSTRACT

Laundry or cleaning composition comprising: (a) a catalytically effective amount, preferably from about 1 ppb to about 99.9%, of a transition-metal bleach catalyst which is a complex of a transition-metal and a cross-bridged macropolycyclic ligand; and (b) at least about 0.1% of one or more laundry or cleaning adjunct materials, preferably comprising an oxygen bleaching agent. Preferred compositions are laundry compositions and automatic dishwashing detergents which provide enhanced cleaning/bleaching benefits through the use of such catalysts.

24 Claims, No Drawings

BLEACH COMPOSITIONS

CROSS REFERENCE TO RELATED APPLICATIONS

This application claims priority under 37 U.S.C. § 120 to continuation U.S. application Ser. No. 09/380,674 filed Sep. 7, 1999, now U.S. Pat. No. 6,218,351, which in turn claims priority under 35 U.S.C. § 371 to PCT International Application Serial No. PCT/IB98/00300 filed Mar. 6, 1998 which claims priority under 37 U.S.C. § 119(e) to U.S. Provisional Application Serial No. 60/039,915, filed Mar. 7, 1997 and U.S. Provisional Application Serial No. 60/040,222 filed Mar. 7, 1997.

TECHNICAL FIELD

The present invention relates to detergent and detergent additive compositions and to methods for their use. The compositions comprise selected transition metals such as Mn, Fe or Cr, with selected macropolycyclic rigid ligands, preferably cross-bridged macropolycyclic ligands. More specifically, the present invention relates to catalytic oxidation of soils and stains using cleaning compositions comprising said metal catalysts, such soils and stains being on surfaces such as fabrics, dishes, countertops, dentures and the like; as well as to dye transfer inhibition in the laundering of fabrics. The compositions include detergent adjuncts with catalysts including complexes of manganese, iron, chromium and other suitable transition metals with certain cross-bridged macropolycyclic ligands. Preferred catalysts include transition-metal complexes of ligands which are polyazamacropolycycles, especially including specific azamacrobicycles, such as cross-bridged derivatives of cyclam.

BACKGROUND OF THE INVENTION

A damaging effect of manganese on fabrics during bleaching has been known since the 19th century. In the 1960's and '70's, efforts were made to include simple Mn(II) salts in detergents, but none saw commercial success. More recently, metal-containing catalysts containing macrocycle ligands have been described for use in bleaching compositions. Preferred catalysts include those described as manganese-containing catalysts of small macrocycles, especially the compound 1,4,7-trimethyl-1,4,7-triazacyclononane. These catalysts assertedly catalyze the bleaching action of peroxy compounds against various stains. Several are said to be effective in washing and bleaching of substrates, including in laundry and cleaning applications and in the textile, paper and wood pulp industries. However, such metal-containing bleach catalysts, especially these manganese-containing catalysts, still have shortcomings, for example a tendency to damage textile fabric, relatively high cost, high color, and the ability to locally stain or discolor substrates.

Salts of cationic-metal dry cave complexes have been described (in U.S. Pat. No. 4,888,032, to Busch, Dec. 19, 1989) as complexing oxygen reversibly, and are taught as being useful for oxygen scavenging and separating oxygen from air. A wide variety of ligands are taught to be usable, some of which include macrocycle ring structures and bridging groups. See also: D. H. Busch, *Chemical Reviews,* (1993), 93, 847–880, for example the discussion of superstructures on polydentate ligands at pages 856–857, and references cited therein; B. K. Coltrain et al., "Oxygen Activation by Transition Metal Complexes of Macrobicyclic Cyclidene Ligands" in "The Activation of Dioxygen and Homogeneous Catalytic Oxidation", Ed. by E. H. R. Barton, et al. (Plenum Press, NY; 1993), pp. 359–380.

More recently the technical literature on azamacrocycles has grown at a rapid pace. Among the many references are Hancock et al., *J. Chem. Soc., Chem. Commun.*, (1987), 1129–1130; Weisman et al., "Synthesis and Transition Metal Complexes of New Cross-Bridged Tetraamine Ligands", *Chem. Commun.,* (1996), 947–948; U.S. Pat. Nos. 5,428,180, 5,504,075, and 5,126,464, all to Burrows et al.; U.S. Pat. No. 5,480,990, to Kiefer et al.; and U.S. Pat. No. 5,374,416, to Rousseaux et al. None of hundreds of such references identify which of numerous new ligands and/or complexes would be commercially useful in bleaching compositions. This history does not reveal the possibility that catalytic oxidation may alter almost all families of organic compounds to yield valuable products, but successful application as hard surface of fabric bleaching depends on a complex set of relationships including the activity of the putative catalyst, its survivability under reaction conditions, its selectivity, and the absence of undesirable side reactions or over-reaction.

In view of the long-felt need, the ongoing search for superior bleaching compositions containing transition-metal bleach catalysts, and in view of the lack of commercial success to this point, especially in fabric laundering compositions with transition-metal bleach catalysts; in view also of the ongoing need for improved cleaning compositions of all kinds which deliver superior bleaching and stain removal without disadvantages such as tendency to damage or discolor the material to be cleaned, and in view also of the known technical limitations of existing transition-metal bleach catalysts for detergent applications, especially in aqueous solutions at high pH, it would be very desirable to identify which of thousands of potential transition-metal complexes might successfully be incorporated in laundry and cleaning products. Accordingly it is an an object herein to provide superior cleaning compositions incorporating selected transition-metal bleach catalysts with detergent or cleaning adjuncts that resolve one or more of the known limitations of such compositions.

It has now surprisingly been determined that, for use in laundry and hard-surface cleaning products, transition-metal catalysts having specific cross-bridged macropolycyclic ligands have exceptional kinetic stability such that the metal ions only dissociate very slowly under conditions which would destroy complexes with ordinary ligands, and further have exceptional thermal stability. Thus, the catalysts useful in the present invention compositions can provide one or more important benefits. These include improved effectiveness of the compositions, and in some instances even synergy with one or more primary oxidants such as hydrogen peroxide, hydrophilically or hydrophobically activated hydrogen peroxide, preformed peracids, or monopersulfate; the cleaning compositions include some especially those containing Mn(II), in which the catalyst is particularly well color-matched with other detergent ingredients, the catalyst having little to no color. The compositions afford great formulation flexibility in consumer products where product aesthetics are very important; and are effective on many types of soils and soiled substrates, including a variety of soiled or stained fabrics or hard surfaces. The compositions permit compatible incorporation of many types of detergent adjuncts, including hydrophobic bleach activators, with excellent results. Moreover, the compositions reduce or even mninimize tendency to stain or damage such surfaces.

These and other objects are secured herein, as will be seen from the following disclosures.

BACKGROUND ART

Laundry bleaching is reviewed in Kirk Othmer's Encyclopedia of Chemical Technology, 3rd and 4th editions, under a number of headings including "Bleaching Agents", "Detergents" and "Peroxy Compounds". The use of amido-derived bleach activators in laundry detergents is described in U.S. Pat. No. 4,634,551. The use of manganese with various ligands to enhance bleaching is reported in the following U.S. Patents: U.S. Pat. No. 4,430,243; U.S. Pat. No. 4,728,455; U.S. Pat. No. 5,246,621; U.S. Pat. No. 5,244,594; U.S. Pat. No. 5,284,944; U.S. Pat. No. 5,194,416; U.S. Pat. No. 5,246,612; U.S. Pat. No. 5,256,779; U.S. Pat. No. 5,280,117; U.S. Pat. No. 5,274,147; U.S. Pat. No. 5,153,161; U.S. Pat. No. 5,227,084; U.S. Pat. No. 5,114,606; U.S. Pat. No. 5,114,611. See also: EP 549,271 A1; EP 544,490 A1; EP 549,272 A1; and EP 544,440 A2.

U.S. Pat. No. 5,580,485 describes a bleach and oxidation catalyst comprising an iron complex having formula $A[LFeX_n]^Z Y_q(A)$ or precursors thereof, in which Fe is iron in the II, III, IV or V oxidation state, X represents a coordinating species such as $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$ or aromatic N donors such as pyridines, pyrazines, pyrazoles, imidazoles, benzimidazoles, pyrimidines, triazoles and thiazoles with R being H, optionally substituted alkyl, optionally substituted aryl; n is 0–3; Y is a counter ion, the type of which is dependent on the charge of the complex; q=z/[charge Y]; z denotes the charge of the complex and is an integer which can be positive, zero or negative; if z is positive, Y is an anion such as $F^-$, $Cl^-$, $Br^-$, $I^-$, $NO_3^-$, $BPh_4^-$, $ClO_4^-$, $BF_4^-$, $PF_6^-$, $RSO_3^-$, $RSO_4^-$, $SO_4^{2-}$, $CF_3SO_3^-$, $RCOO^-$ etc; if z is negative, Y is a common cation such as an alkali metal, alkaline earth metal or (alkyl)ammonium cation etc; L is said to represent a ligand which is an organic molecule containing a number of hetero atoms, e.g. N, P, O, S etc. which co-ordinates via all or some of its hetero atoms and/or carbon atoms to the iron center. The most preferred ligand is said to be N,N-bis(pyridin-2-yl-methyl)-bis(pyridin-2-yl)methylamine, $N_4Py$. The Fe-complex catalyst is said to be useful in a bleaching system comprising a peroxy compound or a precursor thereof and suitable for use in the washing and bleaching of substrates including laundry, dishwashing and hard surface cleaning. Alternatively, the Fe-complex catalyst is assertedly also useful in the textile, paper and woodpulp industries.

The art of the transition metal chemistry of macrocycles is enormous; see, for example "Heterocyclic compounds: Aza-crown macrocycles", J. S. Bradshaw et. al., *Wiley-Interscience,* (1993) which also describes a number of syntheses of such ligands. See especially the table beginning at p. 604. U.S. Pat. No. 4,888,032 describes salts of cationic metal dry cave complexes.

Cross-bridging, i.e., bridging across nonadjacent nitrogens, of cyclam (1,4,8,11-tetraazacyclotetradecane) is described by Weisman et al, *J. Amer. Chem. Soc.,* (1990), 112(23), 8604–8605. More particularly, Weisman et al., *Chem. Commun.,* (1996), 947–948 describe new cross-bridged tetraamine ligands which are bicyclo[6.6.2], [6.5.2], and [5.5.2] systems, and their complexation to Cu(II) and Ni(II) demonstrating that the ligands coordinate the metals in a cleft. Specific complexes reported include those of the ligands 1.1:

1.1

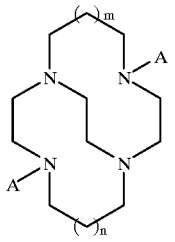

in which A is hydrogen or benzyl and (a) m=n=1; or (b) m=1 and n=0; or (c) m=n=0, including a Cu(II)chloride complex of the ligand having A=H and m=n=1; Cu(II) perchlorate complexes where A=H and m=n=1 or m=n=0; a Cu(II) chloride complex of the ligand having A=benzyl and m=n=0; and a Ni(II)bromide complex of the ligand having A=H and m=n=1. In some instances halide in these complexes is a ligand, and in other instances it is present as an anion. This handful of complexes appears to be the total of those known wherein the cross-bridging is not across "adjacent" nitrogens.

Ramasubbu and Wainwright, *J. Chem. Soc. Chem. Commun.,* (1982), 277–278 in contrast describe structurally reinforcing cyclen by bridging adjacent nitrogen donors. Ni(II) forms a pale yellow mononuclear diperchlorate complex having one mole of the ligand in a square planar configuration. Kojima et al, *Chemistry Letters,* (1996), pp 153–154 describes assertedly novel optically active dinuclear Cu(II) complexes of a structurally reinforced tricyclic macrocycle.

Bridging alkylation of saturated polyaza macrocycles as a means for imparting structural rigidity is described by Wainwright, *Inorg. Chem.,* (1980), 19(5), 1396–8. Mali, Wade and Hancock describe a cobalt (III) complex of a structurally reinforced macrocycle, see *J. Chem. Soc., Dalton Trans.*, (1992), (1), 67–71. Seki et al describe the synthesis and structure of chiral dinuclear copper(II) complexes of an assertedly novel reinforced hexaazamacrocyclic ligand; see *Mol. Cryst. Liq. Cryst. Sci. Technol.,* Sect. A (1996), 276, pp 79–84; see also related work by the same authors in the same Journal at 276, pp. 85–90 and 278, p.235–240. $[Mn(III)_2(\mu\text{-}O)(\mu\text{-}O_2CMe)_2L_2]^{2+}$ and $[Mn(IV)_2(\mu\text{-}O)_3L_2]^{2+}$ complexes derived from a series of N-substituted 1,4,7-triazacyclononanes are described by Koek et al., see *J. Chem. Soc., Dalton Trans.,* (1996), 353–362. Important earlier work by Wieghardt and co-workers on 1,4,7-triazacyclononane transition metal complexes, including those of Manganese, is described in Wieghardt et. al., *Angew. Chem. Internat. Ed. Engl.,* (1986), 25, 1030–1031 and Wieghardt et al., *J. Amer. Chem. Soc.,* (1988), 110, 7398. Ciampolini et al., *J. Chem. Soc., Dalton Trans.,* (1984), pp. 1357–1362 describe synthesis and characterization of the macrocycle 1,7-dimethyl-1,4,7,10-tetraazacyclododecane and of certain of its Cu(II) and Ni(II) complexes including both a square-planar Ni complex and a cis-octahedral complex with the macrocycle co-ordinated in a folded configuration to four sites around the central nickel atom. Hancock et al, *Inorg. Chem.,* (1990), 29, 1968–1974 describe ligand design approaches for complexation in aqueous solution, including chelate ring size as a basis for control of size-based selectivity for metal ions. Thermodynamic data for macrocycle interaction with cations, anions and neutral molecules is reviewed by Izatt et al., *Chem. Rev.,* (1995), 95, 2529–2586 (478 references). Bryan et al, *Inorganic Chemistry,* (1975), 14, No. 2., pp 296–299 describe synthesis and characterization of Mn(II) and Mn(III) complexes of meso-5,5,7-12,12,14-hexamethyl-1,4,8,11-tetraazacyclotetradecane ([14]aneN4]. The isolated solids are assertedly frequently contaminated with free ligand or "excess metal salt" and attempts to prepare chloride and bromide derivatives gave solids of variable composition which could not be purified by repeated crystallization. Costa and Delgado, *Inorg. Chem.,* (1993), 32, 5257–5265, describe metal complexes such as the Co(II), Ni(II) and Cu(II) complexes, of macrocyclic complexes containing pyridine. Derivatives of the cross-bridged cyclens, such as salts of 4,10-dimethyl-1,4,7,10-tetraazabicyclo[5.5.2] tetradecane, are described by Bencini et al., see *Supramolecular Chemistry,* 3, pp 141–146. U.S. Pat. No. 5,428,180 and related work by Cynthia Burrows and co-workers in U.S. Pat. No. 5,272,056 and U.S. Pat. No. 5,504,075 describe pH dependence of oxidations using cyclam or its derivatives, oxidations of alkenes to epoxides using metal complexes of such derivatives, and pharmaceutical applications. Hancock et al., *Inorganica Chimica Acta.,* (1989), 164,73–84 describe under a title including "complexes of structurally reinforced tetraaza-macrocyclic ligands of high ligand field strength" the synthesis of complexes of low-spin Ni(II) with three assertedly novel bicyclic macrocycles. The complexes apparently involve nearly coplanar arrangements of the four donor atoms and the metals despite the presence of the bicyclic ligand arrangement. Bencini et al., *J. Chem. Soc., Chem. Commun.,* (1990), 174–175 describe synthesis of a small aza-cage, 4,10-dimethyl-1,4,7,10,15-pentaazabicyclo[5.5.5]heptadecane, which "encapsulates" lithium. Hancock and Martell, *Chem. Rev.,* (1989), 89 1875–1914 review ligand design for selective complexation of metal ions in aqueous solution. Conformers of cyclam complexes are discussed on page 1894 including a folded conformer -see FIG. 18 (cis-V). The paper includes a glossary. In a paper entitled "Structurally Reinforced Macrocyclic Ligands that Show Greatly Enhanced Selectivity for Metal Ions on the Basis of the Match and Size Between the Metal Ion and the Macrocyclic Cavity", Hancock et al., *J. Chem. Soc., Chem. Commun.,* (1987), 1129–1130 describe formation constants for Cu(II), Ni(II) and other metal complexes of some bridged macrocycles having piperazine-like structure. Many other macrocycles are described in the art, including types with pedant groups and a wide range of intracyclic and exocyclic substituents. In short, although the macrocycle and transition metal complex literature is vast, relatively little appears to have been reported on cross-bridged tetraaza- and penta-aza macrocycles and there is no apparent singling out of these materials from the vast chemical literature, either alone or as their transition metal complexes, for use in bleaching detergents.

SUMMARY OF THE INVENTION

The present invention relates to a laundry or cleaning composition comprising:

(a) a catalytically effective amount, preferably from about 1 ppb to about 99.9%, more typically from about 0.001 ppm to about 49%, preferably from about 0.05 ppm to about 500 ppm (wherein "ppb" denotes parts per billion by weight and "ppm" denotes parts per million by weight), of a transition-metal bleach catalyst, wherein said transition-metal bleach catalyst comprises a complex of a transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV) coordinated with a macropolycyclic rigid ligand, preferably a cross-bridged macropolycyclic ligand, having at least 4 donor atoms, at least two of which are bridgehead donor atoms; and (b) the balance, to 100%, of one or more adjunct materials.

The present invention further relates to a laundry or cleaning composition comprising:

(a) a catalytically effective amount, preferably from about 1 ppb to about 99.9%, more typically from about 0.001 ppm to about 49%, preferably from about 0.05 ppm to about 500 ppm, of a transition-metal bleach catalyst, said catalyst comprising a complex of a transition metal and a cross-bridged macropolycyclic ligand, wherein:

(1) said transition metal is selected from the group consisting of Mn(III), Mn(III), Mn(IV), Fe(II), Fe(III), Cr(II), Cr(III), Cr(IV), Cr(V), and Cr(VI);

(2) said cross-bridged macropolycyclic ligand is coordinated by four or five donor atoms to the same transition metal and comprises:

(i) an organic macrocycle ring containing four or more donor atoms selected from N and optionally O and S, at least two of these donor atoms being N (preferably at least 3, more preferably at least 4, of these donor atoms are N), separated from each other by covalent linkages of 2 or 3 non-donor atoms, two to five (preferably three to four, more preferably four) of these donor atoms being coordinated to the same transition metal in the complex;

(ii) a cross-bridging chain which covalently connects at least 2 non-adjacent N donor atoms of the organic macrocycle ring, said covalently connected non-adjacent N donor atoms being bridgehead N donor atoms which are coordinated to the same transition metal in the complex, and wherein said cross-bridged chain comprises from 2 to about 10 atoms (preferably the cross-bridged chain is selected from 2, 3 or 4 non-donor atoms, and 4–6 non-donor atoms with a further, preferably N, donor atom); and (iii) optionally, one or more non-macropolycyclic ligands, preferably selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO^{43-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl; and (b) the balance, to 100%, preferably at least about 0.1%, of one or more laundry or cleaning adjunct materials, preferably comprising an oxygen bleaching agent.

Amounts of the essential transition-metal catalyst and essential adjunct materials can vary widely depending on the precise application. For example, the compositions herein may be provided as a concentrate, in which case the catalyst can be present in a high proportion, for example 0.01%–80%, or more, of the composition. The invention also encompasses compositions containing catalysts at their in-use levels; such compositions include those in which the catalyst is dilute, for example at ppb levels. Intermediate level compositions, for example those comprising from about 0.01 ppm to about 500 ppm, more preferably from about 0.05 ppm to about 50 ppm, more preferably still from about 0.1 ppm to about 10 ppm of transition-metal catalyst and the balance to 100%, preferably at least about 0.1%, typically about 99% or more being solid-form or liquid-form adjunct materials (for example fillers, solvents, and adjuncts especially adapted to a particular use).

More generally, the present invention also relates to a laundry or cleaning composition comprising:

(a) a catalytically effective amount, preferably from about 1 ppb to about 99.9%, of a transition-metal bleach catalyst which is a complex of a transition-metal and a cross-bridged macropolycyclic ligand; and (b) the balance, to 100%, of one or more laundry or cleaning adjunct materials, preferably comprising an oxygen bleaching agent.

The present invention further relates to laundry or cleaning compositions comprising:

(a) a catalytically effective amount, preferably from about 1 ppb to about 49%, of a transition-metal bleach catalyst, said catalyst comprising a complex of a transition metal and a macropolycyclic rigid ligand, preferably a cross-bridged macropolycyclic ligand, wherein:

(1) said transition metal is selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV);

(2) said macropolycyclic rigid ligand is coordinated by at least four, preferably four or five, donor atoms to the same transition metal and comprises:

(i) an organic macrocycle ring containing four or more donor atoms (preferably at least 3, more preferably at least 4, of these donor atoms are N) separated from each other by covalent linkages of at least one, preferably 2 or 3, non-donor atoms, two to five (preferably three to four, more preferably four) of these donor atoms being coordinated to the same transition metal in the complex;

(ii) a linking moiety, preferably a cross-bridging chain, which covalently connects at least 2 (preferably non-adjacent) donor atoms of the organic macrocycle ring, said covalently connected (preferably non-adjacent) donor atoms being bridgehead donor atoms which are coordinated to the same transition metal in the complex, and wherein said linking moiety (preferably a cross-bridged chain) comprises from 2 to about 10 atoms (preferably the cross-bridged chain is selected from 2, 3 or 4 non-donor atoms, and 4–6 non-donor atoms with a further donor atom), including for example, a cross-bridge which is the result of a Mannich condensation of ammonia and formaldehyde; and (iii) optionally, one or more non-macropolycyclic ligands, preferably monodentate ligands, such as those selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl (specific examples of monodentate ligands including phenolate, acetate or the like); and (b) at least about 0.1%, preferably B %, of one or more laundry or cleaning adjunct materials, preferably comprising an oxygen bleaching agent (where B %, the "balance" of the composition expressed as a percentage, is obtained by subtracting the weight of said component (a) from the weight of the total composition and then expressing the result as a percentage by weight of the total composition).

The present invention also preferably relates to laundry or cleaning compositions comprising:

(a) a catalytically effective amount, preferably from about 1 ppb to about 49%, of a transition-metal bleach catalyst, of a transition-metal bleach catalyst, said catalyst comprising a complex of a transition metal and a macropolycyclic rigid ligand (preferably a cross-bridged macropolycyclic ligand) wherein:

(1) said transition metal is selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), and;

(2) said macropolycyclic rigid ligand is selected from the group consisting of:

(i) the cross-bridged macropolycyclic ligand of formula (I) having denticity of 4 or 5:

(I)

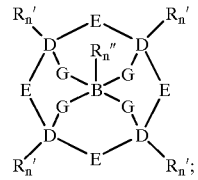

(ii) the cross-bridged macropolycyclic ligand of formula (II) having denticity of 5 or 6:

(II)

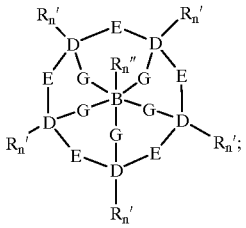

(iii) the cross-bridged macropolycyclic ligand of formula (III) having denticity of 6 or 7:

(III)

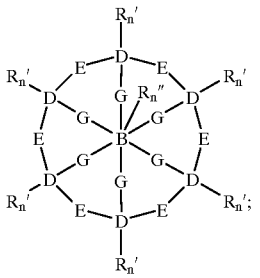

wherein in these formulas:

each "E" is the moiety $(CR_n)_a$—X—$(CR_n)_a'$, wherein —X— is selected from the group consisting of O, S, NR and P, or a covalent bond, and preferably X is a covalent bond and for each E the sum of a+a' is independently selected from 1 to 5, more preferably 2 and 3;

each "G" is the moiety $(CR_n)_b$;

each "R" is independently selected from H, alkyl, alkenyl, alkynyl, aryl, alkylaryl (e.g., benzyl), and heteroaryl, or two or more R are covalently bonded to form an aromatic, heteroaromatic, cycloalkyl, or heterocycloalkyl ring;

each "D" is a donor atom independently selected from the group consisting of N, O, S, and P, and at least two D atoms are bridgehead donor atoms coordinated to the transition metal (in the preferred embodiments, all donor atoms designated D are donor atoms which coordinate to the transition metal, in contrast with heteroatoms in the structure which are not in D such as those which may be present in E; the non-D heteroatoms can be non-coordinating and indeed are non-coordinating whenever present in the preferred embodiment);

"B" is a carbon atom or "D" donor atom, or a cycloalkyl or heterocyclic ring;

each "n" is an integer independently selected from 1 and 2, completing the valence of the carbon atoms to which the R moieties are covalently bonded;

each "n'" is an integer independently selected from 0 and 1, completing the valence of the D donor atoms to which the R moieties are covalently bonded;

each "n"" is an integer independently selected from 0, 1, and 2 completing the valence of the B atoms to which the R moieties are covalently bonded;

each "a" and "a'" is an integer independently selected from 0–5, preferably a+a' equals 2 or 3, wherein the sum of all "a" plus "a'" in the ligand of formula (I) is within the range of from about 6 (preferably 8) to about 12, the sum of all "a" plus "a'" in the ligand of formula (II) is within the range of from about 8 (preferably 10) to about 15, and the sum of all "a" plus "a'" in the ligand of formula (III) is within the range of from about 10 (preferably 12) to about 18;

each "b" is an integer independently selected from 0–9, preferably 0–5 (wherein when b=0, $(CR_n)_0$ represents a covalent bond), or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all "b" is within the range of from about 1 to about 5; and (iii) optionally, one or more non-macropolycyclic ligands; and (b) one or more laundry or cleaning adjunct materials, preferably comprising an oxygen bleaching agent, at suitable levels as identified hereinabove.

The present invention also preferably relates to laundry or cleaning compositions comprising:

(a) a catalytically effective amount, preferably from about 1 ppb to about 99.9%, of a transition-metal bleach catalyst, said catalyst comprising a complex of a transition metal and a cross-bridged macropolycyclic ligand, wherein:

(1) said transition metal is selected from the group consisting of Mn(II), Mn(III), Mn(IV), Fe(II), Fe(III), Cr(II), Cr(III), Cr(IV), Cr(V), and Cr(VI);

(2) said cross-bridged macropolycyclic ligand is selected from the group consisting of:

(I)

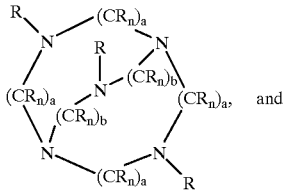

and (II)

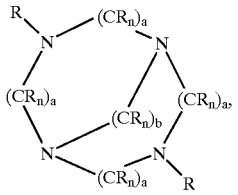

wherein in these formulas:

each "R" is independently selected from H, alkyl, alkenyl, alkynyl, aryl, alkylaryl (e.g., benzyl) and heteroaryl, or two or more R are covalently bonded to form an aromatic, heteroaromatic, cycloalkyl, or heterocycloalkyl ring;

each "n" is an integer independently selected from 0, 1 and 2, completing the valence of the carbon atoms to which the R moieties are covalently bonded;

each "b" is an integer independently selected from 2 and 3; and each "a" is an integer independently selected from 2 and 3; and (3) optionally, one or more non-macropolycyclic ligands; and (b) at least about 0.1%, preferably B %, of one or more laundry or cleaning adjunct materials, preferably comprising an oxygen bleaching agent (where B %, the "balance" of the composition expressed as a percentage, is obtained by subtracting the weight of said component (a) from the weight of the total composition and then expressing the result as a percentage by weight of the total composition).

The present invention further relates to methods for cleaning fabrics or hard surfaces, said method comprising contacting a fabric or hard surface in need of cleaning with an oxygen bleaching agent and a transition-metal bleach catalyst, wherein said transition-metal bleach catalyst comprises a complex of a transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), preferably Mn(II), Mn(III), Mn(IV), Fe(II), Fe(III), Cr(II), Cr(III), Cr(IV), Cr(V), and Cr(VI), preferably Mn, Fe and Cr in the (II) or (III) state, coordinated with a macropolycyclic rigid ligand, preferably a cross-bridged macropolycyclic ligand, having at least 4 donor atoms, at least two of which are bridgehead donor atoms.

All parts, percentages and ratios used herein are expressed as percent weight unless otherwise specified. All documents cited are, in relevant part, incorporated herein by reference.

DETAILED DESCRIPTION OF THE INVENTION

Bleach Compositions:

The compositions of the present invention comprise a particularly selected transition-metal bleach catalyst comprising a complex of a transition metal and a macropolycyclic rigid ligand, preferably one which is cross-bridged. The compositions also comprise at least one adjunct material, preferably comprising an oxygen bleaching agent, preferably one which is a low cost, readily available substance producing little or no waste, such as a source of hydrogen peroxide. The source of hydrogen peroxide can be $H_2O_2$ itself, its solutions, or any common hydrogen-peroxide releasing salt, adduct or precursor, such as sodium perborate, sodium percarbonate, or mixtures thereof. Also useful are other sources of available oxygen such as persulfate (e.g., OXONE, manufactured by DuPont), as well as preformed organic peracids and other organic peroxides.

Mixtures of oxygen bleaching agents can be used; in such mixtures, an bleaching agent which is not present in major proportion can be used, for example as in mixtures of a major proportion of hydrogen peroxide and a minor proportion of peracetic acid or its salts. In this example, the peracetic acid is termed the "secondary bleaching agent". Secondary bleaching agents can be selected from the same list of bleaching agents given hereinafter. The use of secondary bleaching agents is optional but may be highly desirable in certain embodiments of the invention.

More preferably, the adjunct component includes both an oxygen bleaching agent and at least one other adjunct material selected from non-bleaching adjuncts suited for laundry detergents or cleaning products. Non-bleaching adjuncts as defined herein are adjuncts useful in detergents and cleaning products which neither bleach on their own, nor are recognized as adjuncts used in cleaning primarily as promoters of bleaching such as is the case with bleach activators, organic bleach catalysts or peracids. Preferred non-bleaching adjuncts include detersive surfactants, detergent builders, non-bleaching enzymes having a useful function in detergents, and the like. Preferred compositions herein can incorporate a source of hydrogen peroxide which is any common hydrogen-peroxide releasing salt, such as sodium perborate, sodium percarbonate, and mixtures thereof.

In a hard surface cleaning or fabric laundering operation which uses the present invention compositions, the target substrate, that is, the material to be cleaned, will typically be a surface or fabric stained with, for example, various hydrophilic food stains, such as coffee, tea or wine; with hydrophobic stains such as greasy or carotenoid stains; or is a "dingy" surface, for example one yellowed by the presence of a relativly uniformly distributed fine residue of hydrophobic soils.

In the present invention, a preferred laundry or cleaning composition comprises:

(a) a catalytically effective amount, preferably from about 1 ppb to about 99.9%, of a transition-metal bleach catalyst which is a complex of a transition-metal and a cross-bridged macropolycyclic ligand; and (b) one or more laundry or cleaning adjunct materials, preferably comprising an oxygen bleaching agent, at levels as described hereinbefore.

(1) said transition metal is selected from the group consisting of Mn(II), Mn(III), Mn(IV), Fe(II), Fe(III), Cr(II), Cr(III), Cr(IV), Cr(V), and Cr(VI);

(2) said cross-bridged macropolycyclic ligand is coordinated by four or five donor atoms to the same transition metal and comprises:

(i) an organic macrocycle ring containing four or more donor atoms selected from N and optionally O and S, at least two of these donor atoms being N (preferably at least 3, more preferably at least 4, of these donor atoms are N), separated from each other by covalent linkages of 2 or 3 non-donor atoms, two to five (preferably three to four, more preferably four) of these donor atoms being coordinated to the same transition metal in the complex;

(ii) a cross-bridged chain which covalently connects at least 2 non-adjacent N donor atoms of the organic macrocycle ring, said covalently connected non-adjacent N donor atoms being bridgehead N donor atoms which are coordinated to the same transition metal in the complex, and wherein said cross-bridged chain comprises from 2 to about 10 atoms (preferably the cross-bridged chain is selected from 2, 3 or 4 non-donor atoms, and 4–6 non-donor atoms with a further, preferably N, donor atom); and (iii) optionally, one or more non-macropolycyclic ligands, preferably selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl.

In the preferred laundry compositions, adjuncts such as builders including zeolites and phosphates, surfactants such as anionic and/or nonionic and/or cationic surfactants, dispersant polymers (which modify and inhibit crystal growth of calcium and/or magnesium salts), chelants (which control wash water introduced transition metals), alkalis (to adjust pH), and detersive enzymes are present. Additional bleach-modifying adjuncts such as conventional bleach activators, for example TAED and/or NOBS may be added, provided that any such materials are delivered in such a manner as to be compatible with the purposes of the present invention. The present detergent or detergent-additive compositions may, moreover, comprise one or more processing aids, fillers, perfumes, conventional enzyme particle-making materials including enzyme cores or "nonpareils", as well as pigments, and the like. In the preferred laundry compositions, additional ingredients such as soil release polymers, brighteners, and/or dye transfer inhibitors can be present.

The inventive compositions can include laundry detergents, hard-surface cleaners and the like which include all the components needed for cleaning; alternatively, the compositions can be made for use as cleaning additives. A cleaning additive, for example, can be a composition containing the transition-metal bleach catalyst, a detersive surfactant, and a builder, and can be sold for use as an "add-on", to be used with a conventional detergent which contains a perborate, percarbonate, or other primary oxidant. The compositions herein can include automatic dishwashing compositions (ADD) and denture cleaners, thus, they are not, in general, limited to fabric washing.

In general, materials used for the production of ADD compositions herein are preferably checked for compatibility with spotting/filming on glassware. Test methods for spotting/filming are generally described in the automatic dishwashing detergent literature, including DIN test methods. Certain oily materials, especially those having longer hydrocarbon chain lengths, and insoluble materials such as clays, as well as long-chain fatty acids or soaps which form soap scum are therefore preferably limited or excluded from such compositions.

Amounts of the essential ingredients can vary within wide ranges, however preferred cleaning compositions herein (which have a 1% aqueous solution pH of from about 6 to about 13, more preferably from about 7.5 to about 11.5, and most preferably less than about 11, especially from about 8 to about 10.5) are those wherein there is present: from about 1 ppb to about 99.9%, preferably from about 0.01 ppm to about 49%, and typically during use, from about 0.01 ppm to about 500 ppm, of a transition-metal bleach catalyst in accordance with the invention, and the balance, typically from at least about 0.01%, preferably at least about 51%, more preferably about 90% to about 100%, of one or more laundry or cleaning adjuncts. In preferred embodiments, there can be present (also expressed as a percentage by weight of the entire composition) from 0.1% to about 90%, preferably from about 0.5% to about 50% of a primary oxidant, such as a preformed peracid or a source of hydrogen peroxide; from 0% to about 20%, preferably at least about 0.001%, of a conventional bleach-promoting adjunct, such as a hydrophilic bleach activator, a hydrophobic bleach activator, or a mixture of hydrophilic and hydrophobic bleach activators, and at least about 0.001%, preferably from about 1% to about 40%, of a laundry or cleaning adjunct which does not have a primary role in bleaching, such as a detersive surfactant, a detergent builder, a detergent enzyme, a stabilizer, a detergent buffer, or mixtures thereof. Such fully-formulated embodiments desirably comprise, by way of non-bleaching adjuncts, from about 0.1% to about 15% of a polymeric dispersant, from about 0.01% to about 10% of a chelant, and from about 0.00001% to about 10% of a detersive enzyme though further additional or adjunct ingredients, especially colorants, perfumes, pro-perfumes (compounds which release a fragrance when triggered by any suitable trigger such as heat, enzyme action, or change in pH) may be present. Preferred adjuncts herein are selected from bleach-stable types, though bleach-unstable types can often be included through the skill of the formulator.

Detergent compositions herein can have any desired physical form; when in granular form, it is typical to limit water content, for example to less than about 10%, preferably less than about 7% free water, for best storage stability.

Further, preferred compositions of this invention include those which are substantially free of chlorine bleach. By "substantially free" of chlorine bleach is meant that the formulator does not deliberately add a chlorine-containing bleach additive, such as hypochlorite or a source thereof, such as a chlorinated isocyanurate, to the preferred composition. However, it is recognized that because of factors outside the control of the formulator, such as chlorination of the water supply, some non-zero amount of chlorine bleach may be present in the wash liquor. The term "substantially free" can be similarly constructed with reference to preferred limitation of other ingredients, such as phosphate builder.

The term "catalytically effective amount", as used herein, refers to an amount of the transition-metal bleach catalyst present in the present invention compositions, or during use according to the present invention methods, that is sufficient, under whatever comparative or use conditions are employed, to result in at least partial oxidation of the material sought to be oxidized by the composition or method.

In the case of use in laundry or hard surface compositions or methods, the catalytically effective amount of transition-metal bleach catalyst is that amount which is sufficient to enhance the appearance of a soiled surface. In such cases, the appearance is typically improved in one or more of whiteness, brightness and de-staining; and a catalytically effective amount is one requiring less than a stoichiometric number of moles of catalyst when compared with the number of moles of primary oxidant, such as hydrogen peroxide or hydrophobic peracid, required to produce measurable effect. In addition to direct observation of the bulk surface being bleached or cleaned, catalytic bleaching effect can (where appropriate) be measured indirectly, such as by measurement of the kinetics or end-result of oxidizing a dye in solution.

As noted, the invention encompasses catalysts both at their in-use levels and at the levels which may commercially be provided for sale as "concentrates"; thus "catalytically effective amounts" herein include both those levels in which the catalyst is highly dilute and ready to use, for example at ppb levels, and compositions having rather higher concentrations of catalyst and adjunct materials. Intermediate level compositions, as noted in summary, can include those comprising from about 0.01 ppm to about 500 ppm, more preferably from about 0.05 ppm to about 50 ppm, more preferably still from about 0.1 ppm to about 10 ppm of transition-metal catalyst and the balance to 100%, typically about 99% or more, being solid-form or liquid-form adjunct materials (for example fillers, solvents, and adjuncts especially adapted to a particular use, such as detergent adjuncts, or the like). Preferred levels for use in compositions and methods according to the present invention are provided hereinafter.

In a fabric laundering operation, the target substrate will typically be a fabric stained with, for example, various food stains. The test conditions will vary, depending on the type of washing appliance used and the habits of the user. Thus, front-loading laundry washing machines of the type employed in Europe generally use less water and higher detergent concentrations than do top-loading U.S.-style machines. Some machines have considerably longer wash cycles than others. Some users elect to use very hot water; others use warm or even cold water in fabric laundering operations. Of course, the catalytic performance of the transition-metal bleach catalyst will be affected by such considerations, and the levels of transition-metal bleach catalyst used in fully-formulated detergent and bleach compositions can be appropriately adjusted. As a practical matter, and not by way of limitation, the compositions and processes herein can be adjusted to provide on the order of at least one part per billion of the active transition-metal bleach catalyst in the aqueous washing liquor, and will preferably provide from about 0.01 ppm to about 500 ppm of the transition-metal bleach catalyst in the laundry liquor.

By "effective amount", as used herein, is meant an amount of a material, such as a detergent adjunct, which is sufficient under whatever comparative or use conditions are employed, to provide the desired benefit in laundry and cleaning methods to improve the appearance of a soiled surface in one or more use cycles. A "use cycle" is, for example, one wash of a bundle of fabrics by a consumer. Appearance or visual effect can be measured by the consumer, by technical observers such as trained panelists, or by technical instrument means such as spectroscopy or image analysis. Preferred levels of adjunct materials for use in the present invention compositions and methods are provided hereinafter.

Transition-metal bleach catalysts:

The present invention compositions comprise a transition-metal bleach catalyst. In general, the catalyst contains an at least partially covalently bonded transition metal, and bonded thereto at least one particularly defined macropolycyclic rigid ligand, preferably one having four or more donor atoms (more preferably 4 or 5 donor atoms) and which is cross-bridged or otherwise tied so that the primary macrocycle ring complexes in a folded conformation about the metal. Catalysts herein are thus neither of the more conventional macrocyclic type: e.g., porphyrin complexes, in which the metal can readily adopt square-planar configuration; nor are they complexes in which the metal is fully encrypted in a ligand. Rather, the presently useful catalysts represent a selection of all the many complexes, hitherto largely unrecognized, which have an intermediate state in which the metal is bound in a "cleft". Further, there can be present in the catalyst one or more additional ligands, of generally conventional type such as chloride covalently bound to the metal; and, if needed, one or more counter-ions, most commonly anions such as chloride, hexafluorophosphate, perchlorate or the like; and additional molecules to complete crystal formation as needed, such as water of crystallization. Only the transition-metal and macropolycyclic rigid ligand are, in general, essential.

Transition-metal bleach catalysts useful in the invention compositions can in general include known compounds where they conform with the invention definition, as well as, more preferably, any of a large number of novel compounds expressly designed for the present laundry or cleaning uses, and non-limitingly illustrated by any of the following:

Dichloro-5,12-dimethyl-1,5,8,12-tetraazabicyclo[6.6.2] hexadecane Manganese(II)

Dichloro-4,10-dimethyl-1,4,7,10-tetraazabicyclo[5.5.2] tetradecane Manganese(II)

Diaquo-5,12-dimethyl-1,5,8,12-tetraazabicyclo[6.6.2] hexadecane Manganese(II) Hexafluorophosphate Aquo-hydroxy-5,12-dimethyl-1,5,8,12-tetraazabicyclo [6.6.2]hexadecane Manganese(III) Hexafluorophosphate Diaquo-4,10-dimethyl-1,4,7,10-tetraazabicyclo[5.5.2] tetradecane Manganese(I) Hexafluorophosphate Diaquo-5,12-dimethyl-1,5,8,12-tetraazabicyclo[6.6.2] hexadecane Manganese(II) Tetrafluoroborate Diaquo-4,10-dimethyl-1,4,7,10-tetraazabicyclo[5.5.2] tetradecane Manganese(II) Tetrafluoroborate Dichloro-5,12-dimethyl-1,5,8,12-tetraazabicyclo[6.6.2] hexadecane Manganese(III) Hexafluorophosphate Dichloro-5,12-di-n-butyl-1,5,8,12-tetraaza-bicyclo[6.6.2] hexadecane Manganese(II)

Dichloro-5,12-dibenzyl-1,5,8,12-tetraazabicyclo[6.6.2] hexadecane Manganese(II)

Dichloro-5-n-butyl-12-methyl-1,5,8,12-tetraaza-bicyclo [6.6.2]hexadecane Manganese(II)

Dichloro-5-n-octyl-12-methyl-1,5,8,12-tetraaza-bicyclo [6.6.2]hexadecane Manganese(II)

Dichloro-5-n-butyl-12-methyl-1,5,8,12-tetraaza-bicyclo [6.6.2]hexadecane Manganese(II)

Dichloro-5,12-dimethyl-1,5,8,12-tetraazabicyclo[6.6.2] hexadecane Iron(II)

Dichloro-4,10-dimethyl-1,4,7,10-tetraazabicyclo[5.5.2] tetradecane Iron(II)

Dichloro-5,12-dimethyl-1,5,8,12-tetraazabicyclo[6.6.2] hexadecane Copper(II)

Dichloro-4,10-dimethyl-1,4,7,10-tetraazabicyclo[5.5.2] tetradecane Copper(II)

Dichloro-5,12-dimethyl-1,5,8,12-tetraazabicyclo[6.6.2] hexadecane Cobalt(II)

Dichloro-4,10-dimethyl-1,4,7,10-tetraazabicyclo[5.5.2] tetradecane Cobalt(II)

Dichloro 5,12-dimethyl-4-phenyl-1,5,8,1 2-tetraazabicyclo [6.6.2]hexadecane Manganese(II)

Dichloro-4,10-dimethyl-3-phenyl-1,4,7,10-tetraazabicyclo [5.5.2]tetradecane Manganese(II)

Dichloro-5,12-dimethyl-4,9-diphenyl-1,5,8,12-tetraazabicyclo[6.6.2]hexadecane Manganese(II)

Dichloro-4,10-dimethyl-3,8-diphenyl-1,4,7,10-tetraazabicyclo[5.5.2]tetradecane Manganese(II)

Dichloro-5,12-dimethyl-2,11-diphenyl-1,5,8,12-tetraazabicyclo[6.6.2]hexadecane Manganese(II)

Dichloro-4,10-dimethyl-4,9-diphenyl-1,4,7,10-tetraazabicyclo[5.5.2]tetradecane Manganese(II)

Dichloro-2,4,5,9,11,12-hexamethyl-1,5,8,12-tetraazabicyclo[6.6.2]hexadecane Manganese(II)

Dichloro-2,3,5,9,10,12-hexamethyl-1,5,8,12-tetraazabicyclo[6.6.2]hexadecane Manganese(II)

Dichloro-2,2,4,5,9,9,11,12-octamethyl-1,5,8,12-tetraazabicyclo[6.6.2]hexadecane Manganese(II)

Dichloro-2,2,4,5,9,11,11,12-octamethyl-1,5,8,12-tetraazabicyclo[6.6.2]hexadecane Manganese(II)

Dichloro-3,3,5,10,10,1 2-hexamethyl-1,5,8,12-tetraazabicyclo[6.6.2]hexadecane Manganese(II)

Dichloro-3,5,10,12-tetramethyl-1,5,8,12-tetraazabicyclo [6.6.2]hexadecane Manganese(II)

Dichloro-3-butyl-5,10,12-trimethyl-1,5,8,12-tetraazabicyclo[6.6.2]hexadecane Manganese(II)

Dichloro-1,5,8,1 2-tetraazabicyclo[6.6.2]hexadecane Manganese(II)

Dichloro-1,4,7,10-tetraazabicyclo[5.5.2]tetradecane Manganese(II)

Dichloro-1,5,8,1 2-tetraazabicyclo[6.6.2]hexadecane Iron (II)

Dichloro-1,4,7,10-tetraazabicyclo [5.5.2]tetradecane Iron (II)

Aquo-chloro-2-(2-hydroxyphenyl)-5,12-dimethy 1,5,8,12-tetraazabicyclo[6.6.2]hexadecane Manganese(II)

Aquo-chloro-10-(2-hydroxybenzyl)-4,10-dimethyl-1,4,7,10-tetraazabicyclo[5.5.2]tetradecane Manganese(II)

Chloro-2-(2-hydroxybenzyl)-5-methyl-5,8,12-tetraazabicyclo[6.6.2]hexadecane Manganese(II)

Chloro-10-(2-hydroxybenzyl)-4-methyl-1,4,7,10-tetraazabicyclo[5.5.2]tetradecane Manganese(II)

Chloro-5-methyl-12-(2-picolyl)-1,5,8,12-tetraazabicyclo [6.6.2]hexadecane Manganese(II) Chloride Chloro-4-methyl-10-(2-picolyl)-1,4,7,10-tetraazabicyclo [5.5.2]tetradecane Manganese(II) Chloride Dichloro-5-(2-sulfato)dodecyl-12-methyl-1,5,8,12-tetraazabicyclo[6.6.2]hexadecane Manganese(III)

Aquo-Chloro-5-(2-sulfato)dodecyl-12-methyl-1,5,8,12-tetraazabicyclo[6.6.2]hexadecane Manganese(II)

Aquo-Chloro-5-(3-sulfonopropyl)-12-methyl-1,5,8,12-tetraazabicyclo[6.6.2]hexadecane Manganese(II)

Dichloro-5-(Trimethylammoniopropyl)dodecyl-12-methyl-1,5,8,12-tetraazabicyclo[6.6.2]hexadecane Manganese (III) Chloride Dichloro-5,12-dimethyl-1,4,7,10,13-pentaazabicyclo[8.5.2] heptadecane Manganese(II)

Dichloro-14,20-dimethyl-1,10,14,20-tetraazatriyclo[8.6.6] docosa-3 (8),4,6-triene Manganese (II)

Dichloro-4,11-dimethyl-1,4,7,11 -tetraazabicyclo[6.5.2] pentadecane Manganese(II)

Dichloro-5,12-dimethyl-1,5,8,12-tetraazabicyclo[7.6.2] heptadecane Manganese(II)

Dichloro-5,13-dimethyl-1,5,9,13-tetraazabicyclo[7.7.2] heptadecane Manganese(II)

Dichloro-3,10-bis(butylcarboxy)-5,12-dimethyl-1,5,8,12-tetraazabicyclo[6.6.2]hexadecane Manganese(II)

Diaquo-3,10-dicarboxy-5,12-dimethyl-1,5,8,12-tetraazabicyclo[6.6.2]hexadecane Manganese(II)

Chloro-20-methyl-1,9,20,24,25-pentaaza-tetracyclo [7.7.7.$1^{3,7}$.$1^{11,15}$.]pentacosa-3,5,7(24),11,13,15(25)-hexaene manganese(II) Hexafluorophosphate Trifluoromethanesulfono-20-methyl-1,9,20,24,25-pentaaza-tetracyclo[7.7.7.$1^{3,7}$1.$^{11,15}$.]pentacosa-3,5,7(24),11,13,15 (25)-hexaene Manganese(II) Trifluoromethanesulfonate Trifluoromethanesulfono-20-methyl-1,9,20,24,25-pentaaza-tetracyclo[7.7.7.$1^{3,7}$.$1^{11,15}$.]pentacosa-3,5,7(24),11,13,15 (25)-hexaene Iron(II) Trifluoromethanesulfonate Chloro-5,12,17-trimethyl-1,5,8,12,17-pentaazabicyclo [6.6.5]nonadecane Manganese(II) Hexafluorophosphate Chloro-4,10,15-trimethyl-1,4,7,10,15-pentaazabicyclo [5.5.5]heptadecane Manganese(II) Hexafluorophosphate Chloro-5,12,17-trimethyl-1,5,8,12,17-pentaazabicyclo [6.6.5]nonadecane Manganese(II) Chloride Chloro-4,10,15-trimethyl-1,4,7,10,15-pentaazabicyclo [5.5.5]heptadecane Manganese(II) Chloride Preferred complexes useful as transition-metal bleach catalysts more generally include not only monometallic, mononuclear kinds such as those illustrated hereinabove but also bimetallic, trimetallic or cluster kinds, especially when the polymetallic kinds transform chemically in the presence of a primary oxidant to form a mononuclear, monometallic active species. Monometallic, mononuclear complexes are preferred. As defined herein, a monometallic transition-metal bleach catalyst contains only one transition metal atom per mole of complex. A monometallic, mononuclear complex is one in which any donor atoms of the essential macrocyclic ligand are bonded to the same transition metal atom, that is, the essential ligand does not "bridge" across two or more transition-metal atoms.

Transition Metals of the Catalyst

Just as the macropolycyclic ligand cannot vary indeterminately for the present useful purposes, nor can the metal. An important part of the invention is to arrive at a match between ligand selection and metal selection which results in excellent bleach catalysis. In general, transition-metal bleach catalysts herein comprise a transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV).

Preferred transition-metals in the instant transition-metal bleach catalyst include manganese, iron and chromium, preferably Mn(II), Mn(III), Mn(IV), Fe(II), Fe(III), Cr(II), Cr(III), Cr(IV), Cr(V), and Cr(VI), more preferably manganese and iron, most preferably manganese. Preferred oxidation states include the (II) and (III) oxidation states. Manganese(II) in both the low-spin configuration and high spin complexes are included. It is to be noted that complexes such as low-spin Mn(II) complexes are rather rare in all of coordination chemistry. The designation (II) or (III) denotes a coordinated transition metal having the requisite oxidation state; the coordinated metal atom is not a free ion or one having only water as a ligand.

Ligands

In general, as used herein, a "ligand" is any moiety capable of direct covalent bonding to a metal ion. Ligands can be charged or neutral and may range widely, including simple monovalent donors, such as chloride, or simple amines which form a single coordinate bond and a single point of attachment to a metal; to oxygen or ethylene, which can form a three-membered ring with a metal and thus can be said to have two potential points of attachment, to larger moieties such as ethylenediamine or aza macrocycles, which form up to the maximum number of single bonds to one or more metals that are allowed by the available sites on the metal and the number of lone pairs or alternate bonding sites of the free ligand. Numerous ligands can form bonds other than simple donor bonds, and can have multiple points of attachment.

Ligands useful herein can fall into several groups: the essential macropolycyclic rigid ligand, preferably a cross-bridged macropolycycle (preferably there will be one such ligand in a useful transition-metal complex, but more, for example two, can be present, but not in preferred mononuclear complexes); other, optional ligands, which in general are different from the essential macropolycyclic rigid ligand (generally there will be from 0 to 4, preferably from 1 to 3 such ligands); and ligands associated transiently with the metal as part of the catalytic cycle, these latter typically being related to water, hydroxide, oxygen or peroxides. Ligands of the third group are not essential for defining the metal bleach catalyst, which is a stable, isolable chemical compound that can be fully characterized. Ligands which bind to metals through donor atoms each having at least a single lone pair of electrons available for donation to a metal have a donor capability, or potential denticity, at least equal to the number of donor atoms. In general, that donor capability may be fully or only partially exercised.

Macropolycyclic Rigid Ligands

To arrive at the instant transition-metal catalysts, a macropolycyclic rigid ligand is essential. This is coordinated (covalently connected to any of the above-identified transition-metals) by at least three, preferably at least four, and most preferably four or five, donor atoms to the same transition metal.

Generally, the macropolycyclic rigid ligands herein can be viewed as the result of imposing additional structural rigidity on specifically selected "parent macrocycles". The term "rigid" herein has been defined as the constrained converse of flexibility: see D. H. Busch., *Chemical Reviews.,* (1993), 93, 847–860, incorporated by reference. More particularly, "rigid" as used herein means that the essential ligand, to be suitable for the purposes of the invention, must be determinably more rigid than a macrocycle ("parent macrocycle") which is otherwise identical (having the same ring size and type and number of atoms in the main ring) but lacks the superstructure (especially linking moieties or, preferably cross-bridging moieties) of the present ligands. In determining the comparative rigidity of the macrocycles with and without superstructures, the practitioner will use the free form (not the metal-bound form) of the macrocycles. Rigidity is well-known to be useful in comparing macrocycles; suitable tools for determining, measuring or comparing rigidity include computational methods (see, for example, Zimmer, *Chemical Reviews,* (1995), 95(38), 2629–2648 or Hancock et al., *Inorganica Chimica Acta,* (1989), 164, 73–84. A determination of whether one macrocycle is more rigid than another can be often made by simply making a molecular model, thus it is not in general essential to know configurational energies in absolute terms or to precisely compute them. Excellent comparative determinations of rigidity of one macrocycle vs. another can be made using inexpensive personal computer-based computational tools, such as ALCHEMY III, commercially available from Tripos Associates. Tripos also has available more expensive software permitting not only comparative, but absolute determinations; alternately, SHAPES can be used (see Zimmer cited supra). One observation which is significant in the context of the present invention is that there is an optimum for the present purposes when the parent macrocycle is distinctly flexible as compared to the cross-bridged form. Thus, unexpectedly, it is preferred to use parent macrocycles containing at least four donor atoms, such as cyclam derivatives, and to cross-bridge them, rather than to start with a more rigid parent macrocycle. Another observation is that cross-bridged macrocycles are significantly preferred over macrocycles which are bridged in other manners.

The macrocyclic rigid ligands herein are of course not limited to being synthesized from any preformed macrocycle plus preformed "rigidizing" or "conformation-modifying" element: rather, a wide variety of synthetic means, such as template syntheses, are useful. See for example Busch et al., reviewed in "Heterocyclic compounds: Aza-crown macrocycles", J. S. Bradshaw et. al., referred to in the Background Section hereinbefore, for synthetic methods.

In one aspect of the present invention, the macropolycyclic rigid ligands herein include those comprising:

(i) an organic macrocycle ring containing four or more donor atoms (preferably at least 3, more preferably at least 4, of these donor atoms are N) separated from each other by covalent linkages of at least one, preferably 2 or 3, non-donor atoms, two to five (preferably three to four, more preferably four) of these donor atoms being coordinated to the same transition metal in the complex; and (ii) a linking moiety, preferably a cross-bridging chain, which covalently connects at least 2 (preferably non-adjacent) donor atoms of the organic macrocycle ring, said covalently connected (preferably non-adjacent) donor atoms being bridgehead donor atoms which are coordinated to the same transition metal in the complex, and wherein said linking moiety (preferably a cross-bridged chain) comprises from 2 to about 10 atoms (preferably the cross-bridged chain is selected from 2, 3 or 4 non-donor atoms, and 4-6 non-donor atoms with a further donor atom).

In preferred embodiments of the instant invention, the cross-bridged macropolycycle is coordinated by four or five nitrogen donor atoms to the same transition metal. These ligands comprise:

(i) an organic macrocycle ring containing four or more donor atoms selected from N and optionally O and S, at least two of these donor atoms being N (preferably at least 3, more preferably at least 4, of these donor atoms are N), separated from each other by covalent linkages of 2 or 3 non-donor atoms, two to five (preferably three to four, more preferably four) of these donor atoms being coordinated to the same transition metal in the complex;

(ii) a cross-bridging chain which covalently connects at least 2 non-adjacent N donor atoms of the organic macrocycle ring, said covalently connected non-adjacent N donor atoms being bridgehead N donor atoms which are coordinated to the same transition metal in the complex, and wherein said cross-bridged chain comprises from 2 to about 10 atoms (preferably the cross-bridged chain is selected from 2, 3 or 4 non-donor atoms, and 4–6 non-donor atoms with a further, preferably N, donor atom).

While clear from the various contexts and illustrations already presented, the practitioner may further benefit if certain terms receive additional definition and illustration. As used herein, "macrocyclic rings" are covalently connected rings formed from four or more donor atoms (i.e., heteroatoms such as nitrogen or oxygen) with carbon chains connecting them, and any macrocycle ring as defined herein must contain a total of at least ten, preferably at least twelve, atoms in the macrocycle ring. A macropolycyclic rigid ligand herein may contain more than one ring of any sort per ligand, but at least one macrocycle ring must be identifiable. Moreover, in the preferred embodiments, no two heteroatoms are directly connected. Preferred transition-metal bleach catalysts are those wherein the macropolycyclic rigid ligand comprises an organic macrocycle ring (main ring) containing at least 10–20 atoms, preferably 12–18 atoms, more preferably from about 12 to about 20 atoms, most preferably 12 to 16 atoms.

Further for the preferred compounds, as used herein, "macrocyclic rings" are covalently connected rings formed from four or more donor atoms selected from N and optionally O and S, at least two of these donor atoms being N, with C2 or C3 carbon chains connecting them, and any macrocycle ring as defined herein must contain a total of at least twelve atoms in the macrocycle ring. A cross-bridged macropolycyclic ligand herein may contain more than one ring of any sort per ligand, but at least one macrocycle ring must be identifiable in the cross-bridged macropolycycle. Moreover, unless otherwise specifically noted, no two hetero-atoms are directly connected. Preferred transition-metal bleach catalysts are those wherein the cross-bridged macropolycyclic ligand comprises an organic macrocycle ring containing at least 12 atoms, preferably from about 12 to about 20 atoms, most preferably 12 to 16 atoms.

"Donor atoms" herein are heteroatoms such as nitrogen, oxygen, phosphorus or sulfur (preferably N, O, and S), which when incorporated into a ligand still have at least one lone pair of electrons available for forming a donor-acceptor bond with a metal. Preferred transition-metal bleach catalysts are those wherein the donor atoms in the organic macrocycle ring of the cross-bridged macropolycyclic ligand are selected from the group consisting of N, O, S, and P, preferably N and O, and most preferably all N. Also preferred are cross-bridged macropolycyclic ligands comprising 4 or 5 donor atoms, all of which are coordinated to the same transition metal. Most preferred transition-metal bleach catalysts are those wherein the cross-bridged macropolycyclic ligand comprises 4 nitrogen donor atoms all coordinated to the same transition metal, and those wherein the cross-bridged macropolycyclic ligand comprises 5 nitrogen atoms all coordinated to the same transition metal.

"Non-donor atoms" of the macropolycyclic rigid ligand herein are most commonly carbon, though a number of atom types can be included, especially in optional exocyclic substituents (such as "pendant" moieties, illustrated hereinafter) of the macrocycles, which are neither donor atoms for purposes essential to form the metal catalysts, nor are they carbon. Thus, in the broadest sense, the term "non-donor atoms" can refer to any atom not essential to forming donor bonds with the metal of the catalyst. Examples of such atoms could include heteroatoms such as sulfur as incorporated in a non-coordinatable sulfonate group, phosphorus as incorporated into a phosphonium salt moiety, phosphorus as incorporated into a P(V) oxide, a non-transition metal, or the like. In certain preferred embodiments, all non-donor atoms are carbon.

The term "macropolycyclic ligand" is used herein to refer to the essential ligand required for forming the essential metal catalyst. As indicated by the term, such a ligand is both a macrocycle and is polycyclic. "Polycyclic" means at least bicyclic in the conventional sense. The essential macropolycyclic ligands must be rigid, and preferred ligands must also cross-bridged.

Non-limiting examples of macropolycyclic rigid ligands, as defined herein, include 1.3–1.6:

1.3

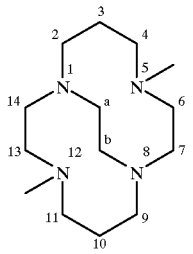

Ligand 1.3 is a macropolycylic rigid ligand in accordance with the invention which is a highly preferred, cross-bridged, methyl-substituted (all nitrogen atoms tertiary) derivative of cyclam. Formally, this ligand is named 5,12-dimethyl-1,5,8,12-tetraazabicyclo[6.6.2]hexadecane using the extended von Baeyer system. See "A Guide to IUPAC Nomenclature of Organic Compounds: Recommendations 1993", R. Panico, W. H. Powell and J-C Richer (Eds.), Blackwell Scientific Publications, Boston, 1993; see especially section R-2.4.2.1. According to conventional terminology, N1 and N8 are "bridgehead atoms"; as defined herein, more particularly "bridgehead donor atoms" since they have lone pairs capable of donation to a metal. N1 is connected to two non-bridgehead donor atoms, N5 and N12, by distinct saturated carbon chains 2,3,4 and 14,13 and to bridgehead donor atom N8 by a "linking moiety" a,b which here is a saturated carbon chain of two carbon atoms. N8 is connected to two non-bridgehead donor atoms, N5 and N12, by distinct chains 6,7 and 9,10,11. Chain a,b is a "linking moiety" as defined herein, and is of the special, preferred type referred to as a "cross-bridging" moiety. The "macrocyclic ring" of the ligand supra, or "main ring" (IUPAC), includes all four donor atoms and chains 2,3,4; 6,7; 9,10,11 and 13,14 but not a,b. This ligand is conventionally bicyclic. The short bridge or "linking moiety" a,b is a "cross-bridge" as defined herein, with a,b bisecting the macrocyclic ring.

1.4

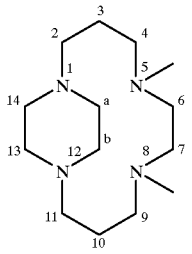

Ligand 1.4 lies within the general definition of macropolycyclic rigid ligands as defined herein, but is not a preferred ligand since it is not "cross-bridged" as defined herein. Specifically, the "linking moiety" a,b connects "adjacent" donor atoms N1 and N12, which is outside the preferred embodiment of the present invention: see for comparison the preceding macrocyclic rigid ligand, in which the linking moiety a,b is a cross-bridging moiety and connects "non-adjacent" donor atoms.

1.5

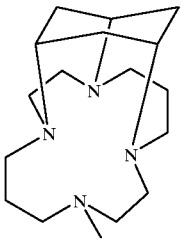

Ligand 1.5 lies within the general definition of macropolycylic rigid ligands as defined herein. This ligand can be viewed as a "main ring" which is a tetraazamacrocycle having three bridgehead donor atoms. This macrocycle is bridged by a "linking moiety" having a structure more complex than a simple chain, containing as it does a secondary ring. The linking moiety includes both a "cross-bridging" mode of bonding, and a non-cross-bridging mode.

1.6

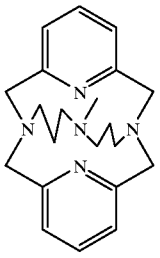

Ligand 1.6 lies within the general definition of macropolycylic rigid ligands. Five donor atoms are present; two being bridgehead donor atoms. This ligand is a preferred cross-bridged ligand. It contains no exocyclic or pendant substituents which have aromatic content.

In contrast, for purposes of comparison, the following ligands (1.7 and 1.8) conform neither with the broad definition of macropolycyclic rigid ligands in the present invention, nor with the preferred cross-bridged sub-family thereof and therefore are completely outside the present invention 1.7

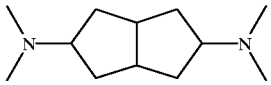

In the ligand supra, neither nitrogen atom is a bridgehead donor atom. There are insufficient donor atoms.

1.8

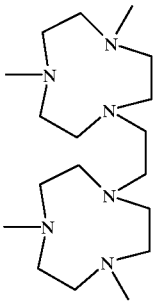

The ligand supra is also outside the present invention. The nitrogen atoms are not bridgehead donor atoms, and the two-carbon linkage between the two main rings does not meet the invention definition of a "linking moiety" since, instead of linking across a single macrocycle ring, it links two different rings. The linkage therefore does not confer rigidity as used in the term "macropolycyclic rigid ligand". See the definition of "linking moiety" hereinafter.

Generally, the essential macropolycyclic rigid ligands (and the corresponding transition-metal catalysts) herein comprise:

(a) at least one macrocycle main ring comprising four or more heteroatoms; and (b) a covalently connected non-metal superstructure capable of increasing the rigidity of the macrocycle, preferably selected from (i) a bridging superstructure, such as a linking moiety;

(ii) a cross-bridging superstructure, such as a cross-bridging linking moiety; and (iii) combinations thereof.

The term "superstructure" is used herein as defined by Busch et al., in the Chemical Reviews article incorporated hereinabove.

Preferred superstructures herein not only enhance the rigidity of the parent macrocycle, but also favor folding of the macrocycle so that it co-ordinates to a metal in a cleft. Suitable superstructures can be remarkably simple, for example a linking moiety such as any of those illustrated in 1.9 and 1.10 below, can be used.

1.9

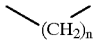

wherein n is an integer, for example from 2 to 8, preferably less than 6, typically 2 to 4, or 1.10

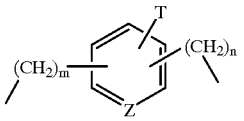

wherein m and n are integers from about 1 to 8, more preferably from 1 to 3; Z is N or CH; and T is a compatible substituent, for example H, alkyl, trialkylammonium, halogen, nitro, sulfonate, or the like. The aromatic ring in 1.10 can be replaced by a saturated ring, in which the atom in Z connecting into the ring can contain N, O, S or C.

Without intending to be limited by theory, it is believed that the preorganization built into the macropolycyclic ligands herein that leads to extra kinetic and/or thermodynamic stability of their metal complexes arises from either or both of topological constraints and enhanced rigidity (loss of flexibility) compared to the free parent macrocycle which has no superstructure. The macropolycyclic rigid ligands as defined herein and their preferred cross-bridged sub-family, which can be said to be "ultra-rigid", combine two sources of fixed preorganization. In preferred ligands herein, the linking moieties and parent macrocycle rings are combined to form ligands which have a significant extent of "fold", typically greater than in many known superstructured ligands in which a superstructure is attached to a largely planar, often unsaturated macrocycle. See, for example,: D. H. Busch, *Chemical Reviews,* (1993), 93, 847–880. Further, the preferred ligands herein have a number of particular properties, including (1) they are characterized by very high proton affinities, as in so-called "proton sponges"; (2) they tend to react slowly with multivalent transition metals, which when combined with (1) above, renders synthesis of their complexes with certain hydrolyzable metal ions difficult in hydroxylic solvents; (3) when they are coordinated to transition metal atoms as identified herein, the ligands result in complexes that have exceptional kinetic stability such that the metal ions only dissociate extremely slowly under conditions that would destroy complexes with ordinary ligands; and (4) these complexes have exceptional thermodynamic stability; however, the unusual kinetics of ligand dissociation from the transition metal may defeat conventional equilibrium measurements that might quantitate this property.

Other usable but more complex superstructures suitable for the present invention purposes include those containing an additional ring, such as in 1.5. Other bridging superstructures when added to a macrocycle include, for example, 1.4. In contrast, cross-bridging superstructures unexpectedly produce a substantial improvement in the utility of a macrocyclic ligand for use in oxidation catalysis: a preferred cross-bridging superstructure is 1.3. A superstructure illustrative of a bridging plus cross-bridging combination is 1.11:

1.11

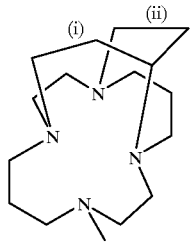

In 1.11, linking moiety (i) is cross-bridging, while linking moiety (ii) is not. 1.11 is less preferred than 1.3.

More generally, a "linking moiety", as defined herein, is a covalently linked moiety comprising a plurality of atoms which has at least two points of covalent attachment to a macrocycle ring and which does not form part of the main ring or rings of the parent macrocycle. In other terms, with the exception of the bonds formed by attaching it to the parent macrocycle, a linking moiety is wholly in a superstructure.

In preferred embodiments of the instant invention, a cross-bridged macropolycycle is coordinated by four or five donor atoms to the same transition metal. These ligands comprise:

(i) an organic macrocycle ring containing four or more donor atoms (preferably at least 3, more preferably at least 4, of these donor atoms are N) separated from each other by covalent linkages of 2 or 3 non-donor atoms, two to five (preferably three to four, more preferably four) of these donor atoms being coordinated to the same transition metal in the complex; and (ii) a cross-bridged chain which covalently connects at least 2 non-adjacent donor atoms of the organic macrocycle ring, said covalently connected non-adjacent donor atoms being bridgehead donor atoms which are coordinated to the same transition metal in the complex, and wherein said cross-bridged chain comprises from 2 to about 10 atoms (preferably the cross-bridged chain is selected from 2, 3 or 4 non-donor atoms, and 4–6 non-donor atoms with a further donor atom).

The terms "cross-bridged" or "cross-bridging", as used herein, refers to covalent ligation, bisection or "tying" of a macrocycle ring in which two donor atoms of the macrocycle ring are covalently connected by a linking moiety, for example an additional chain distinct from the macrocycle ring, and further, preferably, in which there is at least one donor atom (preferably N donor atom) of the macrocycle ring in each of the sections of the macrocycle ring separated by the ligation, bisection or tying. Cross-bridging is not present in structure 1.4 hereinabove; it is present in 1.3, where two donor atoms of a preferred macrocycle ring are connected in such manner that there is not a donor atom in each of the bisection rings. Of course, provided that cross-bridging is present, any other kind of bridging can optionally be added and the bridged macrocycle will retain the preferred property of being "cross-bridged": see Structure 1.11. A "cross-bridged chain" or "cross-bridging chain", as defined herein, is thus a highly preferred type of linking moiety comprising a plurality of atoms which has at least two points of covalent attachment to a macrocycle ring and which does not form part of the original macrocycle ring (main ring), and further, which is connected to the main ring using the rule identified in defining the term "cross-bridging".

The term "adjacent" as used herein in connection with donor atoms in a macrocycle ring means that there are no donor atoms intervening between a first donor atom and another donor atom within the macrocycle ring; all intervening atoms in the ring are non-donor atoms, typically they are carbon atoms. The complementary term "non-adjacent" as used herein in connection with donor atoms in a macrocycle ring means that there is at least one donor atom intervening between a first donor atom and another that is being referred to. In preferred cases such as a cross-bridged tetraazamacrocycle, there will be at least a pair of non-adjacent donor atoms which are bridgehead atoms, and a further pair of non-bridgehead donor atoms.

"Bridgehead" atoms herein are atoms of a macropolycyclic ligand which are connected into the structure of the macrocycle in such manner that each non-donor bond to such an atom is a covalent single bond and there are sufficient covalent single bonds to connect the atom termed "bridgehead" such that it forms a junction of at least two rings, this number being the maximum observable by visual inspection in the un-coordinated ligand.

In general, the metal bleach catalysts herein may contain bridgehead atoms which are carbon, however, and importantly, in certain preferred embodiments, all essential bridgehead atoms are heteroatoms, all heteroatoms are tertiary, and further, they each co-ordinate through lone pair donation to the metal. The preferred metal transition-metal bleach catalysts herein must contain at least two N bridgehead atoms, and further, they each co-ordinate through lone pair donation to the metal. Thus, bridgehead atoms are junction points not only of rings in the macrocycle, but also of chelate rings.

The term "a further donor atom" unless otherwise specifically indicated, as used herein, refers to a donor atom other than a donor atom contained in the macrocycle ring of an essential macropolycycle. For example, a "further donor atom" may be present in an optional exocyclic substituent of a macrocyclic ligand, or in a cross-bridged chain thereof. In certain preferred embodiments, a "further donor atom" is present only in a cross-bridged chain.

The term "coordinated with the same transition metal" as used herein is used to emphasize that a particular donor atom or ligand does not bind to two or more distinct metal atoms, but rather, to only one.

Optional Ligands

It is to be recognized for the transition-metal bleach catalysts useful in the present invention catalytic systems that additional non-macropolycyclic ligands may optionally also be coordinated to the metal, as necessary to complete the coordination number of the metal complexed. Such ligands may have any number of atoms capable of donating electrons to the catalyst complex, but preferred optional ligands have a denticity of 1 to 3, preferably 1. Examples of such ligands are $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl. Preferred transition-metal bleach catalysts comprise one or two non-macropolycyclic ligands.

The term "non-macropolycyclic ligands" is used herein to refer to ligands such as those illustrated immediately hereinabove which in general are not essential for forming the metal catalyst, and are not cross-bridged macropolycycles.

"Not essential", with reference to such non-macropolycyclic ligands means that, in the invention as broadly defined, they can be substituted by a variety of common alternate ligands. In highly preferred embodiments in which metal, macropolycyclic and non-macropolycyclic ligands are finely tuned into a transition-metal bleach catalyst, there may of course be significant differences in performance when the indicated non-macropolycyclic ligand(s) are replaced by further, especially non-illustrated, alternative ligands.

The term "metal catalyst" or "transition-metal bleach catalyst" is used herein to refer to the essential catalyst compound of the invention and is commonly used with the "metal" qualifier unless absolutely clear from the context. Note that there is a disclosure hereinafter pertaining specifically to optional catalyst materials. Therein the term "bleach catalyst" may be used unqualified to refer to optional, organic (metal-free) catalyst materials, or to optional metal-containing catalysts that lack the advantages of the essential catalyst: such optional materials, for example, include known metal porphyrins or metal-containing photobleaches. Other optional catalytic materials herein include enzymes.

The cross-bridged macropolycyclic ligands include cross-bridged macropolycyclic ligand selected from the group consisting of:

(i) the cross-bridged macropolycyclic ligand of formula (I) having denticity of 4 or 5:

(I)

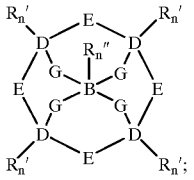

(ii) the cross-bridged macropolycyclic ligand of formula (II) having denticity of 5 or 6:

(II)

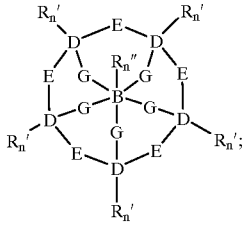

(iii) the cross-bridged macropolycyclic ligand of formula (III) having denticity of 6 or 7:

(III)

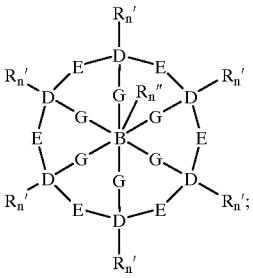

wherein in these formulas:

each "E" is the moiety $(CR_n)_a$—X—$(CR_n)_{a'}$, wherein —X— is selected from the group consisting of O, S, NR and P, or a covalent bond, and preferably X is a covalent bond and for each E the sum of a+a' is independently selected from 1 to 5, more preferably 2 and 3;

each "G" is the moiety $(CR_n)_b$;

each "R" is independently selected from H, alkyl, alkenyl, alkynyl, aryl, alkylaryl (e.g., benzyl), and heteroaryl, or two or more R are covalently bonded to form an aromatic, heteroaromatic, cycloalkyl, or heterocycloalkyl ring;

each "D" is a donor atom independently selected from the group consisting of N, O, S, and P, and at least two D atoms are bridgehead donor atoms coordinated to the transition metal (in the preferred embodiments, all donor atoms designated D are donor atoms which coordinate to the transition metal, in contrast with heteroatoms in the structure which are not in D such as those which may be present in E; the non-D heteroatoms can be non-coordinating and indeed are non-coordinating whenever present in the preferred embodiment);

"B" is a carbon atom or "D" donor atom, or a cycloalkyl or heterocyclic ring;

each "n" is an integer independently selected from 1 and 2, completing the valence of the carbon atoms to which the R moieties are covalently bonded;

each "n'" is an integer independently selected from 0 and 1, completing the valence of the D donor atoms to which the R moieties are covalently bonded;

each "n"" is an integer independently selected from 0, 1, and 2 completing the valence of the B atoms to which the R moieties are covalently bonded;

each "a" and "a'" is an integer independently selected from 0–5, preferably a+a' equals 2 or 3, wherein the sum of all "a" plus "a'" in the ligand of formula (I) is within the range of from about 6 (preferably 8) to about 12, the sum of all "a" plus "a'" in the ligand of formula (II) is within the range of from about 8 (preferably 10) to about 15, and the sum of all "a" plus "a'" in the ligand of formula (III) is within the range of from about 10 (preferably 12) to about 18;

each "b" is an integer independently selected from 0–9, preferably 0–5, or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all "b" is within the range of from about 1 to about 5.

Preferred are the transition-metal bleach catalysts wherein in the cross-bridged macropolycyclic ligand the D and B are selected from the group consisting of N and O, and preferably all D are N. Also preferred are wherein in the cross-bridged macropolycyclic ligand all "a" are independently selected from the integers 2 and 3, all X are selected from covalent bonds, all "a'" are 0, and all "b" are independently selected from the integers 0, 1, and 2. Tetradentate and pentadentate cross-bridged macropolycyclic ligands are most preferred.

Unless otherwise specified, the convention herein when referring to denticity, as in "the macropolycycle has a denticity of four" will be to refer to a characteristic of the ligand: namely, the maximum number of donor bonds that it is capable of forming when it coordinates to a metal. Such a ligand is identified as "tetradentate". Similarly, a macropolycycle containing five nitrogen atoms each with a lone pair is referred to as "pentadentate". The present invention encompasses bleach compositions in which the macropolycyclic rigid ligand exerts its full denticity, as stated, in the transition-metal catalyst complexes; moreover, the invention also encompasses any equivalents which can be formed, for example, if one or more donor sites are not directly coordinated to the metal. This can happen, for example, when a pentadentate ligand coordinates through four donor atoms to the transition metal and one donor atom is protonated.

Preferred are bleach compositions containing metal catalysts wherein the cross-bridged macropolycyclic ligand is a bicyclic ligand; preferably the cross-bridged macropolycyclic ligand is a macropolycyclic moiety of formula (I) having the formula:

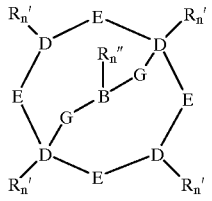

wherein each "a" is independently selected from the integers 2 or 3, and each "b" is independently selected from the integers 0, 1 and 2.

Further preferred are cross-bridged macropolycyclic ligand selected from the group consisting of:

(I)

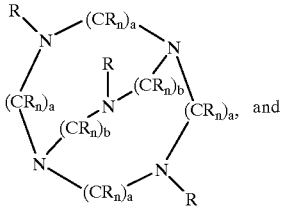

and

-continued (II)

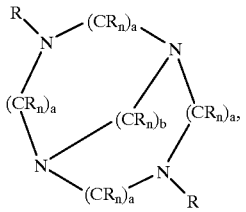

wherein in these formulas:

each "R" is independently selected from H, alkyl, alkenyl, alkynyl, aryl, alkylaryl, and heteroaryl, or two or more R are covalently bonded to form an aromatic, heteroaromatic, cycloalkyl, or heterocycloalkyl ring;

each "n" is an integer independently selected from 0, 1 and 2, completing the valence of the carbon atoms to which the R moieties are covalently bonded;

each "b" is an integer independently selected from 2 and 3; and each "a" is an integer independently selected from 2 and 3.

Further preferred are cross-bridged macropolycyclic ligands having the formula:

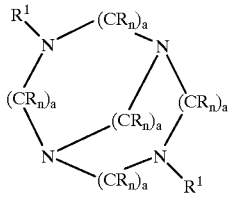

wherein in this formula:

each "n" is an integer independently selected from 1 and 2, completing the valence of the carbon atom to which the R moieties are covalently bonded;

each "R" and "$R^1$" is independently selected from H, alkyl, alkenyl, alkynyl, aryl, alkylaryl, and heteroaryl, or R and/or $R^1$ are covalently bonded to form an aromatic, heteroaromatic, cycloalkyl, or heterocycloalkyl ring, and wherein preferably all R are H and $R^1$ are independently selected from linear or branched, substituted or unsubstituted $C_1$–$C_{20}$ alkyl, alkenyl or alkynyl;

each "a" is an integer independently selected from 2 or 3;

preferably all nitrogen atoms in the cross-bridged macropolycycle rings are coordinated with the transition metal.

Another preferred sub-group of the transition-metal complexes useful in the present invention compositions and methods includes the Mn(II), Fe(II) and Cr(II) complexes of the ligand having the formula:

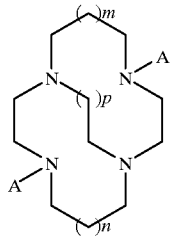

wherein m and n are integers from 0 to 2, p is an integer from 1 to 6, preferably m and n are both 0 or both 1 (preferably both 1), or m is 0 and n is at least 1; and p is 1; and A is a nonhydrogen moiety preferably having no aromatic content; more particularly each A can vary independently and is preferably selected from methyl, ethyl, propyl, isopropyl, butyl, isobutyl, tert-butyl, C5–C20 alkyl, and one, but not both, of the A moieties is benzyl, and combinations thereof. In one such complex, one A is methyl and one A is benzyl.

This includes the preferred cross-bridged macropolycyclic ligands having the formula:

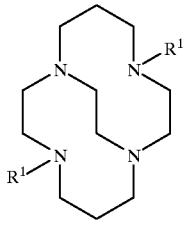

wherein in this formula "$R^1$" is independently selected from H, and linear or branched, substituted or unsubstituted $C_1$–$C_{20}$ alkyl, alkenyl or alkynyl; and preferably all nitrogen atoms in the macropolycyclic rings are coordinated with the transition metal.

Also preferred are cross-bridged macropolycyclic ligands having the formula:

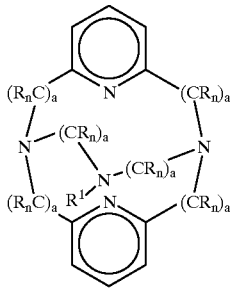

wherein in this formula:

each "n" is an integer independently selected from 1 and 2, completing the valence of the carbon atom to which the R moieties are covalently bonded;

each "R" and "$R^1$" is independently selected from H, alkyl, alkenyl, alkynyl, aryl, alkylaryl and heteroaryl, or R and/or $R^1$ are covalently bonded to form an aromatic, heteroaromatic, cycloalkyl, or heterocycloalkyl ring, and wherein preferably all R are H and $R^1$ are independently selected from linear or branched, substituted or unsubstituted $C_1$–$C_{20}$ alkyl, alkenyl or alkynyl;

each "a" is an integer independently selected from 2 or 3;

preferably all nitrogen atoms in the macropolycyclic rings are coordinated with the transition metal.

These include the preferred cross-bridged macropolycyclic ligands having the formula:

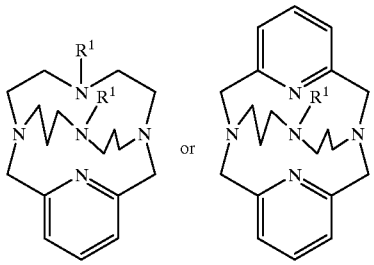

wherein in either of these formulae, "$R^1$" is independently selected from H, or, preferably, linear or branched, substituted or unsubstituted $C_1$–$C_{20}$ alkyl, alkenyl or alkynyl; and preferably all nitrogen atoms in the macropolycyclic rings are coordinated with the transition metal.

The present invention has numerous variations and alternate embodiments which do not depart from its spirit and scope. Thus, in the present invention compositions, the macropolycyclic ligand can be replaced by any of the following:

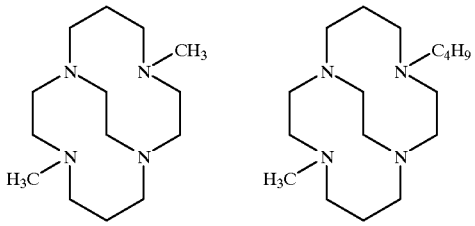

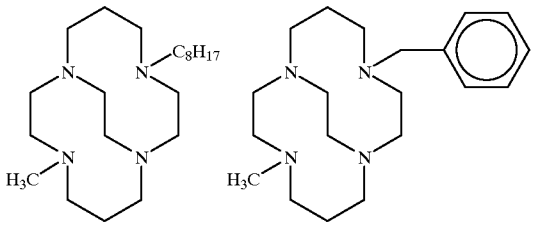

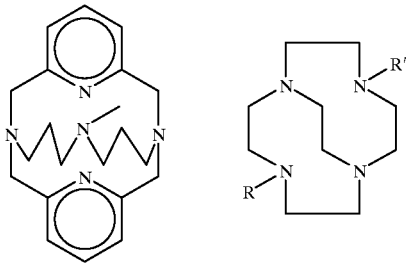

-continued

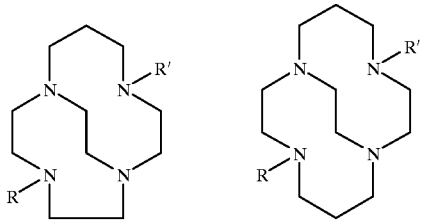

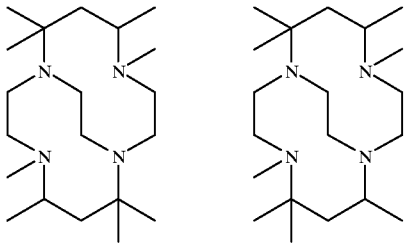

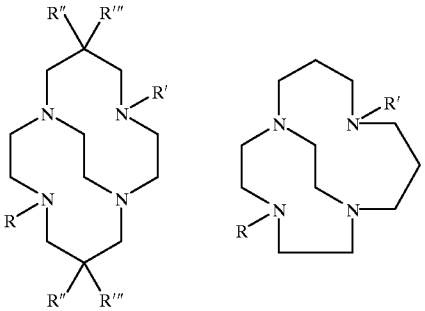

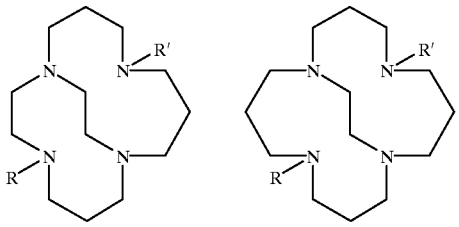

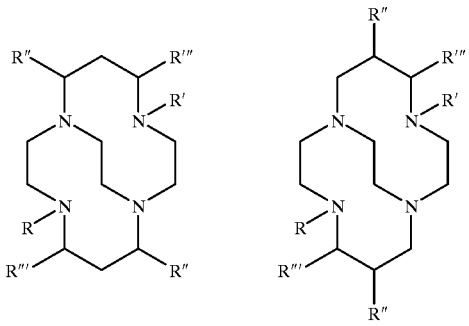

-continued

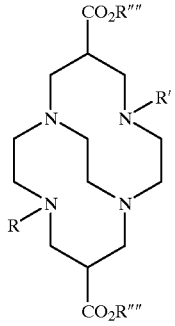

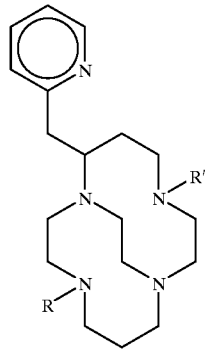

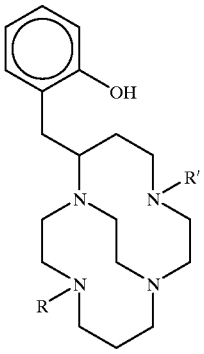

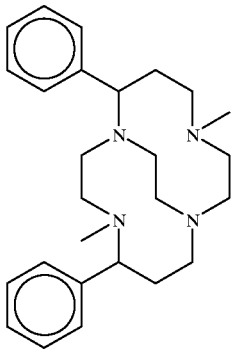

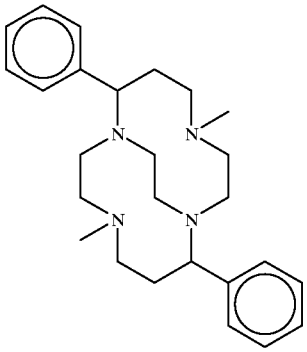

In the above, the R, R', R", R'" moieties can, for example, be methyl, ethyl or propyl. (Note that in the above formalism, the short strokes attached to certain N atoms are an alternate representation for a methyl group).

While the above illustrative structures involve tetra-aza derivatives (four donor nitrogen atoms), ligands and the corresponding complexes in accordance with the present invention can also be made, for example from any of the following:

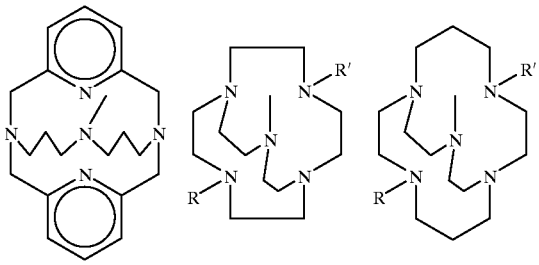

-continued

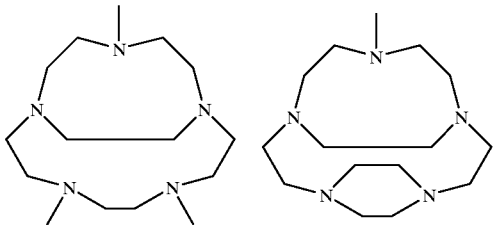

Moreover, using only a single organic polymacrocycle, preferably a cross-bridged derivative of cyclam, a wide range of bleach catalyst compounds of the invention may be prepared; numerous of these are believed to be novel chemical compounds. Preferred transition-metal catalysts of both cyclam-derived and non-cyclam-derived cross-bridged kinds are illustrated, but not limited, by the following:

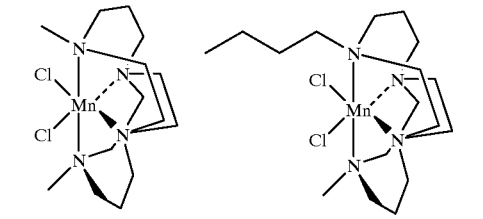

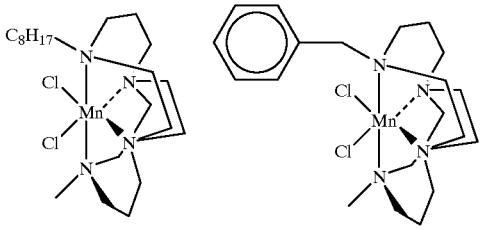

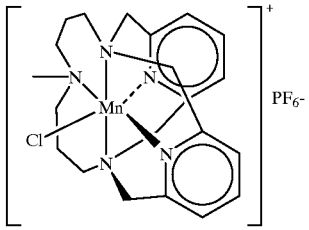

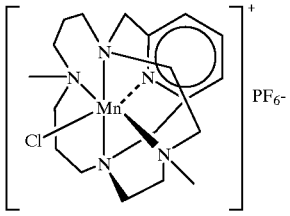

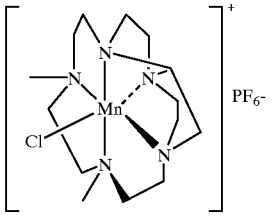

In other embodiments of the invention, transition-metal complexes, such as the Mn, Fe or Cr complexes, especially (II) and/or (III) oxidation state complexes, of the hereinabove-identified metals with any of the following ligands are also included:

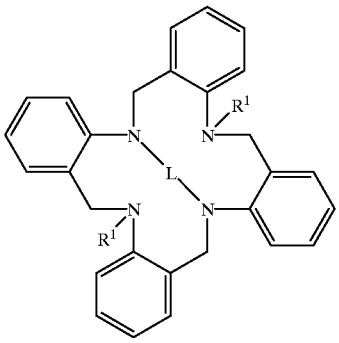

wherein $R^1$ is independently selected from H (preferably non-H) and linear or branched substituted or unsubstituted $C_1$–$C_{20}$ alkyl, alkenyl or alkynyl and L is any of the linking moieties given herein, for example 1.9 or 1.10;

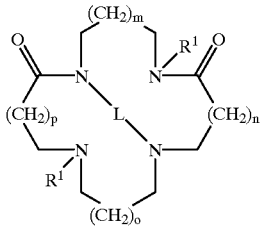

wherein $R^1$ is as defined supra; m, n, o and p can vary independently and are integers which can be zero or a positive integer and can vary independently while respecting the provision that the sum m=n=o=p is from 0 to 8 and L is any of the linking moieties defined herein;

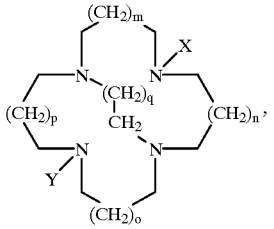

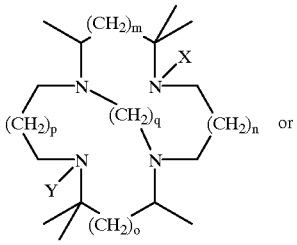

-continued

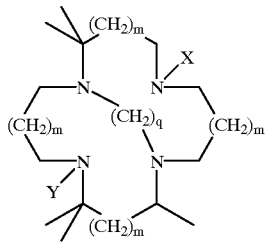

wherein X and Y can be any of the $R^1$ defined supra, m, n, o and p are as defined supra and q is an integer, preferably from 1 to 4; or, more generally,

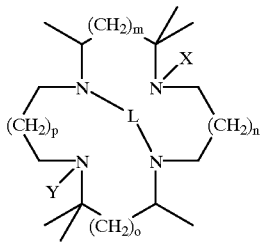

wherein L is any of the linking moieties herein, X and Y can be any of the $R^1$ defined supra, and m, n, o and p are as defined supra. Alternately, another useful ligand is:

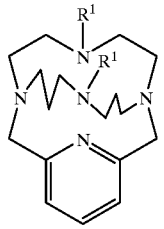

wherein $R^1$ is any of the $R^1$ moieties defined supra.

Pendant Moieties

Macropolycyclic rigid ligands and the corresponding transition-metal complexes and compositions herein may also incorporate one or more pendant moieties, in addition to, or as a replacement for, $R^1$ moieties. Such pendant moieties are nonlimitingly illustrated by any of the following:

$—(CH_2)_n—CH_3$ $—(CH_2)_n—C(O)NH_2$ $—(CH_2)_n—CN—(CH_2)_n—C(O)OH$ $—(CH_2)_n—C(O)NR_2—(CH_2)_n—OH$ $—(CH_2)_n—C(O)OR$

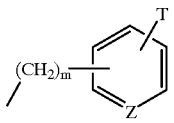

wherein R is, for example, a C1–C12 alkyl, more typically a C1–C4 alkyl, and Z and T are as defined in 1.10. Pendant moieties may be useful, for example, if it is desired to adjust the solubility of the catalyst in a particular solvent adjunct.

Alternately, complexes of any of the foregoing highly rigid, cross-bridged macropolycyclic ligands with any of the metals indicated are equally within the invention.

Preferred are catalysts wherein the transition metal is selected from manganese and iron, and most preferably manganese. Also preferred are catalysts wherein the molar ratio of transition metal to macropolycycle ligand in the transition-metal bleach catalyst is 1:1, and more preferably wherein the catalyst comprises only one metal per transition-metal bleach catalyst complex. Further preferred metal bleach catalysts are monometallic, mononuclear complexes. The term "monometallic, mononuclear complex", as noted, is used herein in referring to an essential transition-metal bleach catalyst compound to identify and distinguish a preferred class of compounds containing only one metal atom per mole of compound and only one metal atom per mole of cross-bridged macropolycyclic ligand.

Preferred transition-metal bleach catalysts are also those wherein at least four of the donor atoms in the cross-bridged macropolycyclic ligand, preferably at least four nitrogen donor atoms, two of which form an apical bond angle with the same transition metal of 180±50° and two of which form at least one equatorial bond angle of 90±20°. Such catalysts preferably have four or five nitrogen donor atoms in total and also have coordination geometry selected from distorted octahedral (including trigonal antiprismatic and general tetragonal distortion) and distorted trigonal prismatic, and preferably wherein further the cross-bridged macropolycyclic ligand is in the folded conformation (as described, for example, in Hancock and Martell, Chem. Rev., 1989, 89, at page 1894). A folded conformation of a cross-bridged macropolycyclic ligand in a transition-metal complex is further illustrated below:

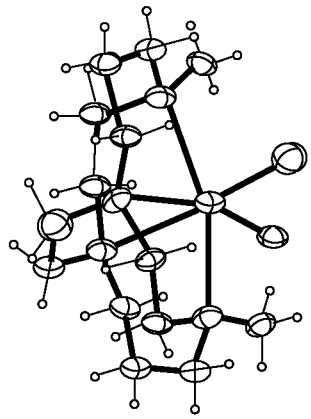

This catalyst is the complex of Example 1 hereinafter. The center atom is Mn; the two ligands to the right are chloride; and a Bcyclam ligand occupies the left side of the distorted octahedral structure. The complex contains an angle N—Mn—N of 158° incorporating the two donor atoms in "axial" positions; the corresponding angle N—Mn—N for the nitrogen donor atoms in plane with the two chloride ligands is 83.2°.

Stated alternately, the preferred synthetic, laundry or cleaning compositions herein contain transition-metal complexes of a macropolycyclic ligand in which there is a major energetic preference of the ligand for a folded, as distinct from an "open" and/or "planar" and or "flat" conformation. For comparison, a disfavored conformation is, for example, either of the trans- structures shown in Hancock and Martell, *Chemical Reviews,* (1989), 89 at page 1894 (see FIG. 18 ), incorporated by reference.

In light of the foregoing coordination description, the present invention includes bleach compositions comprising a transition-metal bleach catalyst, especially based on Mn(II) or Mn(III) or correspondingly, Fe(II) or Fe(III) or Cr(II) or Cr(III), wherein two of the donor atoms in the macropolycyclic rigid ligand, preferably two nitrogen donor atoms, occupy mutually trans- positions of the coordination geometry, and at least two of the donor atoms in the macropolycyclic rigid ligand, preferably at least two nitrogen donor atoms, occupy cis- equatorial positions of the coordination geometry, including particularly the cases in which there is substantial distortion as illustrated hereinabove.

The present compositions can, furthermore, include transition metal bleach catalysts in which the number of asymmetric sites can vary widely; thus both S— and R— absolute conformations can be included for any stereochemically active site. Other types of isomerism, such as geometric isomerism, are also included. The transition-metal bleach catalyst can further include mixtures of geometric or stereoisomers.

Purification of Catalyst

In general, the state of purity of the transition-metal bleach catalyst can vary, provided that any impurities, such as byproducts of the synthesis, free ligand(s), unreacted transition-metal salt precursors, colloidal organic or inorganic particles, and the like, are not present in amounts which substantially decrease the utility of the transition-metal bleach catalyst. It has been discovered that preferred embodiments of the present invention include those in which the transition-metal bleach catalyst is purified by any suitable means, such that it does not excessively consume available oxygen (AvO). Excessive AvO consumption is defined as including any instance of exponential decrease in AvO levels of bleaching, oxidizing or catalyzing solutions with time at 20–40 deg. C. Preferred transition-metal bleach catalysts herein, whether purified or not, when placed into dilute aqueous buffered alkaline solution at a pH of about 9 (carbonate/bicarbonate buffer) at temperatures of about 40 deg. C., have a relatively steady decrease in AvO levels with time; in preferred cases, this rate of decrease is linear or approximately linear. In the preferred embodiments, there is a rate of AvO consumption at 40 deg C. given by a slope of a graph of % AvO vs. time (in sec.) (hereinafter "AvO slope") of from about −0.0050 to about −0.0500, more preferably −0.0100 to about −0.0200. Thus, a preferred Mn(II) bleach catalyst in accordance with the invention has an AvO slope of from about −0.0140 to about −0.0182; in contrast, a somewhat less preferred transition metal bleach catalyst has an AvO slope of −0.0286.

Preferred methods for determining AvO consumption in aqueous solutions of transition metal bleach catalysts herein include the well-known iodometric method or its variants, such as methods commonly applied for hydrogen peroxide. See, for example, Organic Peroxides, Vol. 2., D. Swern (Ed.,), Wiley-Interscience, New York, 1971, for example the table at p. 585 and references therein including P.D. Bartlett and R. Altscul, J. Amer. Chem. Soc., 67, 812 (1945) and W. E. Cass, J. Amer. Chem. Soc., 68, 1976 (1946). Accelerators such as ammonium molybdate can be used. The general procedure used herein is to prepare an aqueous solution of catalyst and hydrogen peroxide in a mild alkaline buffer, for example carbonatelbicarbonate at pH 9, and to monitor the consumption of hydrogen peroxide by periodic removal of aliquots of the solution which are "stopped" from further loss of hydrogen peroxide by acidification using glacial acetic acid, preferably with chilling (ice). These aliquots can then be analyzed by reaction with potassium iodide, optionally but sometimes preferably using ammonium molybdate (especially low-impurity molybdate, see for example U.S. Pat. No. 4,596,701) to accelerate complete reaction, followed by back-titratation using sodium thiosulfate. Other variations of analytical procedure can be used, such as thermometric procedures, potential buffer methods (Ishibashi et al., Anal. Chim. Acta (1992), 261(1–2), 405–10) or photometric procedures for determination of hydrogen peroxide (EP 485,000 A2, May 13, 1992). Variations of methods permitting fractional determinations, for example of peracetic acid and hydrogen peroxide, in presence or absence of the instant transition-metal bleach catalysts are also useful; see, for example JP 92-303215, Oct. 16, 1992.

In another embodiment of the present invention, there are encompassed laundry and cleaning compositions incorporating transition-metal bleach catalysts which have been purified to the extent of having a differential AvO loss reduction, relative to the untreated catalyst, of at least about 10% (units here are dimensionless since they represent the ratio of the AvO slope of the treated transition-metal bleach catalyst over the AvO slope for the untreated transition metal bleach catalyst—effectively a ratio of AvO's). In other terms, the AvO slope is improved by purification so as to bring it into the above-identified preferred ranges.

In yet another embodiment of the instant invention, two processes have been identified which are particularly effective in improving the suitability of transition-metal bleach catalysts, as synthesized, for incorporation into laundry and cleaning products or for other useful oxidation catalysis applications.

One such process is any process having a step of treating the transition-metal bleach catalyst, as prepared, by extracting the transition-metal bleach catalyst, in solid form, with an aromatic hydrocarbon solvent; suitable solvents are oxidation-stable under conditions of use and include benzene and toluene, preferably toluene. Surprisingly, toluene extraction can measurably improve the AvO slope (see disclosure hereinabove).

Another process which can be used to improve the AvO slope of the transition metal bleach catalyst is to filter a solution thereof using any suitable filtration means for removing small or colloidal particles. Such means include the use of fine-pore filters; centrifugation; or coagulation of the colloidal solids.

In more detail, a full procedure for purifying a transition-metal bleach catalyst herein can include:

(a) dissolving the transition-metal bleach catalyst, as prepared, in hot acetonitrile:

(b) filtering the resulting solution hot, e.g., at about 70 deg. C., through glass microfibers (for example glass microfiber filter paper available from Whatman);

(c) if desired, filtering the solution of the first filtration through a 0.2 micron membrane (for example, a 0.2 micron filter commercially available from Millipore), or centrifuging whereby colloidal particles are removed;

(d) evaporating the solution of the second filtration to dryness;

(e) washing the solids of step (d) with toluene, for example five times using toluene in an amount which is double the volume of the bleach catalyst solids;

(f) drying the product of step (e).

Another procedure which can be used, in any convenient combination with aromatic solvent washes and/or removal of fine particles is recrystallization. Recrystallization, for example of Mn(II) Bcyclam chloride transition-metal bleach catalyst, can be done from hot acetonitrile. Recrystallization can have its disadvantages, for example it may on occasion be more costly.

The present invention has numerous alternate embodiments and ramifications. For example, in the laundry detergents and laundry detergent additives field, the invention includes all manner of bleach-containing or bleach additive compositions, including for example, fully-formulated heavy-duty granular detergents containing sodium perborate or sodium percarbonate and/or a preformed peracid derivative such as OXONE as primary oxidant, the transition-metal catalyst of the invention, a bleach activator such as tetraacetylethylenediamine or a similar compound, with or without nonanoyloxybenzenesulfonate sodium salt, and the like.

Other suitable composition forms include laundry bleach additive powders, granular or tablet-form automatic dish-washing detergents, scouring powders and bathroom cleaners. In the solid-form compositions, the catalytic system may lack solvent (water)—this is added by the user along with the substrate (a soiled surface) which is to be cleaned (or contains soil to be oxidized).

Other desirable embodiments of the instant invention include dentifrice or denture cleaning compositions. Suitable compositions to which the transition-metal complexes herein can be added include the dentifrice compositions containing stabilized sodium percarbonate, see for example U.S. Pat. No. 5,424,060 and the denture cleaners of U.S. Pat. No. 5,476,607 which are derived from a mixture containing a pregranulated compressed mixture of anhydrous perborate, perborate monohydrate and lubricant, monopersulfate, non-granulated perborate monohydrate, proteolytic enzyme and sequestering agent, though enzyme-free compositions are also very effective. Optionally, excipients, builders, colors, flavors, and surfactants can be added to such compositions, these being adjuncts characteristic of the intended use. RE32,771 describes another denture cleaning composition to which the instant transition-metal catalysts may profitably be added. Thus, by simple admixture of, for example, about 0.00001% to about 0.1% of the present transition-metal catalyst, a cleaning composition is secured that is particularly suited for compaction into tablet form; this composition also comprises a phosphate salt, an improved perborate salt mixture wherein the improvement comprises a combination of anhydrous perborate and monohydrate perborate in the amount of about 50% to about 70% by weight of the total cleansing composition, wherein the combination includes at least 20% by weight of the total cleansing composition of anhydrous perborate, said combination having a portion present in a compacted granulated mixture with from about 0.01% to about 0.70% by weight of said combination of a polymeric fluorocarbon, and a chelating or sequestering agent present in amounts greater than about 10% by weight up to about 50% by weight of the total composition, said cleansing composition being capable of cleansing stained surfaces and the like with a soaking time of five minutes or less when dissolved in aqueous solution and producing a marked improvement in clarity of solution upon disintegration and cleaning efficacy over the prior art. Of course, the denture cleaning composition need not extend to the sophistication of such compositions: adjuncts not essential to the provision of catalytic oxidation such as the fluorinated polymer can be omitted if desired.

In another non-limiting illustration, the present transition-metal catalyst can be added to an effervescent denture-cleaning composition comprising monoperphthalate, for example the magnesium salt thereof, and/or to the composition of U.S. Pat. No. 4,490,269 incorporated herein by reference. Preferred denture cleansing compositions include those having tablet form, wherein the tablet composition is characterized by active oxygen levels in the range from about 100 to about 200 mg/tablet; and compositions characterized by fragrance retention levels greater than about 50% throughout a period of six hours or greater. See U.S. Pat. No. 5,486,304 incorporated by reference for more detail in connection especially with fragrance retention.

The advantages and benefits of the instant invention include cleaning compositions which have superior bleaching compared to compositions not having the selected transition-metal bleach catalyst. The superiority in bleaching is obtained using very low levels of transition-metal bleach catalyst. The invention includes embodiments which are especially suited for fabric washing, having a low tendency to damage fabrics in repeated washings. However, numerous other benefits can be secured; for example, compositions can be relatively more aggressive, as needed, for example, in tough cleaning of durable hard surfaces, such as the interiors of ovens, or kitchen surfaces having difficult-to-remove films of soil. The compositions can be used both in "pre-treat" modes, for example to loosen dirt in kitchens or bathrooms; or in a "mainwash" mode, for example in fully-formulated heavy-duty laundry detergent granules. Moreover, in addition to the bleaching and/or soil-removing advantages, other advantages of the instant compositions include their efficacy in improving the sanitary condition of surfaces ranging from laundered textiles to kitchen countertops and bathroom tiles. Without intending to be limited by theory, it is believed that the compositions can help control or kill a wide variety of micro-organisms, including bacteria, viruses, sub-viral particles and molds; as well as to destroy objectionable non-living proteins and/or peptides such as certain toxins.

The transition-metal bleach catalysts useful herein may be synthesized by any convenient route. However, specific synthesis methods are nonlimitingly illustrated in detail as follows.

EXAMPLE 1

Synthesis of [Mn(Bcyclam)$Cl_2$]

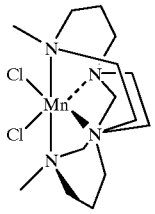

(a) Method I.

"Bcyclam" (5,12-dimethyl-1,5,8,12-tetraaza-bicyclo [6.6.2]hexadecane) is prepared by a synthesis method described by G. R. Weisman, et al., *J. Amer. Chem. Soc.,* (1990), 112,8604. Bcyclam (1.00 g., 3.93 mmol) is dissolved in dry $CH_3CN$ (35 mL, distilled from $CaH_2$). The solution is then evacuated at 15 mm until the $CH_3CN$ begins to boil. The flask is then brought to atmospheric pressure with Ar. This degassing procedure is repeated 4 times. Mn(pyridine)$_2Cl_2$ (1.12 g., 3.93 mmol), synthesized according to the literature procedure of H. T. Witteveen et al., *J. Inorg. Nucl. Chem.,* (1974), 36, 1535, is added under Ar. The cloudy reaction solution slowly begins to darken. After stirring overnight at room temperature, the reaction solution becomes dark brown with suspended fine particulates. The reaction solution is filtered with a 0.2 $\mu$ filter. The filtrate is a light tan color. This filtrate is evaporated to dryness using a rotoevaporator. After drying overnight at 0.05 mm at room temperature, 1.35 g. off-white solid product is collected, 90% yield. Elemental Analysis: % Mn, 14.45; % C, 44.22; % H, 7.95; theoretical for [Mn(Bcyclam)$Cl_2$], $MnC_{14}H_{30}N_4Cl_2$, MW=380.26. Found: % Mn, 14.98; % C, 44.48; % H, 7.86; Ion Spray Mass Spectroscopy shows one major peak at 354 mu corresponding to [Mn(Bcyclam)(formate)]$^+$.

(b) Method II.

Freshly distilled Bcyclam (25.00 g., 0.0984 mol), which is prepared by the same method as above, is dissolved in dry $CH_3CN$ (900 mL, distilled from $CaH_2$). The solution is then evacuated at 15 mm until the $CH_3CN$ begins to boil. The flask is then brought to atmospheric pressure with Ar. This degassing procedure is repeated 4 times. $MnCl_2$ (11.25 g., 0.0894 mol) is added under Ar. The cloudy reaction solution immediately darkens. After stirring 4 hrs. under reflux, the reaction solution becomes dark brown with suspended fine particulates. The reaction solution is filtered through a 0.21 $\mu$ filter under dry conditions. The filtrate is a light tan color. This filtrate is evaporated to dryness using a rotoevaporator. The resulting tan solid is dried overnight at 0.05 mm at room temperature. The solid is suspended in toluene (100 mL) and heated to reflux. The toluene is decanted off and the procedure is repeated with another 100 mL of toluene. The balance of the toluene is removed using a rotoevaporator. After drying overnight at 0.05 mm at room temperature, 31.75 g. of a light blue solid product is collected, 93.5% yield. Elemental Analysis: % Mn, 14.45; % C, 44.22; % H, 7.95; % N, 14.73; % Cl, 18.65; theoretical for [Mn(Bcyclam)$Cl_2$], $MnC_{14}H_{30}N_4Cl_2$, MW=380.26. Found: % Mn, 14.69; % C, 44.69; % H, 7.99; % N, 14.78; % Cl, 18.90 (Karl Fischer Water, 0.68%). Ion Spray Mass Spectroscopy shows one major peak at 354 mu corresponding to [Mn(Bcyclam)(formate)]$^+$.

EXAMPLE 2

Synthesis of [Mn($C_4$-Bcyclam)$Cl_2$] where $C_4$-Bcyclam=5-n-butyl-12-methyl-1,5,8,12-tetraaza-bicyclo [6.6.2] hexadecane

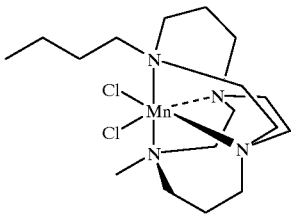

(a) $C_4$-Bcyclam Synthesis

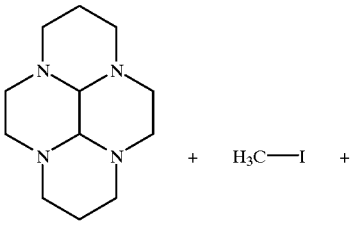

I

-continued

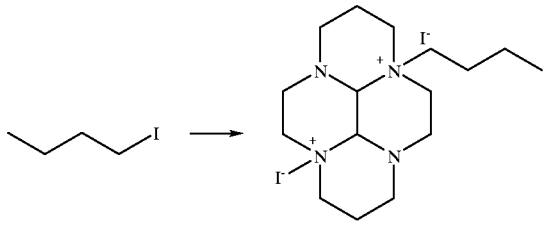

II

Tetracyclic adduct I is prepared by the literature method of H. Yamamoto and K. Maruoka, *J. Amer. Chem. Soc.* (1981) ,103, 4194. I (3.00 g., 13.5 mmol) is dissolved in dry $CH_3CN$ (50 mL, distilled from $CaH_2$). 1-Iodobutane (24.84 g., 135 mmol) is added to the stirred solution under Ar. The solution is stirred at room temperature for 5 days. 4-Iodobutane (12.42 g., 67.5 mmol) is added and the solution is stirred an additional 5 days at RT. Under these conditions, I is fully mono-alkylated with 1-iodobutane as shown by $^{13}$C-NMR. Methyl iodide (26.5 g, 187 mmol) is added and the solution is stirred at room temperature for an additional 5 days. The reaction is filtered using Whatman #4 paper and vacuum filtration. A white solid, II, is collected (6.05 g., 82%). $^{13}$C NMR ($CDCl_3$) 16.3, 21.3, 21.6, 22.5, 25.8, 49.2, 49.4, 50.1, 51.4, 52.6, 53.9, 54.1, 62.3, 63.5, 67.9, 79.1, 79.2 ppm. Electro spray Mass Spec. (MH$^+$/2, 147).

II (6.00 g., 11.0 mmol) is dissolved in 95% ethanol (500 mL). Sodium borohydride (11.0 g., 290 mmol) is added and the reaction turns milky white. The reaction is stirred under Ar for three days. Hydrochloric acid (100 mL, concentrated) is slowly dripped into the reaction mixture over 1 hour. The reaction mixture is evaporated to dryness using a rotoevaporator. The white residue is dissolved in sodium hydroxide (500 mL, 1.00N). This solution is extracted with toluene (2×150 mL). The toluene layers are combined and dried with sodium sulfate. After removal of the sodium sulfate using filtration, the toluene is evaporated to dryness using a rotoevaporator. The resulting oil is dried at room temperature under high vacuum (0.05 mm) overnight. A colorless oil results 2.95 g., 90%. This oil (2.10 g.) is distilled using a short path distillation apparatus (still head temperature 115° C. at 0.05 mm). Yield: 2.00 g. $^{13}$C NMR ($CDCl_3$) 14.0, 20.6, 27.2, 27.7, 30.5, 32.5, 51.2, 51.4, 54.1, 54.7, 55.1, 55.8, 56.1, 56.5, 57.9, 58.0, 59.9 ppm. Mass Spec. (MH$^+$, 297).

(b) [Mn($C_4$-Bcyclam)$Cl_2$] Synthesis $C_4$-Bcyclam (2.00 g., 6.76 mmol) is slurried in dry $CH_3CN$ (75 mL, distilled from $CaH_2$). The solution is then evacuated at 15 mm until the $CH_3CN$ begins to boil. The flask is then brought to atmospheric pressure with Ar. This degassing procedure is repeated 4 times. $MnCl_2$ (0.81 g., 6.43 mmol) is added under Ar. The tan, cloudy reaction solution immediately darkens. After stirring 4 hrs. under reflux, the reaction solution becomes dark brown with suspended fine particulates. The reaction solution is filtered through a 0.2 $\mu$ membrane filter under dry conditions. The filtrate is a light tan color. This filtrate is evaporated to dryness using a rotoevaporator. The resulting white solid is suspended in toluene (50 mL) and heated to reflux. The toluene is decanted off and the procedure is repeated with another 100 mL of toluene. The balance of the toluene is removed using a rotoevaporator. After drying overnight at 0.05 mm, RT, 2.4 g. a light blue solid results, 88% yield. Ion Spray Mass Spectroscopy shows one major peak at 396 mu corresponding to [Mn($C_4$-Bcyclam)(formate)]$^+$.

EXAMPLE 3

Synthesis of [Mn(Bz-Bcyclam)$Cl_2$] where Bz-Bcyclam=5-benzyl-12-methyl-1,5,8,12-tetraaza-bicyclo[6.6.2] hexadecane

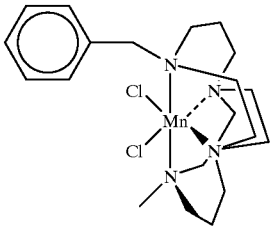

(a) Bz-Bcyclam Synthesis

This ligand is synthesized similarly to the $C_4$-Bcyclam synthesis described above in Example 2(a) except that benzyl bromide is used in place of the 1-iodobutane. $^{13}C$ NMR ($CDCl_3$) 27.6, 28.4, 43.0, 52.1, 52.2, 54.4, 55.6, 56.4, 56.5, 56.9, 57.3, 57.8, 60.2, 60.3, 126.7, 128.0, 129.1, 141.0 ppm. Mass Spec. ($MH^+$, 331).

(b) [Mn(Bz-Bcyclam)$Cl_2$] Synthesis

This complex is made similarly to the [Mn($C_4$-Bcyclam) $Cl_2$] synthesis described above in Example 2(b) except that Bz-Bcyclam is used in place of the $C_4$-Bcyclam. Ion Spray Mass Spectroscopy shows one major peak at 430 mu corresponding to [Mn(Bz-Bcyclam)(formate)]$^+$.

EXAMPLE 4

Synthesis of [Mn($C_8$-Bcyclam)$Cl_2$] where $C_8$-Bcyclam=5-n-octyl-12-methyl-1,5,8,12-tetraaza-bicyclo[6.6.2] hexadecane

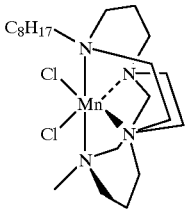

(a) $C_8$-Bcyclam Synthesis:

This ligand is synthesized similarly to the $C_4$-Bcyclam synthesis described above in Example 2(a) except that I-iodooctane is used in place of the 1-iodobutane. Mass Spec. ($MH^+$, 353).

(b) [Mn($C_8$-Bcyclam)$Cl_2$] Synthesis

This complex is made similarly to the [Mn($C_4$-Bcyclam) $Cl_2$] synthesis described above in Example 2(b)except that $C_8$-Bcyclam is used in place of the $C_4$-Bcyclam. Ion Spray Mass Spectroscopy shows one major peak at 452 mu corresponding to [Mn($C_8$-Bcyclam)(formate)]$^+$.

EXAMPLE 5

Synthesis of [Mn(Hg-Bcyclam)$Cl_2$] where $H_9$-Bcyclam=1,5,8,12-tetraaza-bicyclo[6.6.2]hexadecane

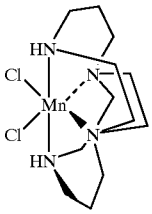

The $H_2$-Bcyclam is synthesized similarly to the $C_4$-Bcyclam synthesis described above except that benzyl bromide is used in place of the 1-iodobutane and the methyl iodide. The benzyl groups are removed by catalytic hydrogenation. Thus, the resulting 5,12-dibenzyl-1,5,8,12-tetraaza-bicyclo[6.6.2]hexadecane and 10% Pd on charcoal is dissolved in 85% acetic acid. This solution is stirred 3 days at room temperature under 1 atm. of hydrogen gas. The solution is filtered though a 0.2 micron filter under vacuum. After evaporation of solvent using a rotary evaporator, the product is obtained as a colorless oil. Yield: $90^+$%.

The Mn complex is made similarly to the [Mn(Bcyclam) $Cl_2$] synthesis described in Example 1(b) except that the that $H_2$-Bcyclam is used in place of the Bcyclam.

Elemental Analysis: % C, 40.92; % H, 7.44; % N, 15.91; theoretical for [Mn($H_2$-Bcyclam)$Cl_2$], $MnC_{12}H_{26}N_4Cl_2$, MW=352.2. Found: % C, 41.00; % H, 7.60; % N, 15.80. FAB+ Mass Spectroscopy shows one major peak at 317 mu corresponding to [Mn($H_2$-Bcyclam)Cl]+ and another minor peak at 352 mu corresponding to [Mn($H_2$-Bcyclam)$Cl_2$]$^+$.

EXAMPLE 6

Synthesis of [Fe($H_2$-Bcyclam)$Cl_2$] where $H_2$-Bcyclam=1,5,8,12-tetraaza-bicyclo[6.6.2]hexadecane

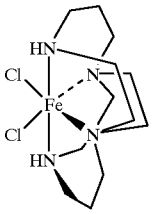

The Fe complex is made similarly to the [Mn($H_2$-Bcyclam)$Cl_2$] synthesis described in Example 5 except that the that anhydrous $FeCI_2$ is used in place of the $MnCl_2$.

Elemental Analysis: % C, 40.82; % H, 7.42; % N, 15.87; theoretical for [Fe($H_2$-Bcyclam)$Cl_2$]$^+$, $FeC_{12}H_{26}N_4Cl_2$, MW=353.1. Found: % C, 39.29; % H, 7.49; % N, 15.00. FAB+ Mass Spectroscopy shows one major peak at 318 mu corresponding to [Fe($H_2$-Bcyclam)Cl]$^+$ and another minor peak at 353 mu corresponding to [Fe($H_2$-Bcyclam)$Cl_2$]$^+$.

EXAMPLE 7

Synthesis of:

Chloro-20-methyl-1,9,20,24,25-pentaaza-tetracyclo [7.7.7.$1^{3,7}$.$1^{11,15}$]pentacosa-3,5,7(24),11,13,15(25)-hexaene manganese(II) hexafluorophosphate ,7(b); Trifluoromethanesulfono-20-methyl-1,9,20,24,25-pentaaza tetracyclo[7.7.7.$1^{3,7}$.$1^{11,15}$.]pentacosa-3,5,7(24),11,13,15 (25)-hexaene manganese(II) trifluoromethanesulfonate, 7(c) and Thiocyanato-20-methyl-1,9,20,24,25-pentaaza-tetracyclo[7.7.7.$1^{3,7}$.$1^{11,15}$.]pentacosa-3,5,7(24),11,13,15 (25)-hexaene iron(II) thiocyanate, 7(d)

(a) Synthesis of the ligand 20-methyl-1,9,20,24,25-pentaaza-tetracyclo[7.7.7.$1^{3,7}$.$1^{11,15}$.]pentacosa-3,5,7(24), 11,13,15(25)-hexaene The ligand 7-methyl-3,7,11,17-tetraazabicyclo[11.3.1$^{17}$] heptadeca-1(17), 13, 15-triene is synthesized by the literature procedure of K. P. Balakrishnan et al., *J. Chem. Soc., Dalton Trans.,* 1990, 2965.

7-methyl-3,7,11,17-tetraazabicyclo[11.3.1$^{17}$]heptadeca-1 (17), 13, 15-triene (1.49 g, 6 mmol) and O,O'-bis (methanesulfonate)-2,6-pyridine dimethanol (1.77 g, 6 mmol) are separately dissolved in acetonitrile (60 ml). They are then added via a syringe pump (at a rate of 1.2 ml/hour) to a suspension of anhydrous sodium carbonate (53 g, 0.5 mol) in acetonitrile (1380 ml). The temperature of the reaction is maintained at 65° C. throughout the total reaction of 60 hours.

After cooling, the solvent is removed under reduced pressure and the residue is dissolved in sodium hydroxide solution (200 ml, 4 M). The product is then extracted with benzene (6 times 100 ml) and the combined organic extracts are dried over anhydrous sodium sulfate. After filtration the solvent is removed under reduced pressure. The product is then dissolved in an acetonitrile/triethylamine mixture (95:5) and is passed through a column of neutral alumina (2.5×12 cm). Removal of the solvent yields a white solid (0.93 g, 44%).

This product may be further purified by recrystallization from an ethanol/diethylether mixture combined with cooling at 0° C. overnight to yield a white crystalline solid. Anal. Calcd. for $C_{21}H_{29}N_5$: C, 71.75; H, 8.32; N, 19.93. Found: C, 71.41; H, 8.00; N, 20.00. A mass spectrum displays the expected molecular ion peak [for $C_{21}H_{30}N_5]^+$ at m/z=352. The $^1$H NMR(400 MHz, in $CD_3CN$) spectrum exhibits peaks at δ=1.81 (m,4H); 2.19 (s, 3H); 2.56 (t, 4H); 3.52 (t,4H); 3.68 (AB, 4H), 4.13 (AB, 4H), 6.53 (d, 4H) and 7.07 (t, 2H). The $^{13}$C NMR(75.6 MHz, in $CD_3CN$) spectrum shows eight peaks at δ=24.05, 58.52, 60.95, 62.94, 121.5, 137.44 and 159.33 ppm.

All metal complexation reactions are performed in an inert atmosphere glovebox using distilled and degassed solvents.

(b) Complexation of the ligand $L_1$ with bis(pyridine) manganese (II) chloride

Bis(pyridine)manganese (II) chloride is synthesized according to the literature procedure of H. T. Witteveen et al., *J. Inorg. Nucl. Chem.,* 1974, 36, 1535.

The ligand $L_1$ (1.24 g, 3.5 mmol), triethylamine(0.35 g, 3.5 mmol) and sodium hexafluorophosphate (0.588 g, 3.5 mmol) are dissolved in pyridine (12 ml). To this is added bis(pyridine)manganese (II) chloride and the reaction is stirred overnight. The reaction is then filtered to remove a white solid. This solid is washed with acetonitrile until the washings are no longer colored and then the combined organic filtrates are evaporated under reduced pressure. The residue is dissolved in the minimum amount of acetonitrile and allowed to evaporate overnight to produce bright red crystals. Yield: 0.8 g (39%). Anal. Calcd. for $C_{21}H_{31}N_5Mn_1Cl_1P_1F_6$: C, 43.00; H, 4.99 and N, 11.95. Found: C, 42.88; H, 4.80 and N 11.86. A mass spectrum displays the expected molecular ion peak [for $C_{21}H_{31}N_5Mn_1Cl_1$] at m/z=441. The electronic spectrum of a dilute solution in water exhibits two absorption bands at 260 and 414 nm (ε=1.47×10$^3$ and 773 $M^{-1}$ $cm^{-1}$ respectively). The IR spectrum (KBr) of the complex shows a band at 1600 $cm^{-1}$ (pyridine), and strong bands at 840 and 558 $cm^{-1}$ ($PF_6^-$).

(c) Complexation of the ligand with manganese (II) trifluoromethanesulfonate

Manganese (II) trifluoromethanesulfonate is prepared by the literature procedure of Bryan and Dabrowiak, Inorg. Chem., 1975, 14, 297.

Manganese (II) trifluoromethanesulfonate (0.883 g, 2.5 mmol) is dissolved in acetonitrile (5 ml). This is added to a solution of the ligand $L_1$(0.878 g, 2.5 mmol) and triethylamine (0.25 g, 2.5 mmol) in acetonitrile (5 ml). This is then heated for two hours before filtering and then after cooling removal of the solvent under reduced pressure. The residue is dissolved in a minimum amount of acetonitrile and left to evaporate slowly to yield orange crystals. Yield 1.06 g (60%). Anal. Calc. for $Mn_1C_{23}H_{29}N_5S_2F_6O_6$: C, 39.20; H, 4.15 and N, 9.95. Found: C, 38.83; H, 4.35 and N, 10.10. The mass spectrum displays the expected peak for $[Mn_1C_{22}H_{29}N_5S_1F_3O_3]^+$ at m/z=555. The electronic spectrum of a dilute solution in water exhibits two absorption bands at 260 and 412 nm (ε=9733 and 607 $M^{-1}cm^{-1}$ respectively). The IR spectrum (KBr) of the complex shows a band at 1600 $cm^{-1}$ (pyridine) and 1260, 1160 and 1030 $cm^{-1}$ ($CF_3SO_3$).

(d) Complexation of the ligand with iron (II) trifluoromethanesulfonate

Iron (II) trifluoromethanesulfonate is prepared in situ by the literature procedure Tait and Busch, *Inorg. Synth.,* 1978, XVIII, 7.

The ligand (0.833 g, 2.5 mmol) and triethylamine (0.505 g, 5 mmol) are dissolved in acetonitrile (5 ml). To this is added a solution of hexakis(acetonitrile) iron (II) trifluoromethanesulfonate (1.5 g, 2.5 mmol) in acetonitrile (5 ml) to yield a dark red solution. Sodium thiocyanate (0.406 g, 5 mmol) is then added and the reaction stirred for a further hour. The solvent is then removed under reduced pressure and the resulting solid is recrystallized from methanol to produce red microcrystals. Yield: 0.65 g (50%). Anal. Calc. for $Fe_1C_{23}H_{29}N_7S_2$:C, 52.76; H, 5.59 and N, 18.74. Found: C 52.96; H, 5.53; N, 18.55. A mass spectrum displays the expected molecular ion peak [for $Fe_1C_{22}H_{29}N_6S_1]^+$ at m/z=465. The $^1$H NMR (300 MHz, $CD_3CN$) δ=1.70(AB,2H), 2.0 (AB,2H), 2.24 (s,3H), 2.39 (m,2H), 2.70 (m,4H), 3.68 (m,4H), 3.95 (m,4H), 4.2 (AB,2H), 7.09 (d,2H), 7.19 (d,2H), 7.52 (t,1H), 7.61 (d,1H). The IR spectrum (KBr) of the spectrum shows peaks at 1608 $cm^-$ (pyridine) and strong peaks at 2099 and 2037 $cm^{-1}$ ($SCN^-$).

Oxygen Bleaching Agents:

Preferred compositions of the present invention comprise, as part or all of the laundry or cleaning adjunct materials, an oxygen bleaching agent. Oxygen bleaching agents useful in the present invention can be any of the oxidizing agents known for laundry, hard surface cleaning, automatic dishwashing or denture cleaning purposes. Oxygen bleaches or mixtures thereof are preferred, though other oxidant bleaches, such as oxygen, an enzymatic hydrogen peroxide producing system, or hypohalites such as chlorine bleaches like hypochlorite, may also be used.

Oxygen bleaches deliver "available oxygen" (AvO) or "active oxygen" which is typically measurable by standard methods such as iodide/thiosulfate and/or ceric sulfate titration. See the well-known work by Swern, or Kirk Othmer's Encyclopedia of Chemical Technology under "Bleaching Agents". When the oxygen bleach is a peroxygen compound, it contains —O—O— linkages with one O in each such linkage being "active". AvO content of such an oxygen bleach compound, usually expressed as a percent, is equal to 100 * the number of active oxygen atoms * (16/molecular weight of the oxygen bleach compound).

Preferably, an oxygen bleach will be used herein, since this benefits directly from combination with the transition-metal bleach catalyst. The mode of combination can vary. For example, the catalyst and oxygen bleach can be incorporated into a single product formula, or can be used in various combinations of "pretreatment product" such as "stain sticks", "main wash product" and even "post-wash product" such as fabric conditioners or dryer-added sheets. The oxygen bleach herein can have any physical form compatible with the intended application; more particularly, liquid-form and solid-form oxygen bleaches as well as adjuncts, promoters or activators are included. Liquids can be included in solid detergents, for example by adsorption onto an inert support; and solids can be included in liquid detergents, for example by use of compatible suspending agents.

Common oxygen bleaches of the peroxygen type include hydrogen peroxide, inorganic peroxohydrates, organic peroxohydrates and the organic peroxyacids, including hydrophilic and hydrophobic mono- or di- peroxyacids. These can be peroxycarboxylic acids, peroxyimidic acids, amidoperoxycarboxylic acids, or their salts including the calcium, magnesium, or mixed-cation salts. Peracids of various kinds can be used both in free form and as precursors known as "bleach activators" or "bleach promoters" which, when combined with a source of hydrogen peroxide, perhydrolyze to release the corresponding peracid.

Also useful herein as oxygen bleaches are the inorganic peroxides such as $Na_2O_2$, superoxides such as $KO_2$, organic hydroperoxides such as cumene hydroperoxide and t-butyl hydroperoxide, and the inorganic peroxoacids and their salts such as the peroxosulfuric acid salts, especially the potassium salts of peroxodisulfuric acid and, more preferably, of peroxomonosulfuric acid including the commercial triple-salt form sold as OXONE by DuPont and also any equivalent commercially available forms such as CUROX from Akzo or CAROAT from Degussa. Certain organic peroxides, such as dibenzoyl peroxide, may be useful, especially as additives rather than as primary oxygen bleach.

Mixed oxygen bleach systems are generally useful, as are mixtures of any oxygen bleaches with the known bleach activators, organic catalysts, enzymatic catalysts and mixtures thereof; moreover such mixtures may further include brighteners, photobleaches and dye transfer inhibitors of types well-known in the art.

Preferred oxygen bleaches, as noted, include the peroxohydrates, sometimes known as peroxyhydrates or peroxohydrates. These are organic or, more commonly, inorganic salts capable of releasing hydrogen peroxide readily. They include types in which hydrogen peroxide is present as a true crystal hydrate, and types in which hydrogen peroxide is incorporated covalently and is released chemically, for example by hydrolysis. Typically, peroxohydrates deliver hydrogen peroxide readily enough that it can be extracted in measurable amounts into the ether phase of an ether/water mixture. Peroxohydrates are characterized in that they fail to give the Riesenfeld reaction, in contrast to certain other oxygen bleach types described hereinafter. Peroxohydrates are the most common examples of "hydrogen peroxide source" materials and include the perborates, percarbonates, perphosphates, and persilicates. Other materials which serve to produce or release hydrogen peroxide are, of course, useful. Mixtures of two or more peroxohydrates can be used, for example when it is desired to exploit differential solubility. Suitable peroxohydrates include sodium carbonate peroxyhydrate and equivalent commercial "percarbonate" bleaches, and any of the so-called sodium perborate hydrates, the "tetrahydrate" and "monohydrate" being preferred; though sodium pyrophosphate peroxyhydrate can be used. Many such peroxohydrates are available in processed forms with coatings, such as of silicate and/or borate and/or waxy materials and/or surfactants, or have particle geometries, such as compact spheres, which improve storage stability. By way of organic peroxohydrates, urea peroxyhydrate can also be useful herein.

Percarbonate bleach includes, for example, dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Percarbonates and perborates are widely available in commerce, for example from FMC, Solvay and Tokai Denka.

Organic percarboxylic acids useful herein as the oxygen bleach include magnesium monoperoxyphthalate hexahydrate, available from Interox, m-chloro perbenzoic acid and its salts, 4-nonylamino-4-oxoperoxybutyric acid and diperoxydodecanedioic acid and their salts. Such bleaches are disclosed in U.S. Pat. No. 4,483,781, U.S. patent application Ser. No. 740,446, Burns et al, filed Jun. 3, 1985, EP-A 133,354, published Feb. 20, 1985, and U.S. Pat. No. 4,412,934. Highly preferred oxygen bleaches also include 6-nonylamino-6-oxoperoxycaproic acid (NAPAA) as described in U.S. Pat. No. 4,634,551 and include those having formula HO—O—C(O)—R—Y wherein R is an alkylene or substituted alkylene group containing from 1 to about 22 carbon atoms or a phenylene or substituted phenylene group, and Y is hydrogen, halogen, alkyl, aryl or —C(O)—OH or —C(O)—O—OH.

Organic percarboxylic acids usable herein include those containing one, two or more peroxy groups, and can be aliphatic or aromatic. When the organic percarboxylic acid is aliphatic, the unsubstituted acid suitably has the linear formula: HO—O—C(O)— $(CH_2)_n$—Y where Y can be, for example, H, $CH_3$, $CH_2Cl$, COOH, or C(O)OOH; and n is an integer from 1 to 20. Branched analogs are also acceptable. When the organic percarboxylic acid is aromatic, the unsubstituted acid suitably has formula: HO—O—C(O)— $C_6H_4$—Y wherein Y is hydrogen, alkyl, alkyhalogen, halogen, or —COOH or —C(O)OOH.

Monoperoxycarboxylic acids useful as oxygen bleach herein are further illustrated by alkyl percarboxylic acids and aryl percarboxylic acids such as peroxybenzoic acid and ring-substituted peroxybenzoic acids, e.g., peroxy-alpha-naphthoic acid; aliphatic, substituted aliphatic and arylalkyl monoperoxy acids such as peroxylauric acid, peroxystearic acid, and N,N-phthaloylaminoperoxycaproic acid (PAP); and 6-octylamino-6-oxo-peroxyhexanoic acid. Monoperoxycarboxylic acids can be hydrophilic, such as peracetic acid, or can be relatively hydrophobic. The hydrophobic types include those containing a chain of six or more carbon atoms, preferred hydrophobic types having a linear aliphatic C8–C14 chain optionally substituted by one or more ether oxygen atoms and/or one or more aromatic moieties positioned such that the peracid is an aliphatic peracid. More generally, such optional substitution by ether oxygen atoms and/or aromatic moieties can be applied to any of the peracids or bleach activators herein. Branched-chain peracid types and aromatic peracids having one or more C3–C16 linear or branched long-chain substituents can also be useful. The peracids can be used in the acid form or as any suitable salt with a bleach-stable cation. Very useful herein are the organic percarboxylic acids of formula:

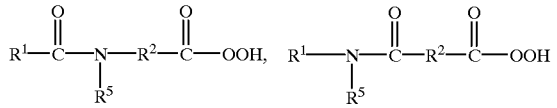

or mixtures thereof wherein $R^1$ is alkyl, aryl, or alkaryl containing from about 1 to about 14 carbon atoms, $R^2$ is alkylene, arylene or alkarylene containing from about 1 to about 14 carbon atoms, and $R^5$ is H or alkyl, aryl, or alkaryl containing from about 1 to about 10 carbon atoms. When these peracids have a sum of carbon atoms in $R^1$ and $R^2$ together of about 6 or higher, preferably from about 8 to about 14, they are particularly suitable as hydrophobic peracids for bleaching a variety of relatively hydrophobic or "lipophilic" stains, including so-called "dingy" types. Calcium, magnesium, or substituted ammonium salts may also be useful.

Other useful peracids and bleach activators herein are in the family of imidoperacids and imido bleach activators. These include phthaloylimidoperoxycaproic acid and related arylimido-substituted and acyloxynitrogen derivatives. For listings of such compounds, preparations and their incorporation into laundry compositions including both granules and liquids, See U.S. Pat. No. 5,487,818; U.S. Pat. No. 5,470,988, U.S. Pat. No. 5,466,825; U.S. Pat. No. 5,419,846; U.S. Pat. No. 5,415,796; U.S. Pat. No. 5,391,324; U.S. Pat. No. 5,328,634; U.S. Pat. No. 5,310,934; U.S. Pat. No. 5,279,757; U.S. Pat. No. 5,246,620; U.S. Pat. No. 5,245,075; U.S. Pat. No. 5,294,362; U.S. Pat. No. 5,423,998; U.S. Pat. No. 5,208,340; U.S. Pat. No. 5,132,431 and U.S. Pat. No. 5,087,385.

Useful diperoxyacids include, for example, 1,12-diperoxydodecanedioic acid (DPDA); 1,9-diperoxyazelaic acid; diperoxybrassilic acid; diperoxysebasic acid and diperoxyisophthalic acid; 2-decyldiperoxybutane-1,4-dioic acid; and 4,4'-sulphonylbisperoxybenzoic acid. Owing to structures in which two relatively hydrophilic groups are disposed at the ends of the molecule, diperoxyacids have sometimes been classified separately from the hydrophilic and hydrophobic monoperacids, for example as "hydrotropic". Some of the diperacids are hydrophobic in a quite literal sense, especially when they have a long-chain moiety separating the peroxyacid moieties.

More generally, the terms "hydrophilic" and "hydrophobic" used herein in connection with any of the oxygen bleaches, especially the peracids, and in connection with bleach activators, are in the first instance based on whether a given oxygen bleach effectively performs bleaching of fugitive dyes in solution thereby preventing fabric graying and discoloration and/or removes more hydrophilic stains such as tea, wine and grape juice—in this case it is termed "hydrophilic". When the oxygen bleach or bleach activator has a significant stain removal, whiteness-improving or cleaning effect on dingy, greasy, carotenoid, or other hydrophobic soils, it is termed "hydrophobic". The terms are applicable also when referring to peracids or bleach activators used in combination with a hydrogen peroxide source. The current commercial benchmarks for hydrophilic performance of oxygen bleach systems are: TAED or peracetic acid, for benchmarking hydrophilic bleaching. NOBS or NAPAA are the corresponding benchmarks for hydrophobic bleaching. The terms "hydrophilic", "hydrophobic" and "hydrotropic" with reference to oxygen bleaches including peracids and here extended to bleach activator have also been used somewhat more narrowly in the literature. See especially Kirk Othmer's Encyclopedia of Chemical Technology, Vol. 4., pages 284–285. This reference provides a chromatographic retention time and critical micelle concentration-based set of criteria, and is useful to identify and/or characterize preferred sub-classes of hydrophobic, hydrophilic and hydrotropic oxygen bleaches and bleach activators that can be used in the present invention.

Bleach Activators

Bleach activators useful herein include amides, imides, esters and anhydrides. Commonly at least one substituted or unsubstituted acyl moiety is present, covalently connected to a leaving group as in the structure R—C(O)—L. In one preferred mode of use, bleach activators are combined with a source of hydrogen peroxide, such as the perborates or percarbonates, in a single product. Conveniently, the single product leads to in situ production in aqueous solution (i.e., during the washing process) of the percarboxylic acid corresponding to the bleach activator. The product itself can be hydrous, for example a powder, provided that water is controlled in amount and mobility such that storage stability is acceptable. Alternately, the product can be an anhydrous solid or liquid. In another mode, the bleach activator or oxygen bleach is incorporated in a pretreatment product, such as a stain stick; soiled, pretreated substrates can then be exposed to further treatments, for example of a hydrogen peroxide source. With respect to the above bleach activator structure RC(O)L, the atom in the leaving group connecting to the peracid-forming acyl moiety R(C)O— is most typically O or N. Bleach activators can have non-charged, positively or negatively charged peracid-forming moieties and/or noncharged, positively or negatively charged leaving groups. One or more peracid-forming moieties or leaving-groups can be present. See, for example, U.S. Pat. No. 5,595,967, U.S. Pat. No. 5,561,235, U.S. Pat. No. 5,560,862 or the bis-(peroxy-carbonic) system of U.S. Pat. No. 5,534,179. Bleach activators can be substituted with electron-donating or electron-releasing moieties either in the leaving-group or in the peracid-forming moiety or moieties, changing their reactivity and making them more or less suited to particular pH or wash conditions. For example, electron-withdrawing groups such as $NO_2$ improve the efficacy of bleach activators intended for use in mild-pH (e.g., from about 7.5- to about 9.5) wash conditions.

Cationic bleach activators include quaternary carbamate-, quaternary carbonate-, quaternary ester- and quaternary amide- types, delivering a range of cationic peroxyimidic, peroxycarbonic or peroxycarboxylic acids to the wash. An analogous but non-cationic palette of bleach activators is available when quaternary derivatives are not desired. In more detail, cationic activators include quaternary ammonium-substituted activators of WO 96-06915, U.S. Pat. Nos. 4,751,015 and 4,397,757, EP-A-284292, EP-A-331,229 and EP-A-03520 including 2-(N,N,N-trimethyl ammonium) ethyl-4-sulphophenyl carbonate-(SPCC); N-octyl,N,N-dimethyl-N 10-carbophenoxy decyl ammonium chloride-(ODC); 3-(N,N,N-trimethyl ammonium) propyl sodium-4-sulphophenyl carboxylate; and N,N,N-trimethyl ammonium toluyloxy benzene dssulfonate. Also useful are cationic nitrites as disclosed in EP-A-303,520 and in European Patent Specification 458,396 and 464,880. Other nitrile types have electron-withdrawing substituents as described in U.S. Pat. No. 5,591,378; examples including 3,5-dimethoxybenzonitrile and 3,5-dinitrobenzonitrile.

Other bleach activator disclosures include GB 836,988; 864,798; 907,356; 1,003,310 and 1,519,351; German Patent 3,337,921; EP-A-0185522; EP-A-0174132; EP-A-0120591; U.S. Pat. Nos. 1,246,339; 3,332,882; 4,128,494; 4,412,934 and 4,675,393, and the phenol sulfonate ester of alkanoyl arninoacids disclosed in U.S. Pat. No. 5,523,434. Suitable bleach activators include any acetylated diamine types, whether hydrophilic or hydrophobic in character.

Of the above classes of bleach precursors, preferred classes include the esters, including acyl phenol sulfonates, acyl alkyl phenol sulfonates or acyl oxybenzenesulfonates (OBS leaving-group); the acyl-amides; and the quaternary ammonium substituted peroxyacid precursors including the cationic nitrites.

Preferred bleach activators include N,N,N'N'-tetraacetyl ethylene diamine (TAED) or any of its close relatives including the triacetyl or other unsymmetrical derivatives. TAED and the acetylated carbohydrates such as glucose pentaacetate and tetraacetyl xylose are preferred hydrophilic bleach activators. Depending on the application, acetyl triethyl citrate, a liquid, also has some utility, as does phenyl benzoate.

Preferred hydrophobic bleach activators include sodium nonanoyloxybenzene sulfonate (NOBS or SNOBS), substituted amide types described in detail hereinafter, such as activators related to NAPAA, and activators related to certain imidoperacid bleaches, for example as described in U.S. Pat. No. 5,061,807, issued Oct. 29, 1991 and assigned to Hoechst Aktiengesellschaft of Frankfurt, Germany. Japanese Laid-Open Patent Application (Kokai) No. 4-28799 for example describes a bleaching agent and a bleaching detergent composition comprising an organic peracid precursor described by a general formula and illustrated by compounds which may be summarized more particularly as conforming to the formula:

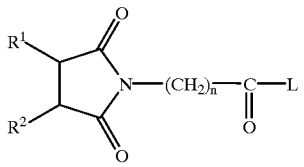

wherein L is sodium p-phenolsulfonate, $R^1$ is $CH_3$ or $C_{12}H_{25}$ and $R^2$ is H. Analogs of these compounds having any of the leaving-groups identified herein and/or having R1 being linear or branched C6–C 16 are also useful.

Another group of peracids and bleach activators herein are those derivable from acyclic imidoperoxycarboxylic acids and salts thereof of the formula:

(i)

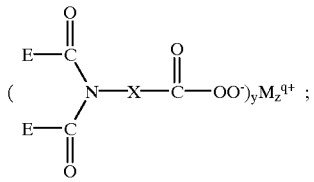

cyclic imidoperoxycarboxylic acids and salts thereof of the formula (ii)

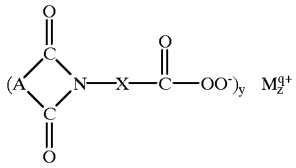

(ii) and (iii) mixtures of said compounds, (i) and (ii); wherein M is selected from hydrogen and bleach-compatible cations having charge q; and y and z are integers such that said compound is electrically neutral; E, A and X comprise hydrocarbyl groups; and said terminal hydrocarbyl groups are contained within E and A. The structure of the corresponding bleach activators is obtained by deleting the peroxy moiety and the metal and replacing it with a leaving-group L, which can be any of the leaving-group moieties defined elsewhere herein. In preferred embodiments, there are encompassed detergent compositions wherein, in any of said compounds, X is linear $C_3$–$C_8$ alkyl; A is selected from:

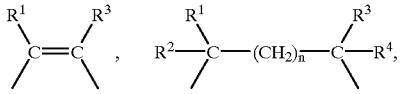

wherein n is from 0 to about 4, and

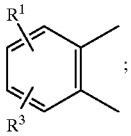

wherein $R^1$ and E are said terminal hydrocarbyl groups, $R^2$, $R^3$ and $R^4$ are independently selected from H, $C_1$–$C_3$ saturated alkyl, and $C_1$–$C_3$ unsaturated alkyl; and wherein said terminal hydrocarbyl groups are alkyl groups comprising at least six carbon atoms, more typically linear or branched alkyl having from about 8 to about 16 carbon atoms.

Other suitable bleach activators include sodium-4-benzoyloxy benzene sulfonate (SBOBS); sodium-1-methyl-2-benzoyloxy benzene-4-sulphonate; sodium-4-methyl-3-benzoyloxy benzoate (SPCC); trimethyl ammonium toluyloxy-benzene sulfonate; or sodium 3,5,5-trimethyl hexanoyloxybenzene sulfonate (STHOBS).

Bleach activators may be used in an amount of up to 20%, preferably from 0.1–10% by weight, of the composition, though higher levels, 40% or more, are acceptable, for example in highly concentrated bleach additive product forms or forms intended for appliance automated dosing.

Highly preferred bleach activators useful herein are amide-substituted and have either of the formulae:

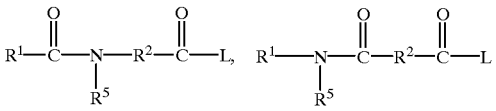

or mixtures thereof, wherein $R^1$ is alkyl, aryl, or alkaryl containing from about 1 to about 14 carbon atoms including both hydrophilic types (short $R^1$) and hydrophobic types ($R^1$ is especially from about 8 to about 12), $R^2$ is alkylene, arylene or alkarylene containing from about 1 to about 14 carbon atoms, $R^5$ is H, or an alkyl, aryl, or alkaryl containing from about 1 to about 10 carbon atoms, and L is a leaving group.

A leaving group as defined herein is any group that is displaced from the bleach activator as a consequence of attack by perhydroxide or equivalent reagent capable of liberating a more potent bleach from the reaction. Perhydrolysis is a term used to describe such reaction. Thus bleach activators perhydrolyze to liberate peracid. Leaving groups of bleach activators for relatively low-pH washing are suitably electron-withdrawing. Preferred leaving groups have slow rates of reassociation with the moiety from which they have been displaced. Leaving groups of bleach activators are preferably selected such that their removal and peracid formation are at rates consistent with the desired application, e.g., a wash cycle. In practice, a balance is struck such that leaving-groups are not appreciably liberated, and the corresponding activators do not appreciably hydrolyze or perhydrolyze, while stored in a bleaching composition. The pK of the conjugate acid of the leaving group is a measure of suitability, and is typically from about 4 to about 16, or higher, preferably from about 6 to about 12, more preferably from about 8 to about 11.

Preferred bleach activators include those of the formulae, for example the amide-substituted formulae, hereinabove, wherein $R^1$, $R^2$ and $R^5$ are as defined for the corresponding peroxyacid and L is selected from the group consisting of:

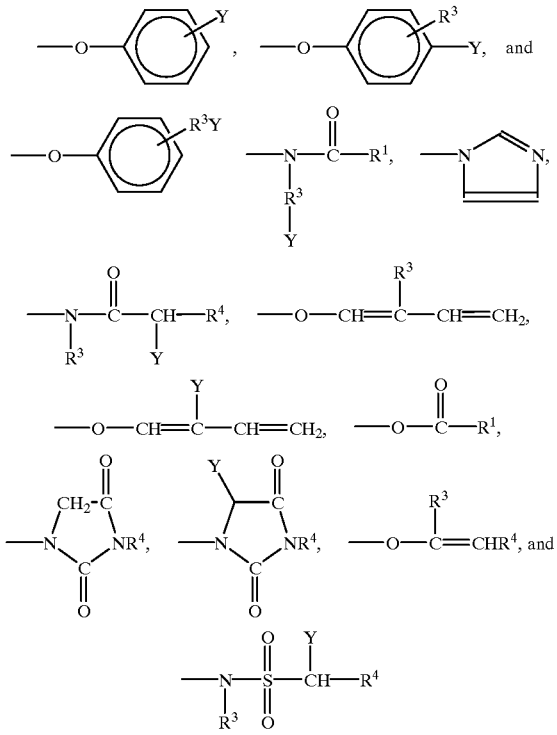

and mixtures thereof, wherein $R^1$ is a linear or branched alkyl, aryl, or alkaryl group containing from about 1 to about 14 carbon atoms, $R^3$ is an alkyl chain containing from 1 to about 8 carbon atoms, $R^4$ is H or $R^3$, and Y is H or a solubilizing group. These and other known leaving groups are, more generally, general suitable alternatives for introduction into any bleach activator herein. Preferred solubilizing groups include $—SO_3^-M^+$, $—CO_2^-M^+$, $—SO_4^-M^+$, $—N^+(R)_4X^-$ and $O←N(R^3)_2$, more preferably $—SO_3^-M^+$ and $—CO_2^-M^+$ wherein $R^3$ is an alkyl chain containing from about 1 to about 4 carbon atoms, M is a bleach-stable cation and X is a bleach-stable anion, each of which is selected consistent with maintaining solubility of the activator. Under some circumstances, for example solid-form European heavy-duty granular detergents, any of the above bleach activators are preferably solids having crystalline character and melting-point above about 50 deg. C.; in these cases, branched alkyl groups are preferably not included in the oxygen bleach or bleach activator; in other formulation contexts, for example heavy-duty liquids with bleach or liquid bleach additives, low-melting or liquid bleach activators are preferred. Melting-point reduction can be favored by incorporating branched, rather than linear alkyl moieties into the oxygen bleach or precursor.

When solubilizing groups are added to the leaving group, the activator can have good water-solubility or dispersibility while still being capable of delivering a relatively hydrophobic peracid. Preferably, M is alkali metal, ammonium or substituted ammonium, more preferably Na or K, and X is halide, hydroxide, methylsulfate or acetate. Solubilizing groups can, more generally, be used in any bleach activator herein. Bleach activators of lower solubility, for example those with leaving group not having a solubilizing group, may need to be finely divided or dispersed in bleaching solutions for acceptable results.

Preferred bleach activators also include those of the above general formula wherein L is selected from the group consisting of:

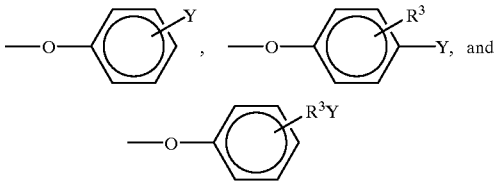

wherein $R^3$ is as defined above and Y is $—SO_3^-M^+$ or $—CO_2^-M^+$ wherein M is as defined above.

Preferred examples of bleach activators of the above formulae include:

(6-octanamidocaproyl)oxybenzenesulfonate, (6-nonanamidocaproyl)oxybenzenesulfonate, (6-decanamidocaproyl)oxybenzenesulfonate, and mixtures thereof.

Other useful activators, disclosed in U.S. Pat. No. 4,966,723, are benzoxazin-type, such as a $C_6H_4$ ring to which is fused in the 1,2-positions a moiety $—C(O)OC(R^1)=N—$.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators are very useful herein, especially the acyl caprolactams (see for example WO 94-28102 A) and acyl valerolactams (see U.S. Pat. No. 5,503,639) of the formulae:

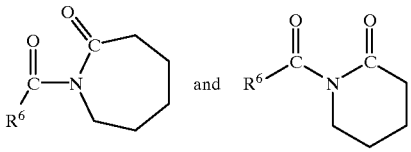

wherein $R^6$ is H, alkyl, aryl, alkoxyaryl, an alkaryl group containing from 1 to about 12 carbon atoms, or substituted phenyl containing from about 6 to about 18 carbons. See also U.S. Pat. No. 4,545,784 which discloses acyl caprolactams, including benzoyl caprolactam adsorbed into sodium perborate. In certain preferred embodiments of the invention, NOBS, lactam activators, imide activators or amide-functional activators, especially the more hydrophobic derivatives, are desirably combined with hydrophilic activators such as TAED, typically at weight ratios of hydrophobic activator: TAED in the range of 1:5 to 5:1, preferably about 1:1. Other suitable lactam activators are alpha-modified, see WO 96-22350 A1, Jul. 25, 1996. Lactam activators, especially the more hydrophobic types, are desirably used in combination with TAED, typically at weight ratios of amido-derived or caprolactam activators: TAED in the range of 1:5 to 5:1, preferably about 1:1. See also the bleach activators having cyclic amidine leaving-group disclosed in U.S. Pat. No. 5,552,556.

Nonlimiting examples of additional activators useful herein are to be found in U.S. Pat. No. 4,915,854, U.S. Pat. Nos. 4,412,934 and 4,634,551. The hydrophobic activator nonanoyloxybenzene sulfonate (NOBS) and the hydrophilic tetraacetyl ethylene diamine (TAED) activator are typical, and mixtures thereof can also be used.

The superior bleaching/cleaning action of the present compositions is also preferably achieved with safety to natural rubber machine parts, for example of certain european washing appliances (see WO 94-28104) and other natural rubber articles, including fabrics containing natural rubber and natural rubber elastic materials. Complexities of bleaching mechanisms are legion and are not completely understood.

Additional activators useful herein include those of U.S. Pat. No. 5,545,349. Examples include esters of an organic acid and ethylene glycol, diethylene glycol or glycerin, or the acid imide of an organic acid and ethylenediamine; wherein the organic acid is selected from methoxyacetic acid, 2-methoxypropionic acid, p-methoxybenzoic acid, ethoxyacetic acid, 2-ethoxypropionic acid, p-ethoxybenzoic acid, propoxyacetic acid, 2-propoxypropionic acid, p-propoxybenzoic acid, butoxyacetic acid, 2-butoxypropionic acid, p-butoxybenzoic acid, 2-methoxyethoxyacetic acid,2-methoxy-1-methylethoxyacetic acid, 2-methoxy-2-methylethoxyacetic acid,2-ethoxyethoxyacetic acid, 2-(2-ethoxyethoxy) propionic acid, p-(2-ethoxyethoxy)benzoic acid, 2-ethoxy-1-methylethoxyacetic acid, 2-ethoxy-2-methylethoxyacetic acid, 2-propoxyethoxyacetic acid, 2-propoxy-1-methylethoxyaceticacid, 2-propoxy-2-methylethoxyacetic acid, 2-butoxyethoxyacetic acid, 2-butoxy-1-methylethoxyacetic acid, 2-butoxy-2-methylethoxyacetic acid, 2-(2-methoxyethoxy)ethoxyacetic acid, 2-(2-methoxy-1-methylethoxy)ethoxyacetic acid, 2-(2-methoxy-2-methylethoxy)ethoxyacetic acid and 2-(2-ethoxyethoxy) ethoxyacetic acid.

Enzymatic sources of hydrogen peroxide

On a different track from the bleach activators illustrated hereinabove, another suitable hydrogen peroxide generating system is a combination of a $C_1$–$C_4$ alkanol oxidase and a $C_1$–$C_4$ alkanol, especially a combination of methanol oxidase (MOX) and ethanol. Such combinations are disclosed in WO 94/03003. Other enzymatic materials related to bleaching, such as peroxidases, haloperoxidases, oxidases, superoxide dismutases, catalases and their enhancers or, more commonly, inhibitors, may be used as optional ingredients in the instant compositions.

Oxygen transfer agents and precursors

Also useful herein are any of the known organic bleach catalysts, oxygen transfer agents or precursors therefor. These include the compounds themselves and/or their precursors, for example any suitable ketone for production of dioxiranes and/or any of the hetero-atom containing analogs of dioxirane precursors or dioxiranes, such as sulfonimines $R^1R^2C{=}NSO_2R^3$, see EP 446 982 A, published 1991 and sulfonyloxaziridines, for example:

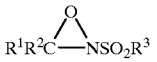

see EP 446,981 A, published 1991. Preferred examples of such materials include hydrophilic or hydrophobic ketones, used especially in conjunction with monoperoxysulfates to produce dioxiranes in situ, and/or the imines described in U.S. Pat. No. 5,576,282 and references described therein. Oxygen bleaches preferably used in conjunction with such oxygen transfer agents or precursors include percarboxylic acids and salts, percarbonic acids and salts, peroxymonosulfuric acid and salts, and mixtures thereof. See also U.S. Pat. No. 5,360,568; U.S. Pat. No. 5,360,569; and U.S. Pat. No. 5,370,826. In a highly preferred embodiment, the invention relates to a detergent composition which incorporates a transition-metal bleach catalyst in accordance with the invention, and organic bleach catalyst such as one named hereinabove, a primary oxidant such as a hydrogen peroxide source, and at least one additional detergent, hard-surface cleaner or automatic dishwashing adjunct. Preferred among such compositions are those which further include a precursor for a hydrophobic oxygen bleach, such as NOBS.

Although oxygen bleach systems and/or their precursors may be susceptible to decomposition during storage in the presence of moisture, air (oxygen and/or carbon dioxide) and trace metals (especially rust or simple salts or colloidal oxides of the transition metals) and when subjected to light, stability can be improved by adding common sequestrants (chelants) and/or polymeric dispersants and/or a small amount of antioxidant to the bleach system or product. See, for example, U.S. Pat. No. 5,545,349. Antioxidants are often added to detergent ingredients ranging from enzymes to surfactants. Their presence is not necessarily inconsistent with use of an oxidant bleach; for example, the introduction of a phase barrier may be used to stabilize an apparently incompatible combination of an enzyme and antioxidant, on one hand, and an oxygen bleach, on the other. Although commonly knowd substances can be used as antioxidants, those that are preferable include phenol-based antioxidants such as 3,5-di-tert-butyl-4-hydroxytoluene and 2,5-di-tert-butylhydroquinone; amine-based antioxidants such as N,N'-diphenyl-p-phenylenediamine and phenyl-4-piperizinyl-carbonate; sulfur-based antioxidants such as didodecyl-3,3'-thiodipropionate and ditridecyl-3,3'-thiodipropionate; phosphorus-based antioxidants such as tris(isodecyl) phosphate and triphenylphosphate; and, natural antioxidants such as L-ascorbic acid, its sodium salts and DL- alpha -tocopherol. These antioxidants may be used independently or in combinations of two or more. From among these, 3,5-di-tert-butyl-4-hydroxytoluene, 2,5-di-tert-butylhydroquinone and D,L-alpha -tocopherol are particularly preferable. When used, antioxidants are blended into the bleaching composition of the present invention preferably at a proportion of 0.01–1.0 wt % of the organic acid peroxide precursor, and particularly preferably at a proportion of 0.05–0.5 wt %. The hydrogen peroxide or peroxide that produces hydrogen peroxide in aqueous solution is blended into the mixture during use preferably at a proportion of 0.5–98 wt %, and particularly preferably at a proportion of 1–50 wt %, so that the effective oxygen concentration is preferably 0.1–3 wt %, and particularly preferably 0.2–2 wt %. In addition, the organic acid peroxide precursor is blended into the composition during use, preferably at a proportion of 0.1–50 wt % and particularly preferably at a proportion of 0.5–30 wt %. Without intending to be limited by theory, antioxidants operating to inhibit or shut down free radical mechanisms may be particularly desirable for controlling fabric damage.

While the combinations of ingredients used with the transition-metal bleach catalysts of the invention can be widely permuted, some particularly preferred combinations include:

(a) transition metal bleach catalyst+hydrogen peroxide source alone, e.g., sodium perborate or percarbonate;

(b) as (a) but with the further addition of a bleach activator selected from
  (i) hydrophilic bleach activators, such as TAED;
  (ii) hydrophobic bleach activators, such as NOBS or activators capable, on perhydrolysis, of releasing NAPAA or a similar hydrophobic peracid, and
  (iii) mixtures thereof;

(c) transition metal bleach catalyst+peracid alone, e.g.,
  (i) hydrophilic peracid, e.g., peracetic acid;
  (ii) hydrophobic peracid, e.g., NAPAA or peroxylauric acid;
  (iii) inorganic peracid, e.g., peroxymonosulfuric acid potassium salts;

(d) use (a), (b) or (c) with the further addition of an oxygen transfer agent or precursor therefor; especially (c)+oxygen transfer agent.

Any of (a)–(d) can be further combined with one or more detersive surfactants, especially including mid-chain branched anionic types having superior low-temperature solubility, such as mid-chain branched sodium alkyl sulfates, though high-level incorporation of nonionic detersive surfactants is also very useful, especially in compact-form heavy-duty granular detergent embodiments; polymeric dispersants, especially including biodegradable, hydrophobically modified and/or terpolymeric types; sequestrants, for example certain penta(methylenephosphonates) or ethylenediamine disuccinate; fluorescent whitening agents; enzymes, including those capable of generating hydrogen peroxide; photobleaches; and/or dye transfer inhibitors. Conventional builders, buffers or alkalis and combinations of multiple cleaning-promoting enzymes, especially proteases, cellulases, amylases, keratinases, and/or lipases may also be added. In such combinations, the transition metal bleach catalyst will preferably be at levels in a range suited to provide wash (in-use) concentrations of from about 0.1 to about 10 ppm (weight of catalyst); the other components typically being used at their known levels, which may vary widely.

While there is currently no certain advantage, the transition metal catalysts of the invention can be used in combination with heretofore-disclosed transition metal bleach or dye transfer inhibition catalysts, such as the Mn or Fe complexes of triazacyclononanes, the Fe complexes of N,N-bis(pyridin-2-yl-methyl)-bis(pyridin-2-yl)methylamine (U.S. Pat. No. 5,580,485) and the like. For example, when the transition metal bleach catalyst is one disclosed to be particularly effective for solution bleaching and dye transfer inhibition, as is the case for example with certain transition metal complexes of porphyrins, it may be combined with one better suited for promoting interfacial bleaching of soiled substrates.

Laundry or Cleaning Adjunct Materials and Methods:

In general, a laundry or cleaning adjunct is any material required to transform a composition containing only transition-metal bleach catalyst into a composition useful for laundry or cleaning purposes. Adjuncts in general include stabilizers, diluents, structuring materials, agents having aesthetic effect such as colorants, pro-perfumes and perfumes, and materials having an independent or dependent cleaning function. In preferred embodiments, laundry or cleaning adjuncts are recognizable to those of skill in the art as being absolutely characteristic of laundry or cleaning products, especially of laundry or cleaning products intended for direct use by a consumer in a domestic environment.

While not essential for the purposes of the present invention as most broadly defined, several such conventional adjuncts illustrated hereinafter are suitable for use in the instant laundry and cleaning compositions and may be desirably incorporated in preferred embodiments of the invention, for example to assist or enhance cleaning performance, for treatment of the substrate to be cleaned, or to modify the aesthetics of the detergent composition as is the case with perfumes, colorants, dyes or the like. The precise nature of these additional components, and levels of incorporation thereof, will depend on the physical form of the composition and the nature of the cleaning operation for which it is to be used.

Unless otherwise indicated, the detergent or detergent additive compositions of the invention may for example, be formulated as granular or power-form all-purpose or "heavy-duty" washing agents, especially laundry detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tabletted, granular, liquid and rinse-aid types for household and institutional use; liquid cleaning and disinfecting agents, including antibacterial hand-wash types, laundry bars, mouthwashes, denture cleaners, car or carpet shampoos, bathroom cleaners; hair shampoos and hair-rinses; shower gels and foam baths and metal cleaners; as well as cleaning auxiliaries such as bleach additives and "stain-stick" or pre-treat types.

Preferably, the adjunct ingredients should have good stability with the bleaches employed herein. Certain preferred detergent compositions herein should be boron-free and phosphate-free. Preferred dishcare formulations can include chlorine-free and chlorine-bleach containing types. Typical levels of adjuncts are from about 30% to about 99.9%, preferably from about 70% to about 95%, by weight of the compositions.

Common adjuncts include builders, surfactants, enzymes, polymers, bleaches, bleach activators, catalytic materials and the like excluding any materials already defined hereinabove as part of the essential component of the inventive compositions. Other adjuncts herein can include diverse active ingredients or specialized materials such as dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, perfumes, solubilizing agents, carriers, processing aids, pigments, and, for liquid formulations, solvents, as described in detail hereinafter.

Quite typically, laundry or cleaning compositions herein such as laundry detergents, laundry detergent additives, hard surface cleaners, automatic dishwashing detergents, synthetic and soap-based laundry bars, fabric softeners and fabric treatment liquids, solids and treatment articles of all kinds will require several adjuncts, though certain simply formulated products, such as bleach additives, may require only metal catalyst and a single supporting material such as a detergent builder or surfactant which helps to make the potent catalyst available to the consumer in a manageable dose.

Detersive surfactants—The instant compositions desirably include a detersive surfactant. Detersive surfactants are extensively illustrated in U.S. Pat. No. 3,929,678, Dec. 30, 1975 Laughlin, et al, and U.S. Pat. No. 4,259,217, Mar. 31, 1981, Murphy; in the series "Surfactant Science", Marcel Dekker, Inc., New York and Basel; in "Handbook of Surfactants", M. R. Porter, Chapman and Hall, 2nd Ed., 1994; in "Surfactants in Consumer Products", Ed. J. Falbe, Springer-Verlag, 1987; and in numerous detergent-related patents assigned to Procter & Gamble and other detergent and consumer product manufacturers.

The detersive surfactant herein is generally an at least partially water-soluble surface-active material which forms micelles and has a cleaning function, in particular, assisting removal of grease from fabrics and/or suspending soil removed therefrom in a laundry operation, although certain detersive surfactants are useful for more specialized purposes, such as co-surfactants to assist the primary cleaning action of another surfactant component, as wetting or hydrotroping agents, as viscosity controllers, as clear rinse or "sheeting" agents, as coating agents, as builders, as fabric softeners, or as suds suppressors.

The detersive surfactant herein comprises at least one amphiphilic compound, that is, a compound having a hydrophobic tail and a hydrophilic head, which produces foam in water. Foam testing is known from the literature and generally includes a test of shaking or mechanically agitating a solution or dispersion of the detersive surfactant in distilled water under concentration, temperature and shear conditions designed to model those encountered in fabric laundering. Such conditions include concentrations in the range from about $10^{-6}$ Molar to about $10^{-1}$ Molar and temperatures in the range from about 5 deg. C.–90 deg. C. Foam testing apparatus is described in the hereinabove identified patents and Surfactant Science Series volumes. See, for example, Vol. 45.

The detersive surfactant herein therefore includes anionic, nonionic, zwitterionic or amphoteric types of surfactant known for use as cleaning agents in textile laundering, but does not include completely foam-free or completely insoluble surfactants (though these may be used as optional adjuncts). Examples of the type of surfactant considered optional for the present purposes are relatively uncommon as compared with cleaning surfactants but include, for example, the common fabric softener materials such as dioctadecyldimethylammonium chloride.

In more detail, detersive surfactants useful herein, typically at levels from 1% to 55%, by weight, suitably include: (1) the alkylbenzenesulfonates, including linear and branched types; (2) olefin sulfonates, including α-olefin sulfonates and sulfonates derived from fatty acids and fatty esters; (3) alkyl or alkenyl sulfosuccinates, including the diester and half-ester types as well as sulfosuccinamates and other sulfonate/carboxylate surfactant types such as the sulfosuccinates derived from ethoxylated alcohols and alkanolamides; (4) paraffin or alkane sulfonate- and alkyl or alkenyl carboxysulfonate- types including the product of adding bisulfite to alpha olefins; (5) alkylnaphthalenesulfonates; (6) alkyl isethionates and alkoxypropanesulfonates, as well as fatty isethionate esters, fatty esters of ethoxylated isethionate and other ester sulfonates such as the ester of 3-hydroxypropanesulfonate or AVANEL S types; (7) benzene, cumene, toluene, xylene, and naphthalene sulfonates, useful especially for their hydrotroping properties; (8) alkyl ether sulfonates; (9) alkyl amide sulfonates; (10) α-sulfo fatty acid salts or esters and internal sulfo fatty acid esters; (11) alkylglycerylsulfonates; (12) ligninsulfonates; (13) petroleum sulfonates, sometimes known as heavy alkylate sulfonates; (14) diphenyl oxide disulfonates; (15) alkylsulfates or alkenyl sulfates; (16) alkyl or alkylphenol alkoxylate sulfates and the corresponding polyalkoxylates, sometimes known as alkyl ether sulfates, as well as the alkenylalkoxysulfates or alkenylpolyalkoxy sulfates; (17) alkyl amide sulfates or alkenyl amide sulfates, including sulfated alkanolamides and their alkoxylates and polyalkoxylates; (18) sulfated oils, sulfated alkylglycerides, sulfated alkylpolyglycosides or sulfated sugar-derived surfactants; (19) alkyl alkoxycarboxylates and alkylpolyalkoxycarboxylates, including galacturonic acid salts; (20) alkyl ester carboxylates and alkenyl ester carboxylates; (21) alkyl or alkenyl carboxylates, especially conventional soaps and (α,ω- dicarboxylates, including also the alkyl- and alkenylsuccinates; (22) alkyl or alkenyl amide alkoxy- and polyalkoxy-carboxylates; (23) alkyl and alkenyl amidocarboxylate surfactant types, including the sarcosinates, taurides, glycinates, aminopropionates and iminopropionates; (24) amide soaps, sometimes referred to as fatty acid cyanamides; (25) alkylpolyaminocarboxylates; (26) phosphorus-based surfactants, including alkyl or alkenyl phosphate esters, alkyl ether phosphates including their alkoxylated derivatives, phopshatidic acid salts, alkyl phosphonic acid salts, alkyl di(polyoxyalkylene alkanol) phosphates, amphoteric phosphates such as lecithins; and phosphate/carboxylate, phosphate/sulfate and phosphate/sulfonate types; (27) Pluronic- and Tetronic-type nonionic surfactants; (28) the so-called EO/PO Block polymers, including the diblock and triblock EPE and PEP types; (29) fatty acid polyglycol esters; (30) capped and non-capped alkyl or alkylphenol ethoxylates, propoxylates and butoxylates including fatty alcohol polyethyleneglycol ethers; (31) fatty alcohols, especially where useful as viscosity-modifying surfactants or present as unreacted components of other surfactants; (32) N-alkyl polyhydroxy fatty acid amides, especially the alkyl N- alkylglucamides; (33) nonionic surfactants derived from mono- or polysaccharides or sorbitan, especially the alkylpolyglycosides, as well as sucrose fatty acid esters; (34) ethylene glycol-, propylene glycol-, glycerol- and polyglyceryl- esters and their alkoxylates, especially glycerol ethers and the fatty acid/glycerol monoesters and diesters; (35) aldobionamide surfactants; (36) alkyl succinimide nonionic surfactant types; (37) acetylenic alcohol surfactants, such as the SURFYNOLS; (38) alkanolamide surfactants and their alkoxylated derivatives including fatty acid alkanolamides and fatty acid alkanolamide polyglycol ethers; (39) alkylpyrrolidones; (40) alkyl amine oxides, including alkoxylated or polyalkoxylated amine oxides and amine oxides derived from sugars; (41) alkyl phosphine oxides; (42) sulfoxide surfactants; (43) amphoteric sulfonates, especially sulfobetaines; (44) betaine-type amphoterics, including aminocarboxylate-derived types; (45) amphoteric sulfates such as the alkyl ammonio polyethoxysulfates; (46) fatty and petroleum-derived alkylamines and amine salts; (47) alkylimidazolines; (48) alkylamidoamines and their alkoxylate and polyalkoxylate derivatives; and (49) conventional cationic surfactants, including water-soluble alkyltrimethylammonium salts. Moreover, more unusual surfactant types are included, such as: (50) alkylamidoamine oxides, carboxylates and quaternary salts; (51) sugar-derived surfactants modeled after any of the hereinabove-referenced more conventional nonsugar types; (52) fluorosurfactants; (53) biosurfactants; (54) organosilicon surfactants; (55) gemini surfactants, other than the above-referenced diphenyl oxide disulfonates, including those derived from glucose; (56) polymeric surfactants including amphopolycarboxyglycinates; and (57) bolaform surfactants.

In any of the above detersive surfactants, hydrophobe chain length is typically in the general range $C_8$–$C_{20}$, with chain lengths in the range $C_8$–$C_{16}$ often being preferred, especially when laundering is to be conducted in cool water. Selection of chainlengths and degree of alkoxylation for conventional purposes are taught in the standard texts. When the detersive surfactant is a salt, any compatible cation may be present, including H (that is, the acid or partly acid form of a potentially acidic surfactant may be used), Na, K, Mg, ammonium or alkanolammonium, or combinations of cations. Mixtures of detersive surfactants having different charges are commonly preferred, especially anionic/nonionic, anionic/nonionic/cationic, anionic/nonionic/amphoteric, nonionic/cationic and nonionic/amphoteric mixtures. Moreover, any single detersive surfactant may be substituted, often with desirable results for cool water washing, by mixtures of otherwise similar detersive surfactants having differing chainlengths, degree of unsaturation or branching, degree of alkoxylation (especially ethoxylation), insertion of substituents such as ether oxygen atoms in the hydrophobes, or any combinations thereof.

Preferred among the above-identified detersive surfactants are: acid, sodium and ammonium $C_9$–$C_{20}$ alkylbenzenesulfonates, particularly sodium linear secondary alkyl $C_{10}$–$C_{15}$ benzenesulfonates (1), including straight-chain and branched forms; olefinsulfonate salts, (2), that is, material made by reacting olefins, particularly $C_{10}$–$C_{20}$ α-olefins, with sulfur trioxide and then neutralizing and hydrolyzing the reaction product; sodium and ammonium $C_7$–$C_{12}$ dialkyl sulfosuccinates, (3); alkane monosulfonates, (4), such as those derived by reacting $C_8$–$C_{20}$ α-olefins with sodium bisulfite and those derived by reacting paraffins with $SO_2$ and $Cl_2$ and then hydrolyzing with a base to form a random sulfonate; α-Sulfo fatty acid salts or esters, (10); sodium alkylglycerylsulfonates, (11), especially those ethers of the higher alcohols derived from tallow or coconut oil and synthetic alcohols derived from petroleum; alkyl or alkenyl sulfates, (15). which may be primary or secondary, saturated or unsaturated, branched or unbranched. Such compounds when branched can be random or regular. When secondary, they preferably have formula $CH_3(CH_2)_x(CHOSO_3^-M^+)CH_3$ or $CH_3(CH_2)_y(CHOSO_3^-M^+)CH_2CH_3$ where x and (y+1) are integers of at least 7, preferably at least 9 and M is a water-soluble cation, preferably sodium. When unsaturated, sulfates such as oleyl sulfate are preferred, while the sodium and ammonium alkyl sulfates, especially those produced by sulfating $C_8$–$C_{18}$ alcohols, produced for example from tallow or coconut oil are also useful; also preferred are the alkyl or alkenyl ether sulfates, (16), especially the ethoxy sulphates having about 0.5 moles or higher of ethoxylation, preferably from 0.5–8; the alkylethercarboxylates, (19), especially the EO 1–5 ethoxycarboxylates; soaps or fatty acids (21), preferably the more water-soluble types; aminoacid-type surfactants, (23), such as sarcosinates, especially oleyl sarcosinate; phosphate esters, (26); alkyl or alkylphenol ethoxylates, propoxylates and butoxylates, (30), especially the ethoxylates "AE", including the so-called narrow peaked alkyl ethoxylates and $C_6$–$C_{12}$ alkyl phenol alkoxylates as well as the products of aliphatic primary or secondary linear or branched $C_8$–$C_{18}$ alcohols with ethylene oxide, generally 2–30 EO; N-alkyl polyhydroxy fatty acid amides especially the $C_{12}$–$C_{18}$ N-methylglucamides, (32), see WO 9206154, and N-alkoxy polyhydroxy fatty acid amides, such as $C_{10}$–$C_{18}$ N-(3-methoxypropyl) glucamide while N-propyl through N-hexyl $C_{12}$–$C_{18}$ glucamides can be used for low sudsing; alkyl polyglycosides, (33); amine oxides, (40), preferably alkyldimethylamine N- oxides and their dihydrates; sulfobetaines or "sultaines", (43); betaines (44); and gemini surfactants.

Suitable levels of anionic detersive surfactants herein are in the range from about 3% to about 30% or higher, preferably from about 8% to about 20%, more preferably still, from about 9% to about 18% by weight of the detergent composition.

Suitable levels of nonionic detersive surfactant herein are from about 1% to about 20%, preferably from about 3% to about 18%, more preferably from about 5% to about 15%.

Desirable weight ratios of anionic: nonionic surfactants in combination include from 1.0:9.0 to 1.0:0.25, preferably 1.0:1.5 to 1.0:0.4.

Suitable levels of cationic detersive surfactant herein are from about 0.1% to about 10%, preferably from about 1% to about 3.5%, although much higher levels, e.g., up to about 20% or more, may be useful especially in nonionic: cationic (i.e., limited or anionic-free) formulations.

Amphoteric or zwitterionic detersive surfactants when present are usually useful at levels in the range from about 0.1% to about 20% by weight of the detergent composition. Often levels will be limited to about 5% or less, especially when the amphoteric is costly.

Enzymes—Enzymes are preferably included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents, such as in automatic dishwashing, it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble . When desired, a protease having decreased adsorption and increased hydrolysis is available as described in WO 9507791 to Procter & Gamble. A recombinant trypsin-like protease for detergents suitable herein is described in WO 9425583 to Novo.

In more detail, an especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein, especially for, but not limited to automatic dishwashing purposes, include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;* (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Other amylase enzymes include those described in WO 95/26397 and in co-pending application by Novo Nordisk PCT/DK96/00056. Specific amylase enzymes for use in the detergent compositions of the present invention include α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. (Such Phadebas® α-amylase activity assay is described at pages 9–10, WO 95/26397.) Also included herein are α-amylases which are at least 80% homologous with the amino acid sequences shown in the SEQ ID listings in the references. These enzymes are preferably incorporated into laundry detergent compositions at a level from 0.00018% to 0.060% pure enzyme by weight of the total composition, more preferably from 0.00024% to 0.048% pure enzyme by weight of the total composition.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

In spite of the large number of publications on lipase enzymes, only the lipase derived from *Humicola lanuginosa* and produced in *Aspergillus oryzae* as host has so far found widespread application as additive for fabric washing products. It is available from Novo Nordisk under the tradename Lipolase™, as noted above. In order to optimize the stain removal performance of Lipolase, Novo Nordisk have made a number of variants. As described in WO 92/05249, the D96L variant of the native *Humicola lanuginosa* lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100-mg (5–500, 000 LU/liter) lipase variant per liter of wash liquor. The present invention provides the benefit of improved whiteness maintenance on fabrics using low levels of D96L variant in detergent compositions containing the mid-chain branched surfactant surfactants in the manner disclosed herein, especially when the D96L is used at levels in the range of about 50 LU to about 8500 LU per liter of wash solution.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

Enzyme Stabilizing System—The enzyme-containing compositions herein may optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful, for example for promoting the grease-cutting action of certain types of surfactant.

Another stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions, for example automatic dishwashing compositions, may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during dish- or fabric-washing, can be relatively large; accordingly, enzyme stability to chlorine in-use is sometimes problematic. Since perborate or percarbonate, which have the ability to react with chlorine bleach, may present in certain of the instant compositions in amounts accounted for separately from the stabilizing system, the use of additional stabilizers against chlorine, may, most generally, not be essential, though improved results may be obtainable from their use. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by ingredients separately listed under better recognized functions, (e.g., hydrogen peroxide sources), there is no absolute requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392.

Builders—Detergent builders selected from aluminosilicates and silicates are preferably included in the compositions herein, for example to assist in controlling mineral, especially Ca and/or Mg, hardness in wash water or to assist in the removal of particulate soils from surfaces. Alternately, certain compositions can be formulated with completely water-soluble builders, whether organic or inorganic, depending on the intended use.

Suitable silicate builders include water-soluble and hydrous solid types and including those having chain-, layer-, or three-dimensional- structure as well as amorphous-solid silcates or other types, for example especially adapted for use in non-structured-liquid detergents. Preferred are alkali metal silicates, particularly those liquids and solids having a $SiO_2$:$Na_2O$ ratio in the range 1.6:1 to 3.2:1, including, particularly for automatic dishwashing purposes, solid hydrous 2-ratio silicates marketed by PQ Corp. under the tradename BRITESIL®, e.g., BRITESIL H2O; and layered silicates, e.g., those described in U.S. Pat. No. 4,664,839, May 12, 1987, H. P. Rieck. NaSKS-6, sometimes abbreviated "SKS-6", is a crystalline layered aluminum-free $\delta$-$Na_2SiO_5$ morphology silicate marketed by Hoechst and is preferred especially in granular laundry compositions. See preparative methods in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the $\alpha$, $\beta$ and $\gamma$ layer-silicate forms. Other silicates may also be useful, such as magnesium silicate, which can serve as a crispening agent in granules, as a stabilizing agent for bleaches, and as a component of suds control systems.

Also suitable for use herein are synthesized crystalline ion exchange materials or hydrates thereof having chain structure and a composition represented by the following general formula in an anhydride form: $xM_2O\ ySiO_2.zM'O$ wherein M is Na and/or K, M' is Ca and/or Mg; y/x is 0.5 to 2.0 and z/x is 0.005 to 1.0 as taught in U.S. Pat. No. 5,427,711, Sakaguchi et al, Jun. 27, 1995.

Aluminosilicate builders are especially useful in granular detergents, but can also be incorporated in liquids, pastes or gels. Suitable for the present purposes are those having empirical formula: $[M_Z(AlO_2)_Z(SiO_2)_v]\ xH_2O$ wherein z and v are integers of at least 6, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al, Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used. Zeolite A has the formula: $Na_{12}[(AlO_2)_{12}(SiO_2)_{12}].xH_2O$ wherein x is from 20 to 30, especially 27. Dehydrated zeolites (x=0–10) may also be used. Preferably, the aluminosilicate has a particle size of 0.1–10 microns in diameter.

Detergent builders in place of or in addition to the silicates and aluminosilicates described hereinbefore can optionally be included in the compositions herein, for example to assist in controlling mineral, especially Ca and/or Mg, hardness in wash water or to assist in the removal of particulate soils from surfaces. Builders can operate via a variety of mechanisms including forming soluble or insoluble complexes with hardness ions, by ion exchange, and by offering a surface more favorable to the precipitation of hardness ions than are the surfaces of articles to be cleaned. Builder level can vary widely depending upon end use and physical form of the composition. Built detergents typically comprise at least about 1% builder. Liquid formulations typically comprise about 5% to about 50%, more typically 5% to 35% of builder. Granular formulations typically comprise from about 10% to about 80%, more typically 15% to 50% builder by weight of the detergent composition. Lower or higher levels of builders are not excluded. For example, certain detergent additive or high-surfactant formulations can be unbuilt.

Suitable builders herein can be selected from the group consisting of phosphates and polyphosphates, especially the sodium salts; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions.

Builder mixtures, sometimes termed "builder systems" can be used and typically comprise two or more conventional builders, optionally complemented by chelants, pH-buffers or fillers, though these latter materials are generally accounted for separately when describing quantities of materials herein. In terms of relative quantities of surfactant and builder in the present detergents, preferred builder systems are typically formulated at a weight ratio of surfactant to builder of from about 60:1 to about 1:80. Certain preferred laundry detergents have said ratio in the range 0.90:1.0 to 4.0: 1.0, more preferably from 0.95:1.0 to 3.0:1.0.

P-containing detergent builders often preferred where permitted by legislation include, but are not limited to, the alkali metal, ammonium and alkanolammonium salts of polyphosphates exemplified by the tripolyphosphates, pyrophosphates, glassy polymeric meta-phosphates; and phosphonates.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona or any convenient multiple salts of sodium carbonate and calcium carbonate such as those having the composition $2Na_2CO_3.CaCO_3$ when anhydrous, and even calcium carbonates including calcite, aragonite and vaterite, especially forms having high surface areas relative to compact calcite may be useful, for example as seeds or for use in synthetic detergent bars.

Suitable organic detergent builders include polycarboxylate compounds, including water-soluble nonsurfactant dicarboxylates and tricarboxylates. More typically builder polycarboxylates have a plurality of carboxylate groups, preferably at least 3 carboxylates. Carboxylate builders can be formulated in acid, partially neutral, neutral or overbased form. When in salt form, alkali metals, such as sodium, potassium, and lithium, or alkanolammonium salts are preferred. Polycarboxylate builders include the ether polycarboxylates, such as oxydisuccinate, see Berg, U.S. Pat. No. 3,128,287, Apr. 7, 1964, and Lamberti et al, U.S. Pat. No. 3,635,830, Jan. 18, 1972; "TMS/TDS" builders of U.S. Pat. No. 4,663,071, Bush et al, May 5, 1987; and other ether carboxylates including cyclic and alicyclic compounds, such as those described in U.S. Pat. Nos. 3,923,679; 3,835,163; 4,158,635; 4,120,874 and 4,102,903.

Other suitable builders are the ether hydroxypolycarboxylates, copolymers of maleic anhydride with ethylene or vinyl methyl ether; 1,3,5-trihydroxy benzene-2, 4, 6-trisulphonic acid; carboxymethyloxysuccinic acid; the various alkali metal, ammonium and substituted ammonium salts of polyacetic acids such as ethylenediamine tetraacetic acid and nitrilotriacetic acid; as well as mellitic acid, succinic acid, polymaleic acid, benzene 1,3,5-tricarboxylic acid, carboxymethyloxysuccinic acid, and soluble salts thereof.

Citrates, e.g., citric acid and soluble salts thereof are important carboxylate builders e.g., for heavy duty liquid detergents, due to availability from renewable resources and biodegradability. Citrates can also be used in granular compositions, especially in combination with zeolite and/or layered silicates. Oxydisuccinates are also especially useful in such compositions and combinations.

Where permitted, and especially in the formulation of bars used for hand-laundering operations, alkali metal phosphates such as sodium tripolyphosphates, sodium pyrophosphate and sodium orthophosphate can be used. Phosphonate builders such as ethane-1-hydroxy-1,1-diphosphonate and other known phosphonates, e.g., those of U.S. Pat. Nos. 3,159,581; 3,213,030; 3,422,021; 3,400,148 and 3,422,137 can also be used and may have desirable antiscaling properties.

Certain detersive surfactants or their short-chain homologues also have a builder action. For unambiguous formula accounting purposes, when they have surfactant capability, these materials are summed up as detersive surfactants. Preferred types for builder functionality are illustrated by: 3,3-dicarboxy-4-oxa-1,6-hexanedioates and the related compounds disclosed in U.S. Pat. No. 4,566,984, Bush, Jan. 28, 1986. Succinic acid builders include the $C_5$-$C_{20}$ alkyl and alkenyl succinic acids and salts thereof. Succinate builders also include: laurylsuccinate, myristylsuccinate, palmitylsuccinate, 2-dodecenylsuccinate (preferred), 2-pentadecenylsuccinate, and the like. Lauryl-succinates are described in European Patent Application 86200690.5/0, 200,263, published Nov. 5, 1986. Fatty acids, e.g., $C_{12}$–$C_{18}$ monocarboxylic acids, can also be incorporated into the compositions as surfactant/builder materials alone or in combination with the aforementioned builders, especially citrate and/or the succinate builders, to provide additional builder activity. Other suitable polycarboxylates are disclosed in U.S. Pat. No. 4,144,226, Crutchfield et al, Mar. 13, 1979 and in U.S. 3,308,067, Diehl, Mar. 7, 1967. See also Diehl, U.S. Pat. No. 3,723,322.

Other types of inorganic builder materials which can be used have the formula $(M_X)_iCa_y(CO_3)_z$ wherein x and i are integers from 1 to 15, y is an integer from 1 to 10, z is an integer from 2 to 25, $M_i$ are cations, at least one of which is a water-soluble, and the equation $\epsilon_{i=1-15}(x_i$ multiplied by the valence of $M_i)+2y=2z$ is satisfied such that the formula has a neutral or "balanced" charge. These builders are referred to herein as "Mineral Builders". Waters of hydration or anions other than carbonate may be added provided that the overall charge is balanced or neutral. The charge or valence effects of such anions should be added to the right side of the above equation. Preferably, there is present a water-soluble cation selected from the group consisting of hydrogen, water-soluble metals, hydrogen, boron, ammonium, silicon, and mixtures thereof, more preferably, sodium, potassium, hydrogen, lithium, ammonium and mixtures thereof, sodium and potassium being highly preferred. Nonlimiting examples of noncarbonate anions include those selected from the group consisting of chloride, sulfate, fluoride, oxygen, hydroxide, silicon dioxide, chromate, nitrate, borate and mixtures thereof. Preferred builders of this type in their simplest forms are selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof. An especially preferred material for the builder described herein is $Na_2Ca(CO_3)_2$ in any of its crystalline modifications. Suitable builders of the above-defined type are further illustrated by, and include, the natural or synthetic forms of any one or combinations of the following minerals: Afghanite, Andersonite, Ashcroftine Y, Beyerite, Borcarite, Burbankite, Butschliite, Cancrinite, Carbocernaite, Carletonite, Davyne, Donnayite Y, Fairchildite, Ferrisurite, Franzinite, Gaudefroyite, Gaylussite, Girvasite, Gregoryite, Jouravskite, Kamphaugite Y, Kettnerite, Khanneshite, Lepersonnite Gd, Liottite, Mickelveyite Y, Microsommite, Mroseite, Natrofairchildite, Nyerereite, Remondite Ce, Sacrofanite, Schrockingerite, Shortite, Surite, Tunisite, Tuscanite, Tyrolite, Vishnevite, and Zernkorite. Preferred mineral forms include Nyererite, Fairchildite and Shortite.

Many detergent compositions herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

Certain preferred compositions herein, such as some ADD types, comprise a pH-adjusting component selected from water-soluble alkaline inorganic salts and water-soluble organic or inorganic builders. The pH-adjusting components are selected so that when the ADD is dissolved in water at a concentration of 1,000–5,000 ppm, the pH remains in the range of above about 8, preferably from about 9.5 to about 11. The preferred nonphosphate pH-adjusting component can be selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantities of sodium metasilicate;

(iii) sodium citrate;

(iv) citric acid;

(v) sodium bicarbonate;

(vi) sodium borate, preferably borax;

(vii) sodium hydroxide; and (viii) mixtures of (i)–(vii).

Preferred embodiments contain low levels of silicate (i.e. from about 3% to about 10% $SiO_2$).

Illustrative of highly preferred pH-adjusting component systems of this specialized type are binary mixtures of granular sodium citrate with anhydrous sodium carbonate, and three-component mixtures of granular sodium citrate trihydrate, citric acid monohydrate and anhydrous sodium carbonate.

The amount of the pH adjusting component in compositions used for automatic dishwashing is preferably from about 1% to about 50%, by weight of the composition. In a preferred embodiment, the pH-adjusting component is present in the composition in an amount from about 5% to about 40%, preferably from about 10% to about 30%, by weight.

For compositions herein having a pH between about 9.5 and about 11 of the initial wash solution, particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other optional detergency builder salts selected from nonphosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid; nitrilotriacetic acid, tartrate monosuccinic acid, tartrate disuccinic acid, oxydisuccinic acid, carboxymethoxysuccinic acid, mellitic acid, and sodium benzene polycarboxylate salts.

Automatic dishwashing detergent compositions may further comprise water-soluble silicates. Water-soluble silicates herein are any silicates which are soluble to the extent that they do not adversely affect spotting/filming characteristics of the ADD composition.

Examples of silicates are sodium metasilicate and, more generally, the alkali metal silicates, particularly those having a $SiO_2$:$Na_2O$ ratio in the range 1.6:1 to 3.2:1; and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, Na SKS-6 and other water-soluble silicates useful herein do not contain aluminum. NaSKS-6 is the $\delta$-$Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS-11, as the $\alpha$-, $\beta$- and $\gamma$- forms. Other silicates may also be useful, such as for example magnesium silicate, which can serve as a crispening agent in granular formulations, as a stabilizing agent for oxygen bleaches, and as a component of suds control systems.

Silicates particularly useful in automatic dishwashing (ADD) applications include granular hydrous 2-ratio silicates such as BRITESIL® H20 from PQ Corp., and the commonly sourced BRITESIL® H24 though liquid grades of various silicates can be used when the ADD composition has liquid form. Within safe limits, sodium metasilicate or sodium hydroxide alone or in combination with other silicates may be used in an ADD context to boost wash pH to a desired level.

Polymeric Soil Release Agent—Known polymeric soil release agents, hereinafter "SRA" or "SRAA's", can optionally be employed in the present detergent compositions, especially those designed for laundry use. If utilized, SRA's will generally comprise from 0.01% to 10.0%, typically from 0.1% to 5%, preferably from 0.2% to 3.0% by weight, of the composition.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles thereby serving as an anchor for the hydrophilic segments. This can enable stains occurring subsequent to treatment with SRA to be more easily cleaned in later washing procedures.

SRA's can include a variety of charged, e.g., anionic or even cationic (see U.S. Pat. No. 4,956,447), as well as noncharged monomer units and structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without of course forming a densely crosslinked overall structure.

Suitable SRA's include: a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink: such ester oligomers can be prepared by (a) ethoxylating allyl alcohol, (b) reacting the product of (a) with dimethyl terephthalate ("DMT") and 1,2-propylene glycol ("PG") in a two-stage transesterification/oligomerization procedure and (c) reacting the product of (b) with sodium metabisulfite in water; the nonionic end-capped 1,2-propylene/polyoxyethylene terephthalate polyesters of U.S. Pat. No. 4,711,730, Dec. 8, 1987 to Gosselink et al, for example those produced by transesterification/oligomerization of poly(ethyleneglycol) methyl ether, DMT, PG and poly(ethyleneglycol) ("PEG"); the partly- and fully- anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, Me-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al, the latter being typical of SRA's useful in both laundry and fabric conditioning products, an example being an ester composition made from m-sulfobenzoic acid monosodium salt, PG and DMT optionally but preferably further comprising added PEG, e.g., PEG 3400.

SRA's also include simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; and the $C_1$–$C_4$ alkylcelluloses and $C_4$ hydroxyalkyl celluloses; see U.S. Pat. No. 4,000,093, Dec. 28, 1976 to Nicol, et al. Suitable SRA's characterized by poly(vinyl ester) hydrophobe segments include graft copolymers of poly(vinyl ester), e.g., $C_1$–$C_6$ vinyl esters, preferably poly(vinyl acetate), grafted onto polyalkylene oxide backbones. See European Patent Application 0 219 048, published Apr. 22, 1987 by Kud, et al. Commercially available examples include SOKALAN SRA's such as SOKALAN HP-22, available from BASF, Germany. Other SRA's are polyesters with repeat units containing 10–15% by weight of ethylene terephthalate together with 90–80% by weight of polyoxyethylene terephthalate, derived from a polyoxyethylene glycol of average molecular weight 300–5,000. Commercial examples include ZELCON 5126 from duPont and MILEASE T from ICI.

Another preferred SRA is an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EGIPG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two end-cap units derived from sodium 2-(2-hydroxyethoxy)-ethanesulfonate. Said SRA preferably further comprises from 0.5% to 20%, by weight of the oligomer, of a crystallinity-reducing stabilizer, for example an anionic surfactant such as linear sodium dodecylbenzenesulfonate or a member selected from xylene-, cumene-, and toluene-sulfonates or mixtures thereof, these stabilizers or modifiers being introduced into the synthesis pot, all as taught in U.S. Pat. No. 5,415,807, Gosselink, Pan, Kellett and Hall, issued May 16, 1995. Suitable monomers for the above SRA include Na 2-(2-hydroxyethoxy)-ethanesulfonate, DMT, Na- dimethyl 5-sulfoisophthalate, EG and PG.

Yet another group of preferred SRA's are oligomeric esters comprising: (1) a backbone comprising (a) at least one unit selected from the group consisting of dihydroxysulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred of such esters are those of empirical formula:

$$\{(CAP)x(EG/PG)y'(DEG)y''(PEG)y'''(T)z(SIP)z'(SEG)q(B)m\}$$

wherein CAP, EG/PG, PEG, T and SIP are as defined hereinabove, (DEG) represents di(oxyethylene)oxy units; (SEG) represents units derived from the sulfoethyl ether of glycerin and related moiety units; (B) represents branching units which are at least trifunctional whereby ester linkages are formed resulting in a branched oligomer backbone; x is from about 1 to about 12; y' is from about 0.5 to about 25; y" is from 0 to about 12; y''' is from 0 to about 10; y'+y"+y''' totals from about 0.5 to about 25; z is from about 1.5 to about 25; z' is from 0 to about 12; z+z' totals from about 1.5 to about 25; q is from about 0.05 to about 12; m is from about 0.01 to about 10; and x, y', y", y''', z, z', q and m represent the average number of moles of the corresponding units per mole of said ester and said ester has a molecular weight ranging from about 500 to about 5,000.

Preferred SEG and CAP monomers for the above esters include Na-2-(2-,3-dihydroxypropoxy)ethanesulfonate ("SEG"), Na-2-{2-(2-hydroxyethoxy) ethoxy } ethanesulfonate ("SE3") and its homologues and mixtures thereof and the products of ethoxylating and sulfonating allyl alcohol. Preferred SRA esters in this class include the product of transesterifying and oligomerizing sodium 2-{2-(2-hydroxyethoxy)ethoxy}ethanesulfonate and/or sodium 2-[2-{2-(2-hydroxyethoxy)-ethoxy}ethoxy]ethanesulfonate, DMT, sodium 2-(2,3-dihydroxypropoxy) ethane sulfonate, EG, and PG using an appropriate Ti(IV) catalyst and can be designated as (CAP)2(T)5(EG/PG)1.4(SEG)2.5(B)0.13 wherein CAP is ($Na^+$—$O_3S[CH_2CH_2O]3.5$)— and B is a unit from glycerin and the mole ratio EG/PG is about 1.7:1 as measured by conventional gas chromatography after complete hydrolysis.

Additional classes of SRA's include (I) nonionic terephthalates using diisocyanate coupling agents to link up polymeric ester structures, see U.S. Pat. No. 4,201,824, Violland et al. and U.S. Pat. No. 4,240,918 Lagasse et al; (II) SRA's with carboxylate terminal groups made by adding trimellitic anhydride to known SRA's to convert terminal hydroxyl groups to trimellitate esters. With a proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al.; (III) anionic terephthalate-based SRA's of the urethane-linked variety, see U.S. Pat. No. 4,201,824, Violland et al; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,681, Ruppert et al.; (V) graft copolymers, in addition to the SOKALAN types from BASF made, by grafting acrylic monomers on to sulfonated polyesters; these SRA's assertedly have soil release and anti-redeposition activity similar to known cellulose ethers: see EP 279,134 A, 1988, to Rhone-Poulenc Chemie; (VI) grafts of vinyl monomers such as acrylic acid and vinyl acetate on to proteins such as caseins, see EP 457,205 A to BASF (1991); (VII) polyester-polyamide SRA's prepared by condensing adipic acid, caprolactam, and polyethylene glycol, especially for treating polyamide fabrics, see Bevan et al, DE 2,335,044 to Unilever N. V., 1974. Other useful SRA's are described in U.S. Pat. Nos. 4,240,918, 4,787,989, 4,525,524 and 4,877,896.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylated amines; liquid detergent compositions typically contain about 0.01% to about 5%.

A preferred soil release and anti-redeposition agent is ethoxylated tetraethylene pentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. See U.S. Pat. No. 4,891,160, VanderMeer, issued Jan. 2, 1990 and WO 95/32272, published Nov. 30, 1995. Another type of preferred antiredeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release, peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylatelmaleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Other polymer types which may be more desirable for biodegradability, improved bleach stability, or cleaning purposes include various terpolymers and hydrophobically modified copolymers, including those marketed by Rohm & Haas, BASF Corp., Nippon Shokubai and others for all manner of water-treatment, textile treatment, or detergent applications.

Brightener—Any optical brighteners or other brightening or whitening agents known in the art can be incorporated at levels typically from about 0.01% to about 1.2%, by weight, into the detergent compositions herein when they are designed for fabric washing or treatment. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Arctic White CWD, the 2-(4-styryl-phenyl)-2H-naptho[1,2-d] triazoles; 4,4'-bis-(1,2,3-triazol-2-yl)-stilbenes; 4,4'-bis (styryl)bisphenyls; and the aminocoumarins. Specific examples of these brighteners include 4-methyl-7-diethyl-amino coumarin; 1,2-bis(benzimidazol-2-yl)ethylene; 1,3-diphenyl-pyrazolines; 2,5-bis(benzoxazol-2-yl)thiophene; 2-styryl-naptho[1 ,2-d]oxazole; and 2-(stilben-4-yl)-2H-naphtho[1,2-d]triazole. See also U.S. Pat. No. 3,646,015, issued Feb. 29, 1972 to Hamilton.

Dye Transfer Inhibiting Agents—The compositions of the present invention may also include one or more materials effective for inhibiting the iransfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

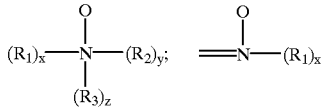

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol. 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2: 1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.0 1% to I% by weight of such optical brighteners.

The hydrophilic optical brighteners useful in the present invention include those having the structural formula:

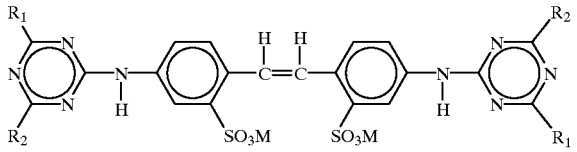

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory the extent to which brighteners deposit on fabrics in the wash solution can be defined by a parameter called the "exhaustion coefficient". The exhaustion coefficient is in general defined as the ratio of a) the brightener material deposited on fabric to b) the initial brightener concentration in the wash liquor. Brighteners with relatively high exhaustion coefficients are the most suitable for inhibiting dye transfer in the context of the present invention.

Other, conventional optical brightener types can optionally be used in the present compositions to provide conventional fabric "brightness" benefits, rather than a dye transfer inhibiting effect. Such usage is conventional and well-known to detergent formulations.

Chelating Agents—The detergent compositions herein may also optionally contain one or chelating agents, particularly chelating agents for adventitious transition metals. Those commonly found in wash water include iron and/or manganese in water-soluble, colloidal or particulate form, and may be associated as oxides or hydroxides, or found in association with soils such as humic substances. Preferred chelants are those which effectively control such transition metals, especially including controlling deposition of such transition-metals or their compounds on fabrics and/or controlling undesired redox reactions in the wash medium and/or at fabric or hard surface interfaces. Such chelating agents include those having low molecular weights as well as polymeric types, typically having at least one, preferably two or more donor heteroatoms such as O or N, capable of co-ordination to a transition-metal, Common chelating agents can be selected from the group consisting of aminocarboxylates, aminophosphonates, polyfunctionally-substituted aromatic chelating agents and mixtures thereof, all as hereinafter defined. Aminocarboxylates useful as optional chelating agents include ethylenediaminetetraacetates, N-hydroxyethylethylenediaminetriacetates, nitrilotriacetates, ethylenediamine tetrapropionates, triethylenetetraaminehexaacetates, diethylenetriaminepentaacetates, and ethanoldiglycines, their alkali metal, ammonium, and substituted ammonium salts, and mixtures thereof.

Aminophosphonates are also suitable for use as chelating agents in the compositions of the invention when at least low levels of total phosphorus are permitted in detergent compositions, and include ethylenediaminetetrakis (methylenephosphonates) such as DEQUEST. Preferably, these amino phosphonates do not contain alkyl or alkenyl groups having more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder useful with, for example, insoluble builders such as zeolites, layered silicates and the like.

If utilized, chelating agents will generally comprise from about 0.001% to about 15% by weight of the detergent compositions herein. More preferably, if utilized, chelating agents will comprise from about 0.01% to about 3.0% by weight of such compositions.

Suds Suppressors—Compounds for reducing or suppressing the formation of suds can be incorporated into the compositions of the present invention when required by the intended use, especially washing of laundry in washing appliances. Other compositions, such as those designed for hand-washing, may desirably be high-sudsing and may omit such ingredients Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors and are well known in the art. See, for example, Kirk Othmer Encyclopedia of Chemical Technology, Third Edition, Volume 7, pages 430–447 (Wiley, 1979). Commonly used are monocarboxylic fatty acids and salts thereof. See U.S. Pat. No. 2,954,347, issued Sep. 27, 1960 to Wayne St. John. These typically have hydrocarbyl chains of 10–24 preferably 12 to 18 carbon atoms. Suitable salts include the alkali metal salts such as sodium, potassium, and lithium salts, and ammonium and alkanolammonium salts.

Other suitable suds suppressors include high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated aminotriazines and monostearyl phosphates such as monostearyl alcohol phosphate ester, monostearyl di-alkali metal (e.g., K, Na, and Li) phosphates or other phosphate esters. The hydrocarbons, such as paraffin and haloparaffin, can be in liquid form, for example being liquids at room temperature and atmospheric pressure, with pour points in the range of about −40° C. to about 50° C., and with minimum normal boiling points not less than about 110° C. It is also known to use waxy hydrocarbons, preferably having a melting point below about 100° C. Hydrocarbon suds suppressors are described, for example, in U.S. Pat. No. 4,265,779. Suitable hydrocarbons include aliphatic, alicyclic, aromatic, and heterocyclic saturated or unsaturated C12–C70 hydrocarbons. Paraffins can be used, including mixtures of true paraffins and cyclic hydrocarbons.

Silicone suds suppressors may be useful, including polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. See U.S. Pat. No. 4,265,779; European Patent Application No. 89307851.9, published Feb. 7, 1990, by Starch, M. S; and U.S. Pat. No. 3,455,839. Mixtures of silicone and silanated silica are described, for instance, in German Patent Application DOS 2,124,526. Silicone defoamers and suds controlling agents in granular detergent compositions are disclosed in U.S. Pat. No. 3,933,672 and in U.S. Pat. No. 4,652,392.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units and $SiO_2$ units at a ratio of f from about 0.6:1 to about 1.2:1; and (iii) from about 1 to about 20 parts per 100 parts by weight of (i) of a solid silica gel.

In a preferred silicone suds suppressor, the solvent for a continuous phase is made up of certain polyethylene glycols or polyethylene-polypropylene glycol copolymers or mixtures thereof (preferred), or polypropylene glycol. The primary silicone suds suppressor is branched/crosslinked. Typical liquid laundry detergent compositions with controlled suds may comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average moiecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol : copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. No. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol + silicone at a weight ratio of 1:5 to 5:1.

For any detergent compositions to be used in automatic laundry washing, suds should not form to the extent that they overflow the washing machine. Suds suppressors, when utilized, are preferably in a "suds suppressing amount. By "suds suppressing amount" is meant that the formulator can select an amount of suds controlling agent that will sufficiently control the suds to result in a low-sudsing laundry detergent for use in automatic laundry washing machines.

The compositions herein will generally comprise from 0% to about 10% of suds suppressor. When utilized as suds suppressors, monocarboxylic fatty acids, and salts thereof, will be present typically in amounts up to about 5%, preferably 0.5%–3% by weight, of the detergent composition. although higher amounts may be used. Preferably from about 0.01% to about 1% of silicone suds suppressor is used, more preferably from about 0.25% to about 0.5%. These weight percentage values include any silica that may be utilized in combination with polyorganosiloxane, as well as any suds suppressor adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Suds suppressor systems are also useful in automatic dishwashing (ADD) embodiments of the invention. Silicone suds suppressor technology and other defoaming agents useful for all purposes herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors for ADD application include the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Coming Corp. If it is desired to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof. It has been found preferable to avoid the use of simple calcium-precipitating soaps as antifoams in ADD compositions as they tend to deposit on the dishware. Indeed, phosphate esters are not entirely free of such problems and the formulator will generally choose to minimize the content of potentially depositing antifoams in ADD use.

Alkoxylated Polycarboxylates—Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7–8 acrylate units. The side-chains are of the formula $—(CH_2CH_2O)_m(CH_2)_nCH_3$ wherein m is 2–3 and n is 6–12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Fabric Softeners—Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981. Moreover, in laundry cleaning methods herein, known fabric softeners, including biodegradable types, can be used in pretreat, mainwash, post-wash and dryer-added modes.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes typically comprise from about 0.01% to about 2%, by weight, of the detergent compositions herein, and individual perfumery ingredients can comprise from about 0.0001% to about 90 % of a finished perfume composition.

Non-limiting examples of perfume ingredients useful herein include: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenyl-butanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl octanal; 10-undecen-1-al; iso-hexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin; heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; beta-naphthol methyl ether; ambroxane; dodecahydro-3a,6,6,9a-tetramethyl-naphtho[2,1b]furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Particularly preferred perfume materials are those that provide the largest odor improvements in finished product compositions containing cellulases. These perfumes include but are not limited to: hexyl cinnamic aldehyde; 2-methyl-3-(para-tert-butylphenyl)-propionaldehyde; 7-acetyl-1,2,3,4,5,6,7,8-octahydro-1,1,6,7-tetramethyl naphthalene; benzyl salicylate; 7-acetyl-1,1,3,4,4,6-hexamethyl tetralin; para-tert-butyl cyclohexyl acetate; methyl dihydro jasmonate; beta-napthol methyl ether; methyl beta-naphthyl ketone; 2-methyl-2-(para-iso-propylphenyl)-propionaldehyde; 1,3,4,6,7,8-hexahydro-4,6,6,7,8,8-hexamethyl-cyclopenta-gamma-2-benzopyrane; dodecahydro-3a,6,6,9a-tetramethylnaphtho[2,1b]furan; anisaldehyde; coumarin; cedrol; vanillin; cyclopentadecanolide; tricyclodecenyl acetate; and tricyclodecenyl propionate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin. Still other perfume chemicals include phenyl ethyl alcohol, terpineol, linalool, linalyl acetate, geraniol, nerol, 2-(1,1-dimethylethyl)-cyclohexanol acetate, benzyl acetate, and eugenol. Carriers such as diethylphthalate can be used in the finished perfume compositions.

Material Care Agents—The present compositions, when designed for automatic dishwashing, may contain one or more material care agents which are effective as corrosion inhibitors and/or anti-tarnish aids. Such materials are preferred components of machine dishwashing compositions especially in certain European countries where the use of electroplated nickel silver and sterling silver is still comparatively common in domestic flatware, or when aluminum protection is a concern and the composition is low in silicate. Generally, such material care agents include metasilicate, silicate, bismuth salts, manganese salts, paraffin, triazoles, pyrazoles, thiols, mercaptans, aluminum fatty acid salts, and mixtures thereof.

When present, such protecting materials are preferably incorporated at low levels, e.g., from about 0.01% to about 5% of the ADD composition. Suitable corrosion inhibitors include paraffin oil, typically a predominantly branched aliphatic hydrocarbon having a number of carbon atoms in the range of from about 20 to about 50; preferred paraffin oil is selected from predominantly branched $C_{25-45}$ species with a ratio of cyclic to noncyclic hydrocarbons of about 32:68. A paraffin oil meeting those characteristics is sold by Wintershall, Salzbergen, Germany, under the trade name WINOG 70. Additionally, the addition of low levels of bismuth nitrate (i.e., $Bi(NO_3)_3$) is also preferred.

Other corrosion inhibitor compounds include benzotriazole and comparable compounds; mercaptans or thiols including thionaphthol and thioanthranol; and finely divided Aluminum fatty acid salts, such as aluminum tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

Other Ingredients—A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, water-soluble magnesium and/or calcium salts such as $MgCl_2$, $MgSO_4$, $CaCl_2$, $CaSO_4$ and the like, can be added at levels of, typically, 0.1%–2%, to provide additional suds and to enhance grease removal performance, especially for liquid dishwashing purposes.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, Degussa) is admixed with a proteolytic enzyme solution containing 3%–5% of $C_{13-15}$ ethoxylated alcohol (EO 7) nonionic surfactant. Typically, the enzyme/surfactant solution is 2.5 X the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, transition-metal bleach catalysts, organic bleach catalysts, photoactivators, dyes, fluorescers, fabric conditioners, hydrolyzable surfactants and mixtures thereof can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.0 and 10.5, more preferably between about 7.0 to about 9.5. Liquid dishwashing product formulations preferably have a pH between about 6.8 and about 9.0. Laundry products are typically at pH 9–11. Techniques for controlling pH at recommended usage levels include the use of buffers, alkalis, acids, etc., and are well known to those skilled in the art.

Form of the compositions

The compositions in accordance with the invention can take a variety of physical forms including granular, tablet, bar and liquid forms. The compositions include the so-called concentrated granular detergent compositions adapted to be added to a washing machine by means of a dispensing device placed in the machine drum with the soiled fabric load.

The mean particle size of the components of granular compositions in accordance with the invention should preferably be such that no more that 5% of particles are greater than 1.7 mm in diameter and not more than 5% of particles are less than 0.15 mm in diameter.

The term mean particle size as defined herein is calculated by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

Certain preferred granular detergent compositions in accordance with the present invention are the high-density types, now common in the marketplace; these typically have a bulk density of at least 600 g/liter, more preferably from 650 g/liter to 1200 g/liter.

Surfactant agglomerate particles

One of the preferred methods of delivering surfactant in consumer products is to make surfactant agglomerate particles, which may take the form of flakes, prills, marumes, noodles, ribbons, but preferably take the form of granules. A preferred way to process the particles is by agglomerating powders (e.g. aluminosilicate, carbonate) with high active surfactant pastes and to control the particle size of the resultant agglomerates within specified limits. Such a process involves mixing an effective amount of powder with a high active surfactant paste in one or more agglomerators such as a pan agglomerator, a Z-blade mixer or more preferably an in-line mixer such as those manufactured by Schugi (Holland) BV, 29 Chroomstraat 8211 AS, Lelystad, Netherlands, and Gebruder Lödige Maschinenbau GmbH, D-4790 Paderborn 1, Elsenerstrasse 7-9, Postfach 2050, Germany. Most preferably a high shear mixer is used, such as a Lödige CB (Trade Name).

A high active surfactant paste comprising from 50% by weight to 95% by weight, preferably 70% by weight to 85% by weight of surfactant is typically used. The paste may be pumped into the agglomerator at a temperature high enough to maintain a pumpable viscosity, but low enough to avoid degradation of the anionic surfactants used. An operating temperature of the paste of 50° C. to 80° C. is typical.

Laundry washing method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is here meant from 40 g to 300 g of product dissolved or dispersed in a wash solution of volume from 5 to 65 litres, as are typical product dosages and wash solution volumes commonly employed in conventional machine laundry methods.

As noted, surfactants are used herein in detergent compositions, preferably in combination with other detersive surfactants, at levels which are effective for achieving at least a directional improvement in cleaning performance. In the context of a fabric laundry composition, such "usage levels" can vary widely, depending not only on the type and severity of the soils and stains, but also on the wash water temperature, the volume of wash water and the type of washing machine. For example, in a top-loading, vertical axis U.S.-type automatic washing machine using about 45 to 83 liters of water in the wash bath, a wash cycle of about 10 to about 14 minutes and a wash water temperature of about 10° C. to about 50° C., it is preferred to include from about 2 ppm to about 625 ppm, preferably from about 2 ppm to about 550 ppm, more preferably from about 10 ppm to about 235 ppm, of the surfactant in the wash liquor. On the basis of usage rates of from about 50 ml to about 150 ml per wash load, this translates into an in-product concentration (wt.) of the surfactant of from about 0.1% to about 40%, preferably about 0.1% to about 35%, more preferably from about 0.5% to about 15%, for a heavy-duty liquid laundry detergent. On the basis of usage rates of from about 30 g to about 950 g per wash load, for dense ("compact") granular laundry detergents (density above about 650 g/l) this translates into an in-product concentration (wt.) of the surfactant of from about 0.1% to about 50%, preferably from about 0.1% to about 35%, and more preferably from about 0.5% to about 15%. On the basis of usage rates of from about 80 g to about 100 g per load for spray-dried granules (i.e., "fluffy"; density below about 650 g/l), this translates into an in-product concentration (wt.) of the surfactant of from about 0.07% to about 35%, preferably from about 0.07 to about 25%, and more preferably from about 0.35% to about 11%.

For example, in a front-loading, horizontal-axis European-type automatic washing machine using about 8 to 15 liters of water in the wash bath, a wash cycle of about 10 to about 60 minutes and a wash water temperature of about 30° C. to about 95° C., it is preferred to include from about 3 ppm to about 14,000 ppm, preferably from about 3 ppm to about 10,000 ppm, more preferably from about 15 ppm to about 4200 ppm, of the surfactant in the wash liquor. On the basis of usage rates of from about 45 ml to about 270 ml per wash load, this translates into an in-product concentration (wt.) of the surfactant of from about 0.1% to about 50%, preferably about 0.1% to about 35%, more preferably from about 0.5% to about 15%, for a heavy-duty liquid laundry detergent. On the basis of usage rates of from about 40 g to about 210 g per wash load, for dense ("compact") granular laundry detergents (density above about 650 g/l) this translates into an in-product concentration (wt.) of the surfactant of from about 0.12% to about 53%, preferably from about 0.12% to about 46%, and more preferably from about 0.6% to about 20%. On the basis of usage rates of from about 140 g to about 400 g per load for spray-dried granules (i.e., "fluffy"; density below about 650 g/1), this translates into an in-product concentration (wt.) of the surfactant of from about 0.03% to about 34%, preferably from about 0.03% to about 24%, and more preferably from about 0.15 % to about 10%.

For example, in a top-loading, vertical-axis Japanese-type automatic washing machine using about 26 to 52 liters of water in the wash bath, a wash cycle of about 8 to about 15 minutes and a wash water temperature of about 5° C. to about 25° C., it is preferred to include from about 0.67 ppm to about 270 ppm, preferably from about 0.67 ppm to about 236 ppm, more preferably from about 3.4 ppm to about 100 ppm, of the surfactant in the wash liquor. On the basis of usage rates of from about 20 ml to about 30 ml per wash load, this translates into an in-product concentration (wt.) of the surfactant of from about 0.1% to about 40%, preferably about 0.1% to about 35%, more preferably from about 0.5% to about 15%, for a heavy-duty liquid laundry detergent. On the basis of usage rates of from about 18 g to about 35 g per wash load, for dense ("compact") granular laundry detergents (density above about 650 g/l) this translates into an in-product concentration (wt.) of the surfactant of from about 0.1% to about 50%, preferably from about 0.1% to about 35%, and more preferably from about 0.5% to about 15%. On the basis of usage rates of from about 30 g to about 40 g per load for spray-dried granules (i.e., "fluffy"; density below about 650 g/l), this translates into an in-product concentration (wt.) of the surfactant of from about 0.06% to about 44%, preferably from about 0.06% to about 30%, and more preferably from about 0.3% to about 13%.

As can be seen from the foregoing, the amount of surfactant used in a machine-wash laundering context can vary, depending on the habits and practices of the user, the type of washing machine, and the like.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localized high concentrations of product in the drum of the washing machine at this stage of the wash cycle.

Preferred dispensing devices are reusable and are designed in such a way that container integrity is maintained in both the dry state and during the wash cycle. Especially preferred dispensing devices for use with the composition of the invention have been described in the following patents; GB-B-2, 157, 717, GB-B-2, 157, 718, EP-A-0201376, EP-A-0288345 and EP-A-0288346. An article by J.Bland published in Manufacturing Chemist, November 1989, pages 41–46 also describes especially preferred dispensing devices for use with granular laundry products which are of a type commonly know as the "granulette". Another preferred dispensing device for use with the compositions of this invention is disclosed in PCT Patent Application No. WO94/11562.

Especially preferred dispensing devices are disclosed in European Patent Application Publication Nos. 0343069 & 0343070. The latter Application discloses a device comprising a flexible sheath in the form of a bag extending from a support ring defining an orifice, the orifice being adapted to admit to the bag sufficient product for one washing cycle in a washing process. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

Machine dishwashing method

Any suitable methods for machine washing or cleaning soiled tableware, particularly soiled silverware are envisaged.

A preferred machine dishwashing method comprises treating soiled articles selected from crockery, glassware, hollowware, silverware and cutlery and mixtures thereof, with an aqueous liquid having dissolved or dispensed therein an effective amount of a machine dishwashing composition in accord with the invention. By an effective amount of the machine dishwashing composition it is meant from 8 g to 60 g of product dissolved or dispersed in a wash solution of volume from 3 to 10 liters, as are typical product dosages and wash solution volumes commonly employed in conventional machine dishwashing methods.

Packaging for the compositions

Commercially marketed executions of the bleaching compositions can be packaged in any suitable container including those constructed from paper, cardboard, plastic materials and any suitable laminates. A preferred packaging execution is described in European Application No. 94921505.7.

Rinse Aid Compositions and Methods:

The present invention also relates to compositions useful in the rinse cycle of an automatic dishwashing process, such compositions being commonly referred to as "rinse aids". While the hereinbefore described compositions may also be formulated to be used as rinse aid compositions, it is not required for purposes of use as a rinse aid to have a source of hydrogen peroxide present in such compositions (although a source of hydrogen peroxide is preferred, at least at low levels to at least supplement the carry-over).

The optional inclusion of a source of hydrogen peroxide in a rinse aid composition is possible in view of the fact that a significant level of residual detergent composition is carried over from the wash cycle to the rinse cycle. Thus, when an ADD composition containing a hydrogen peroxide source is used, the source of hydrogen peroxide for the rinse cycle is carry over from the wash cycle. Catalytic activity provided by the catalyst is thus effective with this carry-over from the wash cycle.

Thus, the present invention further encompasses automatic dishwashing rinse aid compositions comprising: (a) a catalytically effective amount of a catalyst as described herein, and (b) automatic dishwashing detergent adjunct materials. Preferred compositions comprise a low foaming nonionic surfactant. These compositions are also preferably in liquid or solid form.

The present invention also encompasses methods for washing tableware in a domestic automatic dishwashing appliance, said method comprising treating the soiled tableware during a wash cycle of an automatic dishwasher with an aqueous alkaline bath comprising a source of hydrogen peroxide, followed by treating the tableware in the subsequent rinse cycle with an aqueous bath comprising a catalyst as described herein.

In the following Examples, the abbreviations for the various ingredients used for the compositions have the following meanings.

| | |
|---|---|
| LAS | Sodium linear $C_{12}$ alkyl benzene sulfonate |
| C45AS | Sodium $C_{14}$–$C_{15}$ linear alkyl sulfate |
| CxyEzS | Sodium $C_{1x}$–$C_{1y}$ branched alkyl sulfate condensed with z moles of ethylene oxide |
| CxyEz | A $C_{1x-1y}$ branched primary alcohol condensed with an average of z moles of ethylene oxide |
| QAS | $R_2.N^+(CH_3)_2(C_2H_4OH)$ with $R_2 = C_{12}$–$C_{14}$ |
| TFAA | $C_{16}$–$C_{18}$ alkyl N-methyl glucamide |
| STPP | Anhydrous sodium tripolyphosphate |
| Zeolite A | Hydrated Sodium Aluminosilicate of formula $NA_{12}(AlO_2SiO_2)_{12}.27H_2O$ having a primary particle size in the range from 0.1 to 10 micrometers |
| NaSKS-6 | Crystalline layered silicate of formula $\delta$-$Na_2Si_2O_5$ |
| Carbonate | Anhydrous sodium carbonate with a particle size between 200 $\mu$m and 900 $\mu$m |
| Bicarbonate | Anhydrous sodium bicarbonate with a particle size distribution between 400 $\mu$m and 1200 $\mu$m |
| Silicate | Amorphous Sodium Silicate ($SiO_2$:$Na_2O$; 2.0 ratio) |
| Sodium sulfate | Anhydrous sodium sulfate |

-continued

| | |
|---|---|
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000. |
| CMC | Sodium carboxymethyl cellulose |
| Protease | Proteolytic enzyme of activity 4 KNPU/g sold by NOVO Industries A/S under the tradename Savinase |
| Cellulase | Cellulytic enzyme of activity 1000 CEVU/g sold by NOVO Industries A/S under the tradename Carezyme |
| Amylase | Amylolytic enzyme of activity 60 KNU/g sold by NOVO Industries A/S under the tradename Termamyl 60T |
| Lipase | Lipolytic enzyme of activity 100 kLU/g sold by NOVO Industries A/S under the tradename Lipolase |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium Percarbonate of nominal formula $2Na_2CO_3.3H_2O_2$ |
| NaDCC | Sodium dichloroisocyanurate |
| NOBS | Nonanoyloxybenzene sulfonate in the form of the sodium salt. |
| TAED | Tetraacetylethylenediamine |
| DTPMP | Diethylene triamine penta (methylene phosphonate), marketed by Monsanto under the Trade name Dequest 2060 |
| Photoactivated | Sulfonated Zinc Phthlocyanine encapsulated in bleach dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate. |
| HEDP | 1,1-hydroxyethane diphosphonic acid |
| SRP 1 | Sulfobenzoyl end capped esters with oxyethylene oxy and terephtaloyl backbone |
| Silicone antifoam | Polydimethylsiloxane foam controller with siloxane-oxyalkylene copolymer as dispersing agent with a ratio of said foam controller to said dispersing agent of 10:1 to 100:1. |
| DTPA | Diethylene triamine pentaacetic acid |

In the following Examples all levels are quoted as % by weight of the composition. The following examples are illustrative of the present invention, but are not meant to limit or otherwise define its scope. All parts, percentages and ratios used herein are expressed as percent weight unless otherwise specified.

EXAMPLE 1

The following laundry detergent compositions, A–F are prepared as follows:

| Ingredient | A | B | C | D | E | E | F |
|---|---|---|---|---|---|---|---|
| Transition-Metal Bleach Catalyst (1) | 0.1 | 0.5 | 1.0 | 2.0 | 10.0 | 2.0 | 1.0 |
| Detergent (2) | 5000 | 4000 | 1000 | 6000 | 5000 | 500 | 600 |
| Primary Oxidant (3) | 1200 | 500 | 200 | 1200 | 1200 | 50 | 30 |
| TAED (4) | 200 | 100 | 0 | 300 | 200 | 0 | 0 |
| C8–14 Bleach Activator (5) | 0 | 300 | 100 | 50 | 100 | 20 | 30 |
| Chelant (6) | 10 | 30 | 5 | 10 | 10 | 0 | 3 |

wherein the quantities are parts by weight, e.g., kg or ppm.

(1) is the catalyst of any of the foregoing syntheses, e.g., of Synthesis Example 1;

(2) is a commercial detergent granule, e.g., TIDE or ARIEL having no bleach or transition-metal catalyst; or another conventional detergent powder, for example one built with sodium carbonate and/or zeolite A or P;

(3) is sodium perborate monohydrate or sodium perborate tetrahydrate or sodium percarbonate;

(4) is tetraacetylethylenediamine or any equivalent polyacetylethylenediamine, such as an unsymmetrical derivative;

(5) is any hydrophobic bleach activator having a carbon chain length in the indicated range, e.g., NOBS (C9) or an activator producing NAPAA on perhydrolysis (C9);

(6) is a commercial phosphonate chelant, e.g., DTPA, or one from the DEQUEST series, or is S,S-ethylenediaminedisuccinate sodium salts.

The compositions are used for washing soiled fabrics in domestic U.S., European and Japanese automatic washing machines at water hardness in the range 0–20 gpg (grains per U.S. gallon) and temperatures in the range cold (ambient) to about 90 deg. C., more typically at room temperature to about 60 deg. C. The tabulated amounts can be read in any convenient weight unit, for example kilograms for formulating purposes or, for a single wash, parts per million in the wash liquor. The wash pH is in the general range from about 8 to about 10, depending on product use per wash and soiling levels. Excellent results are obtained on various soiled articles (nine replicates per stain), such as T-shirts stained with grass, tea, wine, grape juice, barbecue sauce, beta-carotene or carrots. Evaluations are made by five trained panelists, by a group of about 60 consumers, or by use of an instrument such as a spectrometer.

EXAMPLE 2

Laundry detergent compositions G-M are in accordance with the invention:

| Ingredient | G | H | I | J | K | L | M |
|---|---|---|---|---|---|---|---|
| Mn(Bcyclam)$Cl_2$ | 0.05 | 0.02 | 0.005 | 0.1 | 0.05 | 0.001 | 2.0 |
| PB4 | 10.0 | 9.0 | 9.0 | — | 8.0 | 12.0 | 12.0 |
| PB1 | 10.0 | — | — | 1.0 | — | — | — |
| Na Percarbonate | — | — | 1.0 | 10.0 | 4.0 | — | |
| TAED | — | 1.5 | 2.0 | 5.0 | 1.0 | 1.5 | 1.5 |
| NOBS | 5.0 | 0.0 | 0.0 | 0.5 | 0.1 | — | — |
| DETPMP | — | 0.3 | 0.3 | 0.1 | 0.2 | 0.5 | 0.5 |
| HEDP | 0.5 | 0.3 | 0.3 | 0.3 | 0.1 | 0.3 | 0.3 |
| DTPA | 0.5 | — | — | 0.1 | — | — | — |
| C11–C13 LAS | 20.0 | 8.0 | 7.0 | 8.0 | — | 8.0 | 12.0 |
| C25E3 or C23E7 | 2.0 | 3.0 | 4.0 | 3.0 | 7.0 | 3.0 | 3.0 |
| QAS | — | — | — | — | — | 1.0 | 2.0 |
| STPP | — | — | — | — | — | — | 30.0 |
| Zeolite A | 20.0 | — | 25.0 | 19.0 | 18.0 | 10.0 | — |
| Na Carbonate | 20.0 | 20.0 | 13.0 | 30.0 | 25.0 | 27.0 | 10.0 |
| Silicate, 1–3 r. | — | 1.5 | 2.0 | 3.0 | 3.0 | 3.0 | 5.0 |
| Protease | 0.2 | 0.3 | 0.3 | 0.3 | 0.3 | — | — |
| Amylase | — | 0.1 | 0.1 | — | 0.1 | 0.1 | — |
| Carezyme | 0.2 | — | 0.1 | — | — | — | — |
| MA/AA or Na-polyacrylate | 5.0 | 0.5 | 0.3 | 0.3 | 0.3 | 0.3 | 1.0 |
| CMC | — | 0.2 | 0.2 | 0.2 | 0.2 | 0.2 | 0.2 |
| sulfonated Zn- or Si phthalocyanine | — | 15 ppm | — | 20 ppm | — | 10 ppm | 5 ppm |
| Soil Release Polymer** | 0.2 | — | 0.5 | 0.2 | 1.0 | — | — |
| Brightener 1 | 0.2 | 0.1 | 0.1 | 0.1 | 0.1 | 0.1 | 0.1 |
| Perfume | 0.2 | 0.3 | — | 0.3 | 0.3 | 0.3 | 0.3 |
| Silicone antifoam | 0.2 | 0.4 | 0.5 | 0.3 | 0.5 | 0.5 | — |
| PEG | 1.0 | — | 1.0 | — | — | — | — |
| Moisture | 7.0 | 6.0 | 5.0 | 8.0 | 7.0 | 7.0 | 9.0 |
| Sodium sulfate and minors: -to- | 100% | 100% | 100% | 100% | 100% | 100% | 100% |
| Density (g/liter) | 500 | 800 | 750 | 850 | 850 | 850 | 650 |

The compositions are used for washing textiles as in the example supra. Moreover the compositions, including for example formulation G, can be used for soaking and hand-washing fabrics with excellent results.

EXAMPLE 3

Mn(Bcyclam)$Cl_2$ at levels in the range from about 0.001% to about 5% by weight is mixed with a white detergent powder containing 10% sodium perborate tetrahydrate, 20% zeolite A, 20% of a surfactant agglomerate and the balance sodium sulfate and moisture. The product is evaluated for aesthetic appeal and effectiveness by a series of focus groups of consumers compared with the same detergent powder to which has been added another catalyst outside the invention. The new Mn(Bcyclam)$Cl_2$-containing product is preferred by a majority of consumers in the panel. Accordingly, the new Mn(Bcyclam)$Cl_2$-containing product has benefits both of being visually preferred in product, and delivering improved bleaching.

EXAMPLE 4

Mn(Bcyclam)$Cl_2$ at levels in the range from about 0.001% to about 5% by weight is mixed with blue-speckled white detergent powders at levels in the range from about 0.001% to about 5% by weight. The products are evaluated for aesthetic appeal and effectiveness by a consumer panel compared with the same detergent powder to which has been added another catalyst outside the invention. The Mn(Bcyclam)$Cl_2$-containing product is preferred by a majority of consumers.

EXAMPLE 5

The following granular laundry detergent compositions A-G are prepared in accordance with the invention:

| | N | O | P | Q | R | S | T |
|---|---|---|---|---|---|---|---|
| Mn(Bcyclam)$Cl_2$ | 0.01 | 0.02 | 0.005 | 0.1 | 0.05 | 0.001 | 2.0 |
| PB4 | 5.0 | 9.0 | 9.0 | — | 8.0 | 12.0 | 12.0 |
| PB1 | — | — | — | 1.0 | — | — | — |
| Na Percarbonate | — | — | 1.0 | 10.0 | 4.0 | — | — |
| TAED | — | 1.5 | 2.0 | 5.0 | 1.0 | 1.5 | 1.5 |
| NOBS | 4.0 | 0.0 | 0.0 | 0.5 | 0.1 | — | — |
| DETPMP | — | 0.3 | 0.3 | 0.1 | 0.2 | 0.5 | 0.5 |

-continued

| | N | O | P | Q | R | S | T |
|---|---|---|---|---|---|---|---|
| HEDP | — | 0.3 | 0.3 | 0.3 | 0.1 | 0.3 | 0.3 |
| DTPA | 0.3 | — | — | 0.1 | — | — | — |
| C11–C13 LAS | 5.0 | 8.0 | 7.0 | 8.0 | — | 8.0 | 12.0 |
| C25E3 or C45E7 | 3.2 | 3.0 | 4.0 | 3.0 | 7.0 | 3.0 | 3.0 |
| QAS | — | — | — | — | — | 1.0 | 2.0 |
| STPP | — | — | — | — | — | — | 30.0 |
| Zeolite A | 10.0 | — | 15.0 | 19.0 | 18.0 | 10.0 | — |
| Na Carbonate | 6.0 | 10.0 | 20.0 | 30.0 | 25.0 | 27.0 | 10.0 |
| Silicate, 1–3 r. | 7.0 | 1.5 | 2.0 | 3.0 | 3.0 | 3.0 | 5.0 |
| Na-SKS-6 | — | 5.0 | 10.0 | — | — | — | — |
| Protease | 0.3 | 0.3 | 0.3 | 0.3 | 0.3 | — | — |
| Amylase | 0.1 | 0.1 | 0.1 | — | 0.1 | 0.1 | — |
| Lipase | 0.1 | — | 0.1 | — | — | — | — |
| MA/AA or Na-polyacrylate | 0.8 | 0.5 | 0.3 | 0.3 | 0.3 | 0.3 | 1.0 |
| CMC | 0.2 | 0.2 | 0.2 | 0.2 | 0.2 | 0.2 | 0.2 |
| Ca-montmorillonite | — | — | — | 5.0 | — | — | — |
| Soil Release Polymer | 0.2 | — | 0.5 | 0.2 | 1.0 | — | — |
| Brightener 1 | 0.1 | 0.1 | 0.1 | 0.1 | 0.1 | 0.1 | 0.1 |
| Perfume | 0.2 | 0.3 | — | 0.3 | 0.3 | 0.3 | 0.3 |
| Silicone antifoam | 0.2 | 0.4 | 0.5 | 0.3 | 0.5 | 0.5 | — |
| Moisture | 7.0 | 6.0 | 5.0 | 8.0 | 7.0 | 7.0 | 9.0 |
| Sodium sulfate and minors | to 100% | to 100% | to 100% | to 100% | to 100% | to 100% | to 100% |
| Density (g/liter) | 500 | 800 | 750 | 850 | 850 | 850 | 650 |

The compositions are used for washing textiles as in the examples supra.

EXAMPLE 6

The following detergent formulations are in accordance with the present invention:

| | U | V | W | X |
|---|---|---|---|---|
| Bleach Catalyst* | 0.02 | 0.05 | 0.1 | 1.0 |
| PB1 | 6.0 | 2.0 | 5.0 | 3.0 |
| NOBS | 2.0 | 1.0 | — | — |
| LAS | 15.0 | 14.0 | 14.0 | 18.0 |
| C45AS | 2.7 | 1.0 | 3.0 | 6.0 |
| TFAA | — | 1.0 | — | — |
| C25E5/C45E7 | — | 2.0 | — | 0.5 |
| C45E3S | — | 2.5 | — | — |
| Zeolite A | 30.0 | 18.0 | 30.0 | 22.0 |
| Silicate | 9.0 | 5.0 | 10.0 | 8.0 |
| Carbonate | 13.0 | 7.5 | — | 5.0 |
| Bicarbonate | — | 7.5 | — | — |
| DTPMP | 0.7 | 1.0 | — | — |
| SRP 1 | 0.3 | 0.2 | — | 0.1 |
| MA/AA | 2.0 | 1.5 | 2.0 | 1.0 |
| CMC | 0.8 | 0.4 | 0.4 | 0.2 |
| Protease | 0.8 | 1.0 | 0.5 | 0.5 |
| Amylase | 0.8 | 0.4 | — | 0.25 |
| Lipase | 0.2 | 0.1 | 0.2 | 0.1 |
| Cellulase | 0.1 | 0.05 | — | — |
| Brightener 1 | 0.2 | 0.2 | 0.08 | 0.2 |
| Polyethylene oxide of m.w. 5,000,000 | — | 0.2 | — | 0.2 |
| Bentonite clay | — | — | — | 10.0 |
| Balance (Moisture and Miscellaneous) | 100 | 100 | 100 | 100 |

*Mn(Bcyclam)$Cl_2$ according to Synthesis Example 1; or Synthesis Examples 2–7.

EXAMPLE 7

The following high density detergent formulations are according to the invention:

| | Y | Z |
|---|---|---|
| Agglomerate | | |
| C45AS | 11.0 | 14.0 |
| LAS | 3.0 | 3.0 |
| Zeolite A | 15.0 | 10.0 |
| Carbonate | 4.0 | 8.0 |
| MA/AA | 4.0 | 2.0 |
| CMC | 0.5 | 0.5 |
| DTPMP | 0.4 | 0.4 |
| Spray-On | | |
| C25E5 | 5.0 | 5.0 |
| Perfume | 0.5 | 0.5 |
| Dry-Add | | |
| LAS | 6.0 | 3.0 |
| HEDP | 0.5 | 0.3 |
| SKS-6 | 13.0 | 6.0 |
| Citrate | 3.0 | 1.0 |
| TAED | 5.0 | 7.0 |
| Percarbonate | 20.0 | 20.0 |
| Bleach Catalyst* | 0.5 | 0.1 |
| SRP 1 | 0.3 | 0.3 |
| Protease | 1.4 | 1.4 |
| Lipase | 0.4 | 0.4 |
| Cellulase | 0.6 | 0.6 |
| Amylase | 0.6 | 0.6 |
| Silicone antifoam | 5.0 | 5.0 |
| Brightener 1 | 0.2 | 0.2 |
| Brightener 2 | 0.2 | — |
| Balance (Moisture and Miscellaneous) | 100 | 100 |
| Density (g/liter) | 850 | 850 |

*The bleach catalyst Mn(Bcyclam)$Cl_2$ according to Synthesis Example 1 hereinbefore; benefits are also observable for compositions containing bleach catalysts according to Synthesis Examples 2–7.

EXAMPLE 8

A non-limiting example of bleach-containing nonaqueous liquid laundry detergent is prepared having the composition as set forth in Table I.

TABLE I

| Component | Wt. % | Range (% wt.) |
|---|---|---|
| Liquid Phase | | |
| $NaC_{12}$ Linear alkylbenzene sulfonate (LAS) | 25.3 | 18–35 |
| $C_{12-14}$, EO5 alcohol ethoxylate | 13.6 | 10–20 |
| Hexylene glycol | 27.3 | 20–30 |
| Perfume | 0.4 | 0–1.0 |
| Solids | | |
| Protease enzyme | 0.4 | 0–1.0 |
| $Na_3$ Citrate, anhydrous | 4.3 | 3–6 |
| Bleach Catalyst* | — | — |
| Sodium perborate | 3.4 | 2–7 |
| Sodium nonanoyloxybenzene sulfonate (NOBS) | 8.0 | 2–12 |
| Sodium carbonate | 13.9 | 5–20 |
| Diethyl triamine pentaacetic acid (DTPA) | 0.9 | 0–1.5 |
| Brightener | 0.4 | 0–0.6 |
| Suds Suppressor | 0.1 | 0–0.3 |
| Minors | Balance | — |

*The bleach catalyst Mn(Bcyclam)$Cl_2$ according to Synthesis Example 1 hereinbefore; benefits are also observable for compositions containing bleach catalysts according to Synthesis Examples 2–7.

The resulting composition is a stable anhydrous heavy duty liquid laundry detergent which provides excellent stain and soil removal performance when used in normal fabric laundering operations.

EXAMPLE 9

The following Example further illustrates the invention herein with respect to a hand dishwashing liquid.

| Ingredient | % (wt.) | Range (% wt.) |
|---|---|---|
| Ammonium $C_{12-13}$ alkyl sulfate | 7.0 | 2–35 |
| $C_{12}$–$C_{14}$ ethoxy (1) sulfate | 20.5 | 5–35 |
| Coconut amine oxide | 2.6 | 2–5 |
| Betaine/Tetronic 704 ®** | 0.87–0.10 | 0–2 (mix) |
| Alcohol Ethoxylate $C_8E_{11}$ | 5.0 | 2–10 |
| Ammonium xylene sulfonate | 4.0 | 1–6 |
| Ethanol | 4.0 | 0–7 |
| Ammonium citrate | 0.06 | 0–1.0 |
| Magnesium chloride | 3.3 | 0–4.0 |
| Calcium chloride | 2.5 | 0–4.0 |
| Ammonium sulfate | 0.08 | 0–4.0 |
| Bleach Catalyst* | 0.1 | 0.005–5.0 |
| Hydrogen peroxide | 200 ppm | 10–300 ppm |
| Perfume | 0.18 | 0–0.5 |
| Maxatase ® protease | 0.50 | 0–1.0 |
| Water and minors | Balance | |

*The bleach catalyst Mn(Bcyclam)$Cl_2$ according to Synthesis Example 1 hereinbefore; preferably wax-coated; benefits are also observable for compositions containing bleach catalysts according to Synthesis Examples 2–7.
**Cocoalkyl betaine.

The following Examples further illustrate the invention herein with respect to a granular phosphate-containing automatic dishwashing detergent.

EXAMPLE 10

| INGREDIENTS | % by weight of active material A | B |
|---|---|---|
| STPP (anhydrous)[1] | 31 | 26 |
| Sodium Carbonate | 22 | 32 |
| Silicate (2-ratio, hydrous) | 9 | 7 |
| Surfactant (nonionic, e.g., Plurafac, BASF) | 3 | 1.5 |
| Bleach Catalyst[2] | 0.01 | 0.1 |
| Sodium Perborate | 12 | 10 |
| TAED | — | 1.5 |
| Savinase (parts prill) | — | 0.2 |
| Termamyl (parts prill | | 0.5 |
| Sulfate | 25 | 25 |
| Perfume/Minors | to 100% | to 100% |

[1]Sodium tripolyphosphate
[2]The bleach catalyst Mn(Bcyclam)$Cl_2$ according to Synthesis Example 1 hereinbefore; benefits are also observable for compositions containing bleach catalysts according to Synthesis Examples 2–7.

EXAMPLE 11

In the following example, an automatic dishwashing detergent is provided which illustrates combining transition-metal bleach catalyst according to any of Synthesis Examples 1–7 with an inorganic peracid, sodium monopersulfate.

| INGREDIENTS | % by weight of active material A | B |
|---|---|---|
| STPP (anhydrous)[1] | 31 | 26 |
| Sodium Carbonate | 22 | 32 |
| OXONE monopersulfate | 5 | 10 |
| Surfactant (nonionic, e.g., Plurafac, BASF) | 3 | 1.5 |
| Bleach Catalyst[2] | 0.01 | 0.1 |
| Sodium Perborate | 12 | 1 |
| TAED | — | 1.5 |
| Savinase (parts prill) | — | 0.2 |
| Termamyl (parts prill | | 0.5 |
| Sulfate | 25 | 25 |
| Perfume/Minors | to 100% | to 100% |

[1]Sodium tripolyphosphate

EXAMPLE 12

In the following example, a method of use and composition therefor is provided in which a laundry additive product containing transition-metal catalyst according to Synthesis Example 1 is used to boost the bleaching action of a conventional bleach-containing detergent.

A conventional effervescent tablet containing sodium carbonate and sodium bicarbonate but no oxygen bleach is prepared in the manner known for use in denture cleaners. The tablet has incorporated therein 10% by weight of a transition-metal bleach catalyst according to Synthesis Example 1.

A laundry wash is carried out in the manner of Example 1, with the exception that the tablets and a commercial detergent with incorporated perborate bleach are added in two steps (as two separate products) to the wash. A control wash uses only conventional detergent. Improved bleaching is obtained for the treatment using the tablet.

EXAMPLE 13

In the following example, a method of use and composition therefor is provided in which a laundry additive product containing transition-metal catalyst according to Synthesis Example 1 is used to boost the bleaching action of a conventional non-bleach-containing detergent coupled with a conventional commercial chlorine bleach.

A powder-form laundry additive is prepared by mixing a transition-metal bleach catalyst according to Synthesis Example 1.(9%); sodium perborate monohydrate having a borate or silicate coating (10%); sodium tripolyphosphate (70%), sodium carbonate (9%), and PEG (2%, spray-on).

A laundry wash is carried out in the manner of Example 1, with the exception that the additive powder and a commercial detergent with 5% of incorporated perborate bleach are added in two steps (as two separate products) to the wash. A control wash uses only conventional detergent. Improved bleaching is obtained for the treatment using the tablet.

EXAMPLE 14

Transition-metal catalyst according to Synthesis Example 1 and sodium perborate (0.05%/10%) are added to an otherwise conventional product for soak/wash handwashing of laundry.

EXAMPLE 15

Transition-metal catalyst according to Synthesis Example 1 is added at 0.05% to an otherwise conventional denture cleaner with perborate bleach.

EXAMPLE 16

Transition-metal catalyst according to Synthesis Example 1 is added at 0.05% to an otherwise conventional commercial abrasive hard surface cleaner with sodium dihloroisocyanurate as primary oxidant.

EXAMPLE 17

Transition-metal catalyst according to Synthesis Example 1 in the form of a dilute aqueous solution is charged into one chamber of a dual-chamber liquid dispensing bottle. A dilute solution of stabilised peracetic acid is charged into the second compartment. The bottle is used to dispense a mixture of catalyst and peracetic acid as an additive into an otherwise conventional laundering operation in which no other bleach is present.

EXAMPLE 18

Transition-metal catalyst according to Synthesis Example 1 is adsorbed onto a large-pore zeolite (X or Y). The combination zeolite/catalyst system is used in for dye transfer inhibition in an otherwise conventional laundering operation.

EXAMPLE 19

Transition-metal catalyst according to Synthesis Example 1 is used at pH 8 in combination with a low-foaming nonionic surfactant (Plurafac LF404), sodium carbonate, an anionic polymeric dispersant (Sodium polyacrylate, m.w. 4,000) and peracetic acid in a low-pH cleaner for glass and plastics. The cleaner can be used in institutional as well as domestic contexts.

EXAMPLE 20

Transition-metal catalyst according to Synthesis Example 1 is finely ground and blended into a gel stick composition based on sodium stearate, pH-adjusting agents, aesthetics-modifying components, and optionally but preferably, low-pH bleach activators or preformed peracids, for example m-chloroperbenzoic acid. The stick is fabricated with the approximate dimensions of a lipstick. It is used as a pretreatment for shirt stains. The stick confers the advantage of providing a localized controlled pH environment for bleaching. Stains such as ballpoint pen are treated effectively by a method comprising the steps of (a) applying the stick to the localized soil and (b) putting the soiled article into an automatic laundering appliance with a charge of perborate-containing detergent.

EXAMPLE 21

A composition having similar effect and ingredients to that of Example 21 is provided, with the exception that the pH-control environment is delivered in a liquid vehicle based on nonionic surfactant and sodium bicarbonate, optionally with an excess of macrocyclic ligand as an organic tertiary-nitrogen buffer. The local pH where the liquid first contacts a soiled surface is determined to be about 8. The pretreated soiled surface is then dipped into a higher-pH solution (pH 10–11) comprising detersive surfactant and hydrogen peroxide.

EXAMPLE 22

Transition-metal catalyst according to Synthesis Example 1 and Laundering Example 1 is used in coated form. Any bleach-compatible coating, for example a waxy nonionic surfactant and/or a paraffin wax can be used.

EXAMPLE 23

Transition-metal catalyst according to Synthesis Example 1 and Laundering Example 1 is used in coated form. The transition-metal catalyst is used in a nonrecrystallized, purified, coated form. The purification procedure is the toluene wash/filtration procedure described in detail hereinabove in the specification.

EXAMPLE 24

Transition-metal catalyst according to Synthesis Example 1 at 0.2% is simply added to a commercial product for soaking diapers, based on sodium hypochlorite or sodium hypochlorite-releasing agents; or sodium percarbonate or an equivalent hydrogen peroxide source. Diapers are laundered in an overnight soak, demonstrating an improved effect on the removal of soils.

EXAMPLE 25

In the following example, a prepackaged single-dose composition is provided which has a cleaning component, a source of bleach, a transition-metal catalyst according to Synthesis Example 1, fabric-protecting polymers and a high-impact aesthetics system comprising multiple colorants (including bleach-sensitive colorants) and a perfume/pro-perfume system:

A multi-compartment water-soluble plastic film sachet having a plurality of separate sealable zones is charged with the following components:

A. Nonionic surfactant and colorant A (liquid or waxy phase)

B. Transition-metal bleach catalyst of Example 1, premixed with trisodium citrate as handling-promoting diluent C. Perfume D. Brightener E. Sodium perborate monohydrate F. 2,2-oxydisuccinate, sodium salt+sodium polyacrylate and colorant B G. NOBS/S,S-EDDS premix 1:0.5 and colorant C H. enzymatically hydrolysable pro-perfume (ester or acetal) (producing topnote "burst" by end of wash)

I. Fabric Care Polymer

J. Protease/Amylase Enzyme

Levels of ingredients can vary but include amounts conventional for Japanese washing conditions. The product is used in a Japanese automatic washing machine operating at ambient temperature to about 40 deg. C. to launder fabrics, offering pleasantness in use, combined with outstanding bleaching, cleaning and fabric care results. The product is preferably predissolved in warm water before before adding to the washing appliance if desired.

EXAMPLE 26

Liquid Fabric Softener

| Formulation Example: Ingredient | A Wt. % | B Wt. % | C Wt. % | D Wt. % | E Wt. % | F Wt. % |
|---|---|---|---|---|---|---|
| DEQA[1] | 25.0 | 23.3 | 23.3 | 23.3 | 25.0 | 23.3 |
| Ethanol | 4.0 | 3.65 | 3.65 | 3.65 | 4.0 | 3.65 |
| HCl | 0.01 | 0.74 | 0.74 | 0.74 | 0.01 | 0.74 |
| Chelant[2] | — | 2.50 | 2.50 | 2.50 | — | 2.50 |
| Ammonium Chloride | — | 0.10 | 0.10 | 0.10 | — | 0.10 |
| $CaCl_2$ | 0.46 | 0.50 | 0.50 | 0.50 | 0.46 | 0.50 |
| Silicone Antifoam[3] | 0.15 | 0.15 | 0.15 | 0.15 | 0.15 | 0.15 |
| Preservative[4] | 0.0003 | 0.0003 | 0.0003 | 0.0003 | 0.0003 | 0.0003 |
| Perfume | 0.5 | 3 | 1 | 0.5 | 2 | 1.00 |
| Soil Release Polymer[5] | 0.50 | 0.75 | 0.75 | 0.75 | 0.50 | 0.75 |
| Product of Example[6] | 2.5 ppm | 10 ppm | 5 ppm | 0.5 ppm | 1 ppm | 20 ppm |
| Water | to 100 | to 100 | to 100 | to 100 | to 100 | to 100 |

[1]Di-(soft-tallowyloxyethyl) dimethyl ammonium chloride or Distearyldimethylammonium chloride

[2]Diethylenetriamine Pentaacetic acid(3) DC-2310, sold by Dow-Corning

[3]DC-2310, sold by Dow-Corning

[4]Kathon CG, sold by Rohm & Has

[5]Copolymer of propylene terephthalate and ethyleneoxide

[6]$Mn(Bcyclam)Cl_2$ as in Synthesis Example 1

EXAMPLE 27

Dithiocyanato Manganese (II)

5,8 Dimethyl-1,5,8,12-tetraazabicyclo[10.3.2] heptadecane Synthesis

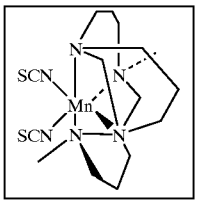

Synthesis of 1,5,9,13-Tetraazatetracyclo[11.2.2.2$^{5,9}$] heptadecane 1,4,8,12-tetraazacyclopentadecane (4.00 g, 18.7 mmol) is suspended in acetonitrile (30 mL) under nitrogen and to this is added glyoxal (3.00 g, 40% aqueous, 20.7 mmol). The resulting mixture is heated at 65° C. for 2 hours. The acetonitrile is removed under reduced pressure. Distilled water (5 mL) is added and the product is extracted with chloroform (5×40 mL). After drying over anhydrous sodium sulfate and filtration, the solvent is removed under reduced pressure. The product is then chromatographed on neutral alumina (15×2.5 cm) using chloroform/methanol (97.5:2.5 increasing to 95:5). The solvent is removed under reduced pressure and the resulting oil is dried under vacuum, overnight. Yield: 3.80 g, I (87%).

Synthesis of 1,13-Dimethyl-1,13-diazonia-5,9-diazatetracyclo[11.2.2.2$^{5,9}$]heptadecane diiodide 1,5,9,13-tetraazatetracyclo[11.2.2.2$^{5,9}$]heptadecane (5.50 g, 23.3 mmol) is dissolved in acetonitrile (180 mL) under nitrogen. Iodomethane (21.75 mL, 349.5 mmol) is added and the reaction is stirred at RT for 10 days. The solution is rotovapped down to a dark brown oil. The oil is taken up in absolute ethanol (100 mL) and this solution is refluxed 1 hour. During that time, a tan solid formed which is separated from the mother liquor by vacuum filtration using Whatman #1 filter paper. The solid is dried under vacuum, overnight. Yield: 1.79 g, II, (15%). Fab Mass Spec. TG/G, MeOH) $M^+$ 266 mu, 60%, $M^+$393 mu, 25%.

Synthesis of 5,8 Dimethyl-1,5,8,12-tetraazabicyclo [10.3.2]heptadecane

To a stirred solution of II, (1.78 g, 3.40 mmol) in ethanol (100 mL,95%) is added sodium borohydride (3.78 g. 0.100 mmol). The reaction is stirred under nitrogen at RT for 4 days. 10% Hydrochloric acid is slowly added until the pH is 1–2 to decompose the unreacted $NaBH_4$. Ethanol (70 mL) is then added. The solvent is removed by roto-evaporation under reduced pressure. The product is then dissolved in aqueous KOH (125 mL, 20%), resulting in a pH 14 solution. The product is then extracted with benzene (5×60 mL) and the combined organic layers are dried over anhydrous sodium sulfate. After filtering, the solvent is removed under reduced pressure. The residue is slurried with crushed KOH and then distilled at 97° C. at ~1 mm pressure. Yield: 0.42 g, III, 47%. Mass Spec. (D-CI/$NH_3$/$CH_2Cl_2$) $MH^+$, 269 mu, 100%.

Synthesis of Dithiocyanato Manganese (II)

5,8 Dimethyl-1,5,8,12-tetraazabicyclo[10.3.2] heptadecane

The ligand III, (0.200 g, 0.750 mmol) is dissolved in acetonitrile (4.0 mL) and is added to maganese(II) dipyridine dichloride (0.213 g, 0.75 mmol). The reaction is stirred for four hours at RT to yield a pale gold solution. The solvent is removed under reduced pressure. Sodium thiocyanate (0.162 g, 2.00 mmol) dissolved in methanol (4 mL) is then added. The reaction is heated 15 minutes. The reaction solution is then filtered through celite and allowed to evaporate. The resulting crystals are washed with ethanol and dried under vacuum. Yield: 0.125 g, 38%. This solid contains NaCl so it is recrystallized in acetonitrile to yield 0.11 g off a white solid. Elemental analysis theoretical: % C, 46.45, % H, 7.34, % N, 19.13. Found: % C, 45.70, % H, 7.10, % N, 19.00.

What is claimed is:

1. A laundry or cleaning composition comprising:

(a) from 1% to 49%, of a transition-metal bleach catalyst, said catalyst comprising a complex of a transition metal and a cross-bridged macropolycyclic ligand, wherein:

(1) said transition metal is selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV);

(2) said cross-bridged macropolycyclic ligand being coordinated by four or five donor atoms to the same transition metal and comprising:

(i) an organic macrocycle ring containing four or more donor atoms separated from each other by covalent linkages of 2 or 3 non-donor atoms, two to five of these donor atoms being coordinated to the same transition metal atom in the complex;

(ii) a cross-bridged chain which covalently connects at least 2 non-adjacent donor atoms of the organic macrocycle ring, said covalently connected non-adjacent donor atoms being bridgehead donor atoms which are coordinated to the same transition metal in the complex, and wherein said cross-bridged chain comprises from 2 to 10 atoms; and (iii) optionally, one or more non-macropolycyclic ligands, selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, pyridines, pyrazines, pyrazoles, imidazoles, benzimidazoles, pyrimidines, triazoles and thiazoles with R being H, optionally substituted alkyl, optionally substituted aryl;

(b) an oxygen bleaching agent, selected from the group consisting of molecular oxygen, hydrogen peroxide, perborate salt, percarbonate salt, and mixtures thereof; and (c) at least 0.1%, of one or more laundry or cleaning adjunct materials.

2. The composition according to claim 1 comprising a transition-metal bleach catalyst wherein the donor atoms in the organic macrocycle ring of the cross-bridged macropolycyclic ligand are selected from the group consisting of N, O, S, and P.

3. The composition according to claim 1 comprising a transition-metal bleach catalyst wherein all the donor atoms in the cross-bridged macropolycyclic ligand are selected from the group consisting of N and O.

4. The composition according to claim 1 comprising a transition-metal bleach catalyst wherein at least four of the donor atoms in the cross-bridged macropolycyclic ligand, form an apical bond angle with the same transition metal of 180±50° and at least one equatorial bond angle of 90±20°.

5. The composition according to claim 1 comprising a transition-metal bleach catalyst wherein two of the donor atoms in the cross-bridged macropolycyclic ligand, occupy mutually trans positions of the coordination geometry, and at least two of the donor atoms in the cross-bridged macropolycyclic ligand, occupy cis-equatorial positions of the coordination geometry.

6. A laundry or cleaning composition comprising:

(a) from 1 ppb to 49%, of a transition-metal bleach catalyst, said catalyst comprising a complex of a transition metal and a cross-bridged macropolycyclic ligand, wherein:

(1) said transition metal is selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), and;

(2) said cross-bridged macropolycyclic ligand is selected from the group consisting of:

(i) the cross-bridged macropolycyclic ligand of formula (I) having denticity of 4 or 5:

(I)

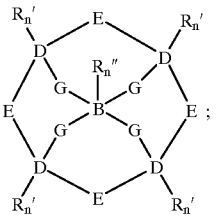

(ii) the cross-bridged macropolycyclic ligand of formula (II) having denticity of 5 or 6:

(II)

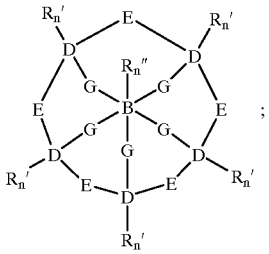

(iii) the cross-bridged macropolycyclic ligand of formula (III) having denticity of 6 or 7:

(III)

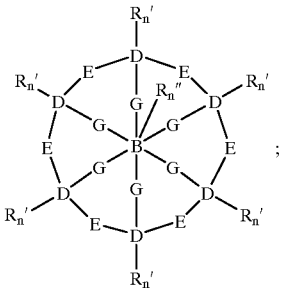

wherein in these formulas:

each "E" is the moiety $(CR_n)_a$—X—$(CR_n)_{a'}$, wherein —X— is selected from the group consisting of O, S, NR and P, or is a covalent bond, and for each E the sum of a+a' is independently selected from 1 to 5;

each "G" is the moiety $(CR_n)_b$;

each "R" is independently selected from H, alkyl, alkenyl, alkynyl, aryl, alkylaryl, and heteroaryl, or two or more R are covalently bonded to form an aromatic, heteroaromatic, cycloalkyl, or heterocycloalkyl ring;

each "D" is a donor atom independently selected from the group consisting of N, O, S, and P, and at least two D atoms are bridgehead donor atoms coordinated to the transition metal;

"B" is a carbon atom or "D" donor atom, or a cycloalkyl or heterocyclic ring;

each "n" is an integer independently selected from 1 and 2, completing the valence of the carbon atoms to which the R moieties are covalently bonded;

each "n'" is an integer independently selected from 0 and 1, completing the valence of the D donor atoms to which the R moieties are covalently bonded;

each "n"" is an integer independently selected from 0, 1, and 2 completing the valence of the B atoms to which the R moieties are covalently bonded;

each "a" and "a'" is an integer independently selected from 0–5, a+a' equals 2 or 3, wherein the sum of all "a" plus "a'" in the ligand of formula (I) is within the range of from about 8 to about 12, the sum of all "a" plus "a'" in the ligand of formula (II) is within the range of from about 10 to about 15, and the sum of all "a" plus "a'" in the ligand of formula (III) is within the range of from about 12 to about 18;

each "b" is an integer independently selected from 0–9, or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all "b" is within the range of from about 1 to about 5; and (iv) optionally, one or more non-macropolycyclic ligands, selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, pyridines, pyrazines, pyrazoles, imidazoles, benzimidazoles, pyrimidines, triazoles and thiazoles with R being H, optionally substituted alkyl, optionally substituted aryl; and (b) an oxygen bleaching agent, selected from the group consisting of molecular oxygen, hydrogen peroxide, perborate salt, percarbonate salt, and mixtures thereof; and (c) at least 0.1% of one or more laundry or cleaning adjunct materials.

7. The composition according to claim 6 comprising a transition-metal bleach catalyst wherein in the cross-bridged macropolycyclic ligand the D is selected from the group consisting of N and O.

8. The composition according to claim 6 comprising a transition-metal bleach catalyst wherein the transition metal is selected from manganese and iron.

9. The composition according to claim 6 comprising a transition-metal bleach catalyst wherein in the cross-bridged macropolycyclic ligand all "a" are independently selected from the integers 2 and 3, all X are selected from covalent bonds, all "a'" are 0, and all "b" are independently selected from the integers 0, 1, and 2.

10. The composition according to claim 6 comprising a transition-metal bleach catalyst wherein the molar ratio of transition metal to cross-bridged macropolycyclic ligand is 1:1.

11. The composition according to claim 6 wherein the transition-metal bleach catalyst comprises only one metal per catalyst complex.

12. The composition according to claim 6 comprising a transition-metal bleach catalyst wherein in the cross-bridged macropolycyclic ligand B is carbon or nitrogen.

13. The composition according to claim 6 wherein the transition-metal bleach catalyst comprises a tetradentate or pentadentate cross-bridged macropolycyclic ligand.

14. The composition according to claim 6 comprising a transition-metal bleach catalyst wherein all the donor atoms in the cross-bridged macropolycyclic ligand are selected from the group consisting of N and O.

15. The composition according to claim 6 comprising a transition-metal bleach catalyst wherein the cross-bridged macropolycyclic ligand comprises 4 or 5 donor atoms, all of which are coordinated with the same transition metal.

16. The composition according to claim 6 comprising a transition-metal bleach catalyst wherein the cross-bridged macropolycyclic ligand comprises 4 nitrogen donor atoms all coordinated to the same transition metal.

17. The composition according to claim 6 comprising a transition-metal bleach catalyst wherein the cross-bridged macropolycyclic ligand comprises 5 nitrogen atoms all coordinated to the same transition metal.

18. The composition according to claim 6 wherein the transition-metal bleach catalyst is a monometallic, mononuclear complex.

19. The composition according to claim 6 comprising a transition-metal bleach catalyst wherein at least four of the donor atoms in the cross-bridged macropolycyclic ligand, two of which form an apical bond angle with the same transition metal of 180±50° and two of which at least one equatorial bond angle of 90±20°.

20. The composition according to claim 6 comprising a transition-metal bleach catalyst having coordination geometry selected from distorted octahedral and distorted trigonal prismatic, and further wherein the cross-bridged macropolycyclic ligand is in the folded conformation.

21. The composition according to claim 6 comprising a transition-metal bleach catalyst wherein two of the donor atoms in the cross-bridged macropolycyclic ligand, occupy mutually trans positions of the coordination geometry, and at least two of the donor atoms in the cross-bridged macropolycyclic ligand, occupy cis-equatorial positions of the coordination geometry.

22. The composition according to claim 6 comprising a transition-metal bleach catalyst which comprises one or two non-macropolycyclic ligands.

23. The composition according to claim 6 comprising a transition-metal bleach catalyst wherein the cross-bridged macropolycyclic ligand comprises an organic macrocycle ring containing at least 12 atoms.

24. A method for cleaning fabrics or hard surfaces, said method comprising contacting a fabric or hard surface in need of cleaning with an aqueous solution of a composition according to claim 1.

* * * * *